US010011919B2

(12) United States Patent
Mayer et al.

(10) Patent No.: US 10,011,919 B2
(45) Date of Patent: Jul. 3, 2018

(54) ELECTROLYTE DELIVERY AND GENERATION EQUIPMENT

(71) Applicant: Lam Research Corporation, Fremont, CA (US)

(72) Inventors: Steven T. Mayer, Aurora, OR (US); Gregory Kearns, West Linn, OR (US); Richard G. Abraham, Sherwood, OR (US); Lawrence Ossowski, Tigard, OR (US)

(73) Assignee: Lam Research Corporation, Fremont, CA (US)

( * ) Notice: Subject to any disclaimer, the term of this patent is extended or adjusted under 35 U.S.C. 154(b) by 209 days.

(21) Appl. No.: 14/921,602

(22) Filed: Oct. 23, 2015

(65) Prior Publication Data

US 2016/0348265 A1 Dec. 1, 2016

Related U.S. Application Data

(60) Provisional application No. 62/168,198, filed on May 29, 2015.

(51) Int. Cl.
*C25D 21/18* (2006.01)
*C25B 15/08* (2006.01)
(Continued)

(52) U.S. Cl.
CPC ..... *C25D 21/18* (2013.01); *C25B 1/00* (2013.01); *C25B 15/02* (2013.01); *C25B 15/08* (2013.01); *C25D 3/30* (2013.01)

(58) Field of Classification Search
CPC ..... C25D 21/18
See application file for complete search history.

(56) References Cited

U.S. PATENT DOCUMENTS 4,789,439 A 12/1988 Bunk et al.
5,082,538 A 1/1992 DeRespiris et al.
(Continued)

FOREIGN PATENT DOCUMENTS

CN 103137994 A 6/2013
CN 104160067 A 11/2014
WO WO 2009019333 A1 * 2/2009 ..... C25D 3/30

OTHER PUBLICATIONS

CN Office Action dated Dec. 5, 2017 in CN Application No. 201610369815.6.

*Primary Examiner* — Bryan D. Ripa
(74) *Attorney, Agent, or Firm* — Weaver Austin Villeneuve & Sampson LLP

(57) ABSTRACT

An apparatus for automatically generating a metal-containing electrolyte (e.g., an electrolyte containing $Sn^{2+}$ ions and an acid) includes an anolyte chamber configured to house an active anode (e.g., a metallic tin anode), an anolyte, and a sensor (e.g., one or more sensors) measuring a concentration of metal ions in the anolyte; a catholyte chamber configured to house a hydrogen-generating cathode and a catholyte; and a controller having program instructions for processing data from the sensor and for automatically generating an electrolyte having metal ions in a target concentration range in the anolyte chamber. In some embodiments, the apparatus is in communication with an electroplating apparatus and is capable to deliver the generated electrolyte to the electroplating apparatus on demand. In some embodiments, a densitometer and a conductivity meter are together used as sensors, and the apparatus is configured to generate low alpha tin electrolyte containing an acid.

24 Claims, 36 Drawing Sheets

(51) Int. Cl.

| | |
|---|---|
| ***C25B 15/02*** | (2006.01) |
| ***C25B 1/00*** | (2006.01) |
| ***C25D 3/30*** | (2006.01) |

(56) References Cited

U.S. PATENT DOCUMENTS

| | | | | |
|---|---|---|---|---|
| 5,312,539 | A * | 5/1994 | Thomson | C25D 3/30 204/DIG. 13 |
| 2004/0182694 | A1* | 9/2004 | Nevosi | C25D 21/18 204/252 |
| 2007/0235392 | A1 | 10/2007 | Edwards | |
| 2010/0116674 | A1 | 5/2010 | Luo et al. | |
| 2012/0298502 | A1* | 11/2012 | Papapanayiotou | C25D 17/001 204/237 |
| 2013/0341196 | A1 | 12/2013 | Silinger et al. | |
| 2014/0166492 | A1* | 6/2014 | Shimoyama | C25D 21/14 205/82 |
| 2014/0332393 | A1* | 11/2014 | Shimoyama | C25D 21/18 205/101 |

* cited by examiner

ELECTROLYTE DELIVERY AND GENERATION EQUIPMENT

CROSS-REFERENCE TO RELATED APPLICATIONS

This application claims benefit under 35 U.S.C. § 119(e) to U.S. Provisional Patent Application No. 62/168,198, filed May 29, 2015, which is herein incorporated by reference in its entirety.

FIELD OF THE INVENTION

This invention pertains to an apparatus and method for generating electroplating liquid (electrolyte) for electroplating metals on semiconductor substrates in a semiconductor fabrication facility. In one implementation this invention pertains to an apparatus and method for generating $Sn^{2+}$-containing electrolyte from tin metal.

BACKGROUND

Tin is a metal that is often used in fabrication of semiconductor devices (e.g., in solder bumps). Tin and its alloys (e.g., tin-silver) can be deposited by electrodeposition on a partially fabricated semiconductor device using an electrolyte containing $Sn^{2+}$ ions, and, typically, an acid. Tin, however, is often contaminated with elements that emit alpha particles that are detrimental to the function of semiconductor devices. Specifically, alpha particles are known to cause so-called "soft errors" in data storage devices. Therefore, a special grade and type of tin electrolyte, an electrolyte that contains very low amount of alpha particle emitters, should be used for electroplating tin in semiconductor devices. This electrolyte is referred to as low alpha tin electrolyte. The specification for "low alpha tin", as used herein, refers to tin having an alpha emission rate of less than 0.002 counts (alpha disintegrations) per hour per square centimeter. The alpha emission rate is typically measured from a metallic tin layer that has been plated from low alpha tin electrolyte. While such electrolyte is commercially available, it is extremely expensive. Tin metal (referring to tin in zero oxidation state) is also available in low alpha tin form, purified from a mixture of various alpha emitting isotopes and aged to ensure that residual radioactive isotopes have followed their decay paths and have finished their fission processes. The metallic low alpha tin is significantly less expensive than low alpha tin electrolyte. The high cost of low alpha tin electrolyte is due to the significant cost of manufacturing, certification, packaging and shipping from the place of origin to the place of use of the acidic hazardous liquid electrolyte, which is added to the moderately high cost of low alpha tin raw material that is used to manufacture the electrolyte. Commercial low alpha tin metal is 4 to 20 times less expensive than the tin in the electrolyte product, on a metal content basis, after shipping costs are taken into account.

SUMMARY

A method and an apparatus for generating electrolyte from a metal (in zero oxidation state) directly in the semiconductor fabrication facility are provided. The method and the apparatus can be used to generate electrolytes containing a variety of metal ions, including tin, nickel, and copper ions from tin, nickel and copper metals respectively. Tin, and particularly low alpha tin electrolyte, is generated by the apparatus in many illustrative embodiments, but the invention is not so limited.

There is a substantial economic advantage in producing the electrolyte "on-site" in the semiconductor fabrication facility. Furthermore, when the electrolyte is manufactured on-site, in some embodiments, the same tool that manufactures the electrolyte is also configured to deliver the generated electrolyte to the electroplating tool. This design is characterized by an advantageously efficient use of equipment, materials and space, as well as by reduced on-site labor costs and by improved operator safety, since the need to pour electrolyte from barrels to the electroplating baths is minimized or eliminated. In some embodiments, the on-site automated electrolyte manufacturing and delivery apparatus is designed to communicate with the electroplating tool (e.g., SABRE 3D™ electroplating tool, available from Lam Research Corp. of Fremont, Calif.) to respond to operator and process-protocol requests for additional electrolyte.

In one aspect, an apparatus for generating an electrolyte containing metal ions is provided. In one embodiment the apparatus includes: (a) an anolyte chamber configured to contain an active anode and an anolyte, wherein the apparatus is configured to electrochemically dissolve the active anode into the anolyte; (b) a first catholyte chamber separated from the anolyte chamber by a first anion permeable membrane, wherein the first catholyte chamber is configured to contain a first catholyte; and (c) a second catholyte chamber configured to contain a cathode and a second catholyte, wherein the second catholyte chamber is separated from the first catholyte chamber by a second anion permeable membrane. The anolyte chamber includes an inlet for receiving a fluid; an outlet for removing the anolyte; and one or more sensors configured for measuring a concentration of metal ions in the anolyte. In some embodiments the active anode is a low alpha tin anode, and the apparatus is configured to generate low alpha tin electrolyte as the anolyte in the anolyte chamber.

In some implementations, the first catholyte chamber and the second catholyte chamber are parts of a removable cathode-housing assembly, wherein the removable cathode-housing assembly is configured to be releasably inserted into the anolyte chamber.

In some embodiments the apparatus is configured to deliver the first catholyte from the first catholyte chamber to the anolyte chamber through a fluidic conduit, e.g., a fluidic line and/or to remove the first catholyte from the first catholyte chamber to a drain. It is noted that ion-permeable membranes, as used herein, are not classified as fluidic conduits (although a small amount of fluid may be transferred through the membrane along with the ions).

In some embodiments the first catholyte chamber and the second catholyte chamber are fluidically connected through a fluidic conduit, wherein the fluidic conduit allows for transfer of the second catholyte from the second catholyte chamber to the first catholyte chamber.

In some embodiments the apparatus includes a single piece metal anode in the anolyte chamber. In other embodiments the anode is composed of a plurality of metal pieces and the anolyte chamber includes an ion-permeable container for containing these metal pieces that collectively form the anode. In those embodiments, where the anode is formed by a plurality of metal pieces, the anolyte chamber may further include a receiving port for receiving the plurality of metal pieces into the ion-permeable container. In some embodiments the receiving port includes a gravity fed hopper and may further be equipped with a sensor configured to communicate to a system controller when the level of metal pieces in the port is low.

The provided apparatus typically includes a hydrogen-generating cathode positioned in the second catholyte chamber. The apparatus may include a diluent gas conduit configured to deliver a diluent gas to a space above the second catholyte, and to dilute hydrogen gas accumulating in that space, wherein the space above the second catholyte is covered with a first lid having one or more openings that allow for transfer of diluted hydrogen gas into a space above the first lid. In some embodiments the apparatus further includes: a second lid over the first lid and spaced apart from the first lid such that there is a space between the first and the second lids; and a second diluent gas conduit configured to deliver a diluent gas to a space between the first and second lids and to move the diluted hydrogen gas from the space between the first and second lids towards an exhaust.

In some implementations of the provided apparatus the anolyte chamber comprises a cooling system. In some embodiments the cooling system is located in a cooling portion of the anolyte chamber away from the anode. In these embodiments the apparatus may further include a fluidic conduit and an associated pump configured to deliver the anolyte from the anolyte chamber outlet located proximate the anode to the cooling portion of the anolyte chamber.

In some embodiments the apparatus is configured to measure the concentration of metal ions in the anolyte with one or more sensors, and to communicate the measurement to the apparatus controller. In some embodiments the one or more sensors include at least two sensors: a densitometer, and a conductivity meter which allow for accurate determination of metal ion concentration in the presence of acid, where acid concentration may fluctuate. In some embodiments one or more sensors (e.g., a combination of a densitometer and a conductivity meter) are also configured for measuring the amount of acid in the anolyte. In some embodiments the preferred conductivity meter is an inductive probe.

In some implementations the apparatus includes a controller having program instructions for automatically generating electrolyte having a concentration of metal ions in a target range.

In some embodiments the apparatus further includes a storage container in fluidic communication with the anolyte chamber and with an electroplating cell, wherein the apparatus is configured for automated transfer of the anolyte from the anolyte chamber to the storage container, and from the storage container to the electroplating cell.

In some embodiments the apparatus further includes a buffer tank in fluidic communication with the anolyte chamber, and with a replaceable tote, wherein the buffer tank is configured to receive an acid solution from the replaceable tote and to deliver the acid to the anolyte chamber. In some embodiments the apparatus is further configured for identifying the low level of acid in the replaceable tote and for providing a signal for tote replacement.

In another aspect, an apparatus for automatically generating an electrolyte containing metal ions, is provided, wherein the apparatus includes: (a) an anolyte chamber configured to contain an active anode and an anolyte, wherein the apparatus is configured to electrochemically dissolve the active anode into the anolyte, and to thereby form the electrolyte containing metal ions, wherein the anolyte chamber comprises: (i) an inlet for receiving a fluid; (ii) an outlet for removing the anolyte; and (iii) one or more sensors configured for measuring a concentration of metal ions in the anolyte; (b) a catholyte chamber configured to contain a cathode and a catholyte, wherein the catholyte chamber is separated from the anolyte chamber by an anion permeable membrane; and (c) a controller having program instructions for automatically generating an electrolyte having a concentration of metal ions in the anolyte chamber in a target range using data provided by the one or more sensors.

In another aspect a system is provided, wherein the system includes: (a) an electroplating apparatus that utilizes an electrolyte containing metal ions; (b) an electrolyte-generating apparatus configured for automatic generation of the electrolyte, wherein the electrolyte-generating apparatus is in communication with the electroplating apparatus; and (c) one or more system controllers comprising program instructions for communicating demand for electrolyte from the electroplating apparatus to the electrolyte-generating apparatus and for generating electrolyte having concentration of metal ions in a target range.

In another aspect, a method of generating an electrolyte containing metal ions is provided, wherein the method includes: (a) passing current through an electrolyte-generating apparatus, wherein the apparatus comprises: (i) an anolyte chamber containing an active metal anode and an anolyte; and (ii) a catholyte chamber containing a cathode and a catholyte, wherein the catholyte chamber is separated from the anolyte chamber by an anion-permeable membrane, wherein the anode is electrochemically dissolved into the anolyte as current is passed; (b) measuring concentration of metal ions in the anolyte, and automatically communicating the concentration to an apparatus controller, wherein the apparatus controller comprises program instructions for processing the data on concentration of metal ions and for automatically instructing the apparatus to act based on these data; and (c) automatically transferring a portion of the anolyte from the anolyte chamber to an electrolyte storage container, when concentration of metal ions in the anolyte falls within a target range.

In some embodiments the concentration of metal ions in the anolyte is measured by a combination of a densitometer and a conductivity meter. In some embodiments the anode comprises low alpha tin metal and the anolyte comprises $Sn^{2+}$ ions. In some embodiments the anolyte further comprises acid, and the method further comprises measuring concentration of acid in the anolyte; automatically communicating concentration of acid to the apparatus controller, wherein the apparatus controller comprises program instructions for processing the data on acid concentration and for instructing the apparatus to act based on these data. For example, the method may involve automatically adding acid to the anolyte if the concentration of acid is less than a target concentration range.

In some embodiments the method further comprises dosing the anolyte with an acidic solution, after a portion of the anolyte has been transferred to the storage container, and repeating operations (a)-(c). In some embodiments no more than 10% of the total volume of anolyte is transferred from the anolyte chamber per one (a)-(c) cycle. In some embodiments, the method involves performing at least three (a)-(c) cycles with addition of acid to anolyte after each cycle. In some embodiments the anolyte and catholyte comprise an acid selected from the group consisting of methansulfonic acid (MSA), sulfuric acid, and mixtures thereof.

According to another implementation, a non-transitory computer machine-readable medium is provided, wherein the medium includes program instructions for control of an electrolyte generating apparatus. The instructions include code for electrolyte generation methods provided herein, and may further include instructions for storage of generated electrolyte in a storage tank and delivery of the electrolyte to an electroplating apparatus.

In some embodiments systems and methods provided herein are integrated with photolithographic patterning processes. In one aspect, a system is provided, wherein the system includes an electrolyte generating apparatus provided herein and a stepper. The system typically further includes an electroplating apparatus in association with the electrolyte generating apparatus. In some embodiments, a method is provided, wherein the method includes generating electrolyte as described herein and further includes electroplating metal on a semiconductor substrate using the generated electrolyte. In some embodiments the method further includes: applying photoresist to the wafer substrate; exposing the photoresist to light; patterning the photoresist and transferring the pattern to the wafer substrate; and selectively removing the photoresist from the wafer substrate.

DETAILED DESCRIPTION

Figure 1A:
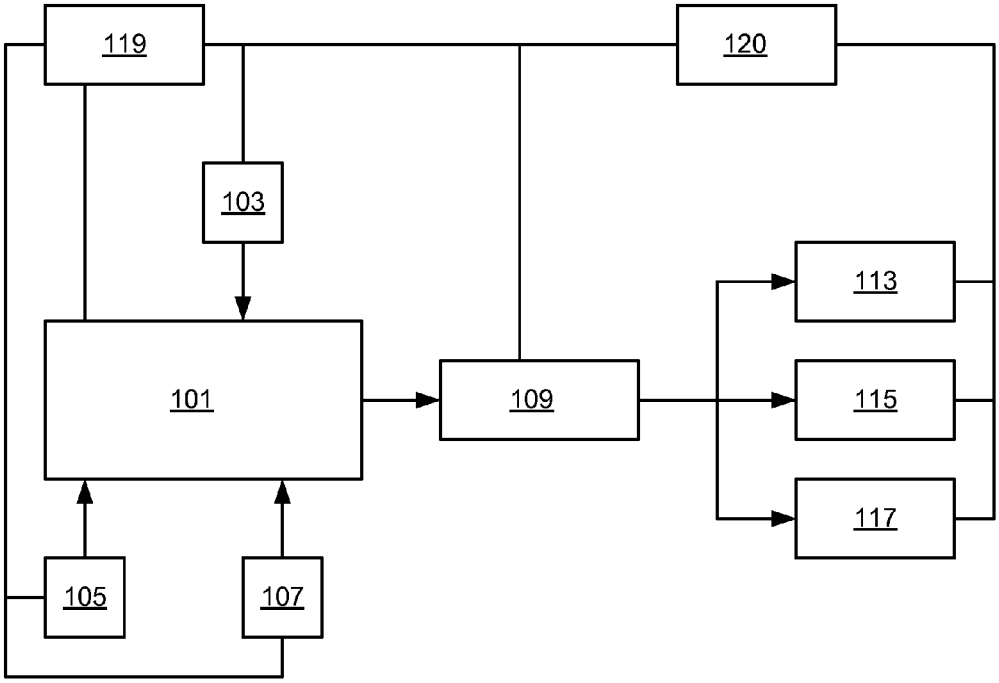
FIG. 1A is a schematic presentation of a system having an electrolyte generating apparatus in communication with an electroplating apparatus according to an embodiment presented herein.

An apparatus for generating an electrolyte for an electroplating apparatus is provided. The apparatus is configured to generate an electrolyte having a desired concentration of metal ions, and, in some embodiments, a desired concentration of acid. The apparatus is illustrated using generation of an acidic low alpha tin electrolyte from a low alpha tin anode as an example, but it is understood that the apparatus can be used to generate a variety of electrolytes, such as an electrolyte containing nickel ions from a nickel anode, an electrolyte containing copper ions from a copper anode, etc. The apparatus can also be used to generate non-acidic electrolytes, such as electrolytes having a pH of greater than 7 (e.g., basic electrolytes containing complexing agents).

In some embodiments the apparatus is capable of generating an electrolyte with a concentration of metal ions that fluctuates by no more than about 15%, such as by no more than about 10% (e.g., by no more than 7%) of the desired concentration in the output electrolyte. For example, if the desired concentration of tin ions in the electrolyte is 300 g/L, the apparatus is capable of generating an electrolyte having tin concentration within the range of 255-345 g/L, such as within the range of 270-330 g/L, more preferably within the range of 280-320 g/L. The range of concentrations that are acceptable for a given purpose is referred herein as a target concentration range and as a "broad target concentration range". For example, the electroplating apparatus may require a stock of tin electrolyte with a desired tin ion concentration of 300 g/L and with acceptable fluctuation of concentration of no more than 7%. In this case the electroplating apparatus is configured to generate an electrolyte with the broad target concentration range of tin ions ($Sn^{2+}$) of between about 280-320 g/L.

In some embodiments, the electrolyte generating apparatus is also capable of generating electrolyte having a stable concentration of acid (e.g., sulfuric acid, an alkylsulphonic acid, such as MSA, and mixtures thereof). The range of acid concentrations that is acceptable for a given purpose is referred to herein as a target acid concentration range or a "broad target acid concentration range". In some embodiments, the concentration of acid in the electrolyte product fluctuates by no more than 25%, such as by no more than 20% of the desired acid concentration. For example, in some embodiments, the electroplating solution should have a target MSA concentration of 45 g/L with a fluctuation of no more than 10 g/L. The electrolyte generator, in this case, will generate the electrolyte with a broad target concentration range of acid of between about 35-55 g/L. In some embodiments the fluctuation of MSA concentration in the electrolyte product should be no more than 5 g/L, such that the concentration of MSA is within a broad target concentration range of between about 40-50 g/L.

In addition to the term "broad target concentration range", the term "narrow target concentration range" will be used herein to indicate a concentration range of an electrolyte component, which is sufficiently close to the desired concentration, such that no correction of electrolyte generation process parameters is required. For example if a broad target concentration range for tin ions is 280-320 g/L and a narrow target concentration range is between about 290-310 g/L, an electrolyte product with tin ion concentration of 300 g/L (within both broad and narrow ranges) would not trigger any corrective action for the apparatus, but an electrolyte product with a tin ion concentration of 315 g/L (within broad range, but outside the narrow range), would indicate that the generated electrolyte is acceptable as a product, but a corrective action should be taken in subsequent electrolyte generation to lower the tin ion concentration to the narrow target range.

The terms "broad target range" and "narrow target range" apply not only to concentrations themselves, but also to electrolyte properties that correlate with concentrations of electrolyte components, such as density, conductivity, and optical density. The meaning of these terms is similar to those described above. Thus "broad target range" indicates that this range is acceptable and does not require process shut-down, while "narrow target range" indicates that this range is not only acceptable at the time of measurement, but also does not raise any red flags that would trigger process parameter adjustment for generation of a future batch. For example if the broad target density range for generated product is between about 1.48-1.52 g/cm$^3$, it means that an electrolyte with a density falling outside of this range is not acceptable as a product. If the narrow target density range is between about 1.49-1.51 g/cm$^3$, it means that an electrolyte with a density falling outside of this range but within the broad target range would be acceptable as a product, but that the apparatus will need to take a corrective action and modify electrolyte generation process parameters, in order to bring the density in future batches of electrolyte to the narrow target density range.

In some embodiments, the generation of electrolyte is partially or completely automated. Automation, as used herein, refers to execution of process steps (such as addition of one or more chemical components and/or removal of the produced electrolyte) with reduced or eliminated manual labor. For example one or more of the following examples of automation can be used, in one apparatus. In some embodiments, one or more physicochemical properties of the electrolyte being manufactured are automatically measured by one or more sensors and these are used to determine the concentration of metal ions in the electrolyte (i.e. the electrolyte properties are automatically measured) as the electrolyte is being generated, and these data are electronically communicated to the process controller, where the process controller has program instructions for removing the electrolyte to the storage container once a target concentration of metal ions has been reached, and/or for diluting the electrolyte if the concentration exceeds the target concentration range. In some embodiments the controller is programmed to remove a portion of the electrolyte to a storage container, after a pre-determined amount of charge has passed through the apparatus, wherein the pre-determined amount of charge is the amount of charge that is necessary to bring the metal ion concentration in the electrolyte into the broad target range. The calculation of the required charge is made based on Faraday's law. The controller may also be programmed to process data from a sensor measuring metal concentration in the electrolyte (including any property correlating with the metal concentration), before the electrolyte is transferred to the storage container. The controller can allow the transfer if the concentration falls within the broad target range, and disallow the transfer, if the concentration falls outside of the broad target range. The controller may also be programmed to modify process parameters for future electrolyte generation, if the measured metal concentration falls outside of the narrow target range, while still being within the broad target range.

In some embodiments, the concentration of acid is automatically measured by one or more sensors during generation of electrolyte, and these data are communicated to a controller that has program instructions for automatically adding more acid if the concentration of acid is insufficient, or for automatically diluting the electrolyte with water if the concentration of acid is too high.

It is understood that the "concentration measurement" by a sensor can refer to the measurement of any property that correlates with the concentration. For example, the concentration measurement of tin ions can be performed by measuring the density of the electrolyte (provided the concentration of acid is known), while measurement of acid concentration can be performed by measuring the conductivity of the electrolyte (provided the concentration of tin ions is known). In some embodiments it is preferable to measure both the conductivity and density of the electrolyte (e.g., anolyte), since both of these parameters positively correlate with metal ion concentration and acid concentration. Therefore, if both density and conductivity are measured, the combined data can be used to accurately determine both metal ion concentration and acid concentration in the electrolyte. In some embodiments, where the concentration of acid is known to be relatively stable during the electrolyte generation process, only density measurement of electrolyte may be sufficient to accurately gauge the concentration of metal ions in the electrolyte solution. In some embodiments, particularly where acid concentration in the electrolyte is relatively low, the density of electrolyte will most strongly depend on metal ion concentration, and density measurement can be used to approximately measure the concentration of metal ions, while conductivity may not be necessary to be measured, or may be measured less frequently than density. In one of preferred embodiments, both density and conductivity of an acidic tin electrolyte are measured to determine both tin concentration in the anolyte, and acid concentration in the anolyte.

The measurement of electrolyte properties "during electrolyte generation" or "as the electrolyte is generated", does not imply that that the electrolyte properties are measured necessarily only when current is applied to the electrodes of the electrolyte generator, as the measurements can be taken both during application of current, and after the current has stopped (e.g., when the generation process includes cycles having "current-on" and "current-off" periods).

Another example of automation is an automated replenishment of anode material. In some embodiments, a metal in the form of pellets is automatically added to an anode container, where automation is achieved using a gravity fed hopper: as anodic metal is dissolved during electrolyte generation, additional pellets from the hopper fall under gravity into the anode container to fill the space freed by the dissolved pellets. In addition, a sensor may automatically measure the level of pellets in the hopper and may send a signal to an operator when replenishment of the hopper is needed, or if the amount of added pellets is too large. In some embodiments, the only steps that are performed manually during electrolyte generation are periodic (e.g. once a week) addition of metal pellets to the gravity fed hopper, and an exchange of an acid-carrying container (tote) that provides acid solution for the electrolyte generating apparatus for a full container.

In one aspect, a system is provided, wherein the system includes an electroplating apparatus that utilizes an electrolyte containing metal ions and an electrolyte-generating apparatus configured for automatic generation of the electrolyte, wherein the electrolyte-generating apparatus is in communication with the electroplating apparatus. The communication may be fluidic, signaling, or both fluidic and signaling. When the electroplating apparatus and the electrolyte generating apparatus are in fluidic communication, the system includes fluidic features (such as electrolyte delivery lines, electrolyte storage container, valves, pumps, etc.) that are configured to deliver the electrolyte produced in the electrolyte generator to the electroplating apparatus. When there is a fluidic communication between the electrolyte-generating apparatus, and the electroplating apparatus there is no need to manually carry and pour the electrolyte into the container of the electroplating tool, as the metered (pre-determined) amount of electrolyte having known concentration, is provided and delivered by the electrolyte-generating apparatus. When there is a signaling communication between the electroplating apparatus and the electrolyte-generating apparatus, the electroplating apparatus is configured to signal to the electrolyte-generating apparatus when electrolyte is needed. For example the system may include a system controller (which may include one or multiple controllers) having program instructions for communicating demand for electrolyte from the electroplating apparatus to the electrolyte generating apparatus, and for generating an electrolyte having a target concentration of metal ions. In some embodiments, a single system controller can be configured to communicate with both the electroplating apparatus and the electrolyte generating apparatus using an electrical or wireless communication, and provide all instructions for operation of both tools and for their communication with each other. In an alternative embodiment, each tool (the electroplating apparatus and the electrolyte-generating apparatus) has its own controller having program instructions for operating each tool respectively, where the controller of one of the tools (e.g., the controller of the electroplating tool) is configured to communicate with the other tool (e.g., the electrolyte generation and delivery tool) and is configured to request action from the other tool. For example the controller of the electroplating tool can be configured to demand delivery of electrolyte from the electrolyte-generating tool and may include instructions for turning on a pump and opening a delivery valve to allow generated electrolyte to flow from the electrolyte-generating tool into the requesting electroplating tool and its associated electroplating bath. The amount of the delivered electrolyte "dose" can be regulated by an additional intermediary system controller, the dose-receiving electroplating tool's controller, or the delivering electrolyte-generating tool's controller.

The provided methods and apparatus can be used to generate low alpha tin electrolyte for use in a variety of electroplating apparatuses, such as in apparatuses with an inert (dimensionally stable) anode, and in apparatuses, containing an active low alpha tin anode. The provided electrolyte can be used as the main electrolyte when the inert anode is used, or as an additional electrolyte for a make-up stream, or other additional streams if an active tin anode is used. Examples of electroplating apparatuses that use an active anode are provided in the US Patent Application Publication No. 2012/0138471 filed on Nov. 28, 2011 by Mayer et al. titled "ELECTROPLATING APPARATUS AND PROCESS FOR WAFER LEVEL PACKAGING" and in the US Patent Application Publication No. 2013/0334052 filed on May 24, 2013 by Lee Peng Chua et al. titled "PROTECTING ANODES FROM PASSIVATION IN ALLOY PLATING SYSTEMS", which are herein incorporated by reference in their entireties.

The electrolyte-generating equipment provided herein, in one embodiment, is configured to interface with a SABRE 3D™ apparatus available from Lam Research Corp. of Fremont, Calif., and is configured to deliver electroplating electrolyte on demand to the electroplating apparatus in desired quantities and with desired composition (with desired components and concentrations). It is understood that the electrolyte delivered from the electrolyte-generating apparatus to the electroplating tool may be modified before it enters the electroplating cell, e.g., via dilution, concentration, mixing with an acid or with electroplating additives (such as accelerators, levelers, wetting agents, carriers and suppressors), or it may enter the electroplating cell without modification.

A schematic presentation of an example of an automated system for generating, storing and delivering electrolyte to an electroplating apparatus is shown in FIG. 1A. In the depicted example, the system includes an electrolyte generating apparatus 101, connected to the source of metal pellets 103, a source of acid 105 (e.g., a concentrated aqueous solution of an acid in a container, such as an aqueous solution of methanesulfonic acid, sulfuric acid, sulfamic acid, and combinations thereof), and a source of water 107. The electrolyte-generating apparatus 101 has an outlet that is fluidically connected to an electrolyte storage container 109, which in turn is fluidically connected to three electroplating apparatuses 113, 115, and 117 to which the electrolyte is delivered on demand from the electrolyte storage container 109. The electrolyte is configured to be delivered to plating baths of the electroplating tools 113, 115, and 117 independently, in the amount that is demanded by each tool. The system provided in the depicted embodiment contains two system controllers: the controller 119 of the electrolyte-generating apparatus, and the controller 120 of the electroplating tools 113, 115, 117 (in other embodiments each electroplating tool has its own controller). The controller 119 is in signaling communication (e.g., electrically and/or wirelessly) with all of the components of the electrolyte-generating tool, and includes program instructions for automatically delivering acid and water to the electrolyte generating apparatus from the sources of water and acid, and for removing the electrolyte to the storage container 109 when target concentration of metal ions is achieved. The controller 120 is in signaling communication with the controller 119, and is programmed to communicate the demand from the electroplating tools 113, 115, and 117, and to deliver the electrolyte from the storage container 109 to the baths of the electroplating tools 113, 115, and 117 based on the demand.

Figure 1B:
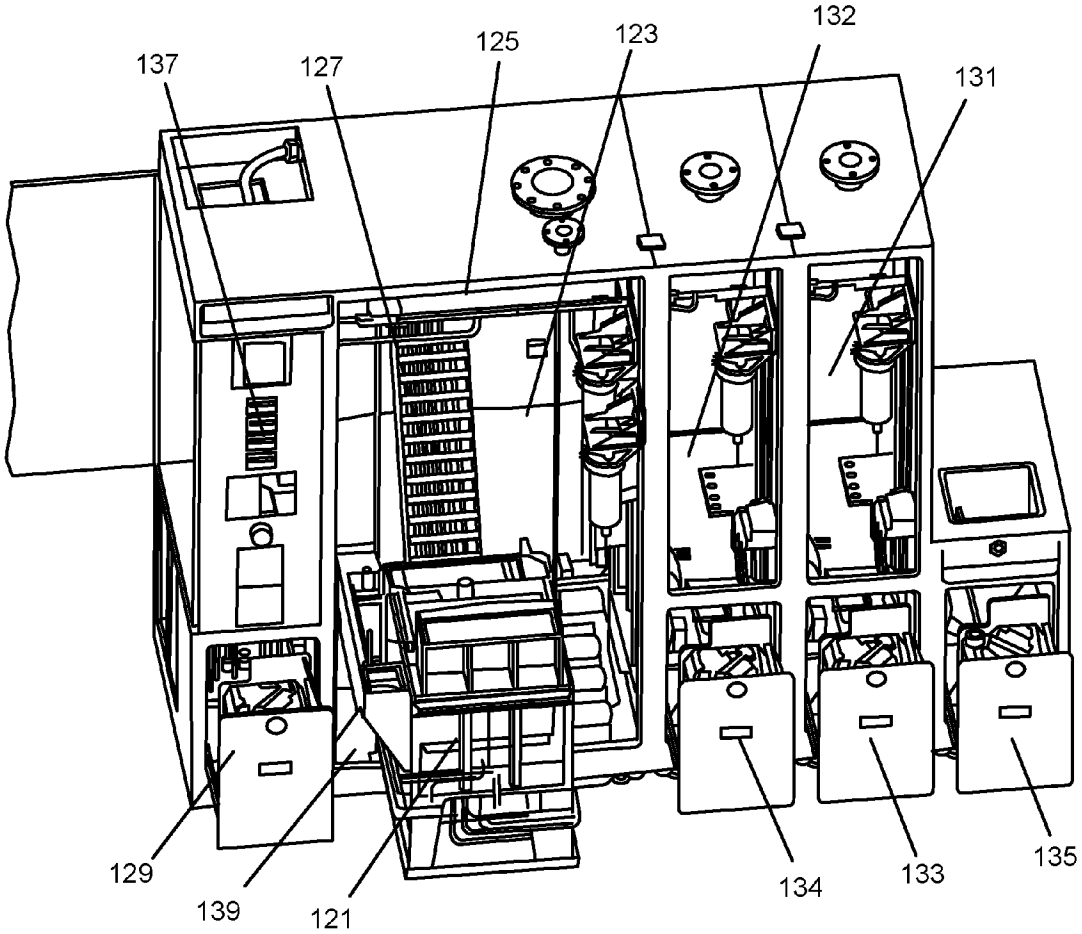
FIG. 1B is a schematic isometric view of a modular system having an electrolyte generating apparatus according to an embodiment provided herein.

The electrolyte generating apparatus provided herein can be integrated into a modular system for use in a semiconductor fabrication facility. FIG. 1B illustrates an example of an arrangement of system components in a modular design. In this example, tin electrolyte is generated in the tin electrolyte-generating apparatus 121 that is housed in the tin generator compartment 123. The tin generator compartment 123 further houses an electrolyte storage tank 125, which receives the electrolyte product from the electrolyte-generating apparatus 121. The generated electrolyte is pumped out of the electrolyte generator 121, is passed through a filter housed in the tin generator compartment 123 and is directed to the storage tank 125 through one of a plurality of fluidic connections 127. The electrolyte is stored in the storage container, and is directed to an electroplating apparatus (not shown) through a fluidic conduit when the electroplating apparatus requests electrolyte. Adjacent to tin generator compartment 123, is an acid storage compartment 129, which is configured to house a removable container with a concentrated solution of acid (e.g., MSA) that may be optionally connected to an acid buffer container. The role of the acid buffer container is to provide an uninterrupted source of acid during the time when the removable container (an acid tote) is being replaced or is being replenished with acid. In some embodiments the acid tote is housed in the acid tote drawer of the acid storage compartment 129. The acid buffer container and the removable acid container are fluidically connected to the electrolyte-generating apparatus 121 through one of the plurality of the fluidic conduits 127, and the apparatus is configured to deliver defined amounts of acid solution to the electrolyte-generating apparatus on demand. Furthermore, in some embodiments the same source of acid (the buffer acid container and/or a removable acid container) from the acid storage compartment 129 is fluidically connected to an electroplating apparatus (not shown), and the apparatus is configured to deliver defined amounts of acidic solution to the electroplating apparatus on demand. In other embodiments, the electroplating apparatus may use a separate source of acid that is not shared with the electrolyte-generating apparatus.

The compartment 131 is configured to house a source of a different electroplating liquid, a source of a different acid than in acid storage compartment 129, or an electroplating additive source. In various embodiments this electroplating liquid may contain ions of copper, nickel, indium, iron, tin (from a different source or at a different concentration than in 125), cobalt or mixtures of any of these ions. In some embodiments the electroplating liquid housed in this compartment is an acidic solution of a salt of any of the metals listed above. The source of this different electrolyte may be a removable container (a tote) and/or a buffer container holding the pre-manufactured electrolyte that is fluidically connected to an electroplating apparatus. In some embodiments the tote with this different electrolyte is housed in a tote drawer 133 within the compartment 131, where the tote is fluidically connected to an electrolyte buffer tank, that is also housed in 131. The apparatus is configured to deliver defined amounts of this electrolyte to an electroplating apparatus upon request. In addition to compartment 131, the illustrated modular system includes a compartment 132, which is configured to house a source of a different electroplating liquid, a source of a different acid than in acid storage compartment 129, or an electroplating additive source, where the chemistry housed in compartment 132 is different from the chemistry housed in compartment 131. The compartment 132 is organized similarly to compartment 131 and includes a drawer 134 configured to house a removable tote containing the provided electroplating solution, acid or an additive. The removable tote may be fluidically connected to a buffer tank, which is fluidically connected to an electroplating apparatus. Thus, in illustrated configuration compartments 131 and 132 serve as sources of different electroplating chemistries for an electroplating tool.

The modular configuration illustrated herein allows the operator to compactly house the generated tin electrolyte, a pre-manufactured different type of electrolyte, and an acid source in a plurality of compartments. In addition, the provided system may include compartment 135, which is a drawer that is configured to house a removable container (a tote) and to fill this tote with the electrolyte generated by the electrolyte-generating apparatus 121. The apparatus is configured to allow one to draw electrolyte from the tin electrolyte storage tank 125 and move it into an empty tote housed in the drawer 135. For example, 20 liters of tin electrolyte can be drawn from the tin electrolyte storage tank into an empty tote placed in station 135 in order to provide additional storage capacity, or for a manual delivery of electrolyte from tin electrolyte filled tote to a plating tool that is not connected to the tin electrolyte generator 121.

In some embodiments, the presence of an acid buffer tank fluidically disposed between the electrolyte generator and a removable acid tote allows for uninterrupted automated supply of acid to the electrolyte generator. In some embodiments the apparatus is configured to determine when the level of acid in the removable acid tote is low, or to otherwise detect that the acid in the tote is used, and to provide a signal for replacing the acid tote with a filled tote. The acid buffer tank is configured to receive acid from the acid tote and to deliver the acid to the electrolyte generator (anolyte and/or catholyte chamber), and is typically configured such that it does not run out of acid during electrolyte generation.

The system further includes a controller, such as a program logic controller (PLC), which has program instructions for performing electrolyte generation and delivery, monitoring the equipment for various errors, and interlock safety. The controller is electrically connected with an output display 137 (e.g., a touchscreen display), which allows the operator to monitor operation of the system, and to provide commands to the controller, when needed. The system is connected with facilities 139, which provide sources of deionized water, and inert and/or diluent gases (nitrogen and compressed dry air) that can be used during operation of the system. Liquid cooling water (LCW) is also supplied as a means of generator heat removal via the internal heat exchange coils. Alternatively, cool circulating fluid may be supplied by a liquid cooling water recirculating refrigeration unit.

Several embodiments of the electrolyte generating apparatus will be illustrated. In one embodiment the electrolyte generating apparatus includes an anolyte chamber configured to contain an active anode and an anolyte, where the apparatus is configured to electrochemically dissolve the active anode into the anolyte, and to thereby form the electrolyte containing metal ions. In other words, the active anode contains a metal that is electrochemically oxidized to form metal ions in the anolyte, according to reaction (1), where M is metal, $e^-$ is an electron, and n is the number of electrons removed from the metal in oxidation $$M \rightarrow M^{n+} + ne^- \quad (1)$$

When the active anode is a tin anode, the tin is electrochemically oxidized to form tin (II) ions, according to reaction (2).

$$Sn \rightarrow Sn^{2+} + 2e^- \text{tm} \quad (2)$$

When low alpha tin is used as the tin anode, the anode material contains only small amounts of alpha emitting impurities and the resulting electrochemical dissolution of low alpha tin metal forms low alpha tin electrolyte that has low concentration of alpha particle emitters, as desired.

The anolyte chamber has an inlet for receiving one or more fluids, an outlet for removing the anolyte and at least one sensor configured for measuring concentration of metal ions in the anolyte. Examples of fluids that can be introduced through the inlet into the anolyte chamber include water, a concentrated aqueous solution of an acid, a more dilute aqueous solution of an acid, an electrolyte containing acid and a metal salt, and combinations thereof. The apparatus typically includes one or more pumps configured for delivering one or more of these fluids into the anolyte chamber. The outlet in the anolyte chamber serves for removal of portions of anolyte (where the portions may have variable sizes) from the anolyte chamber. A pump is typically used to remove the anolyte from the anolyte chamber. For example, a portion of the anolyte can be pumped out of the anolyte chamber through the anolyte chamber outlet, when the concentration of metal ions in the anolyte reaches a target concentration range. In some embodiments the anolyte chamber is further equipped with a cleaning and draining system, which allows the anolyte to be recirculated and filtered during recirculation. The same system may be adapted to remove a portion of the anolyte to a drain, when needed. In one example of anolyte recirculation, a portion of the anolyte is removed from the anolyte chamber through the outlet in the anolyte chamber, passed through a filter to remove particles, and is returned to the anolyte chamber after filtration.

In some embodiments, the anolyte chamber may include more than one sensor. For example, a set of sensors configured for measuring the concentration of acid and metal ions in the anolyte can be included. An example of such set of sensors is a combination of a densitometer and a conductivity meter. The sensors configured for measuring the concentrations of metal ions and acid concentration generally can measure any set of properties of the anolyte that can be correlated with metal ion and acid concentrations. For example, when tin electrolyte is generated, the sensor for measuring tin ion concentration can be a densitometer that measures the density of anolyte. When the densitometer is used in combination with a conductivity meter, both tin ion concentration and acid concentration can be accurately determined.

Figure 12A:
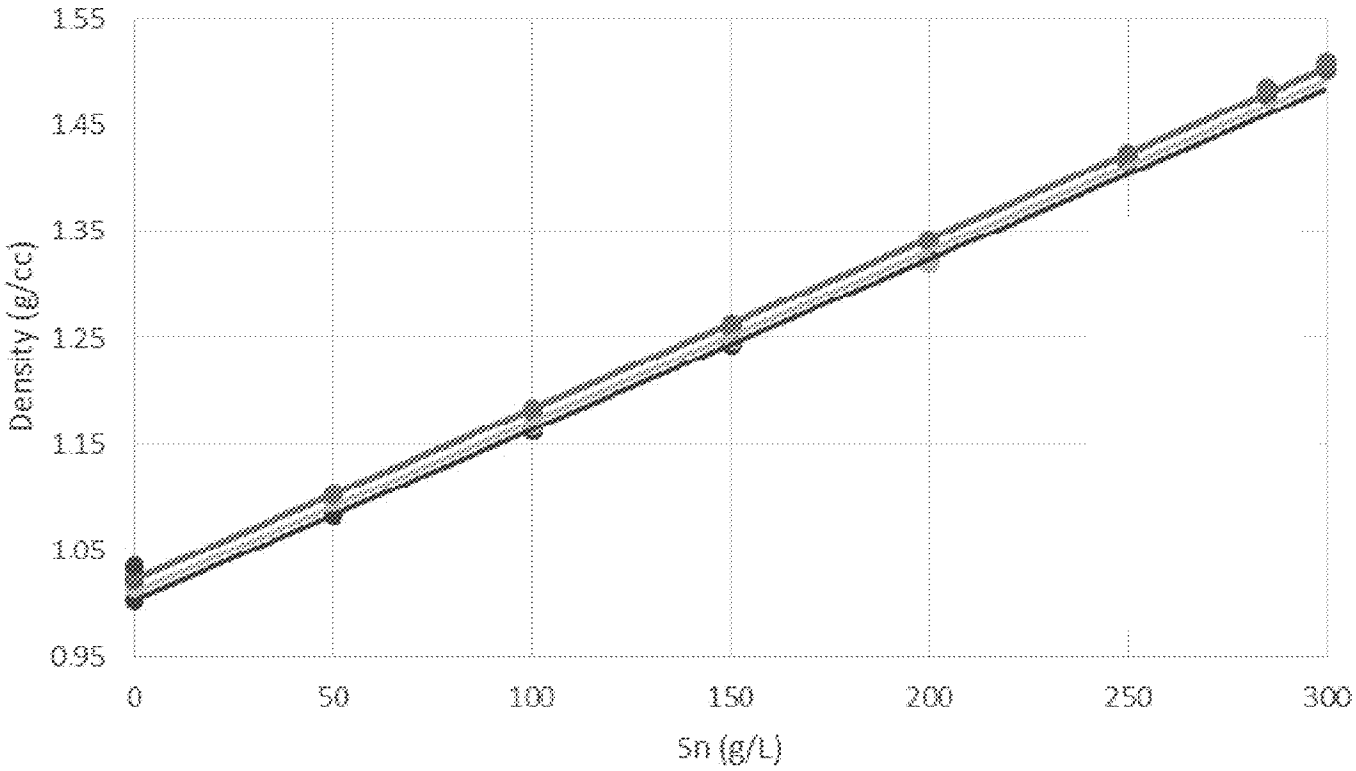
FIGS. 12A-12B are experimental plots illustrating linear dependence of solution density on tin ion concentration.

If the concentration of acid in the anolyte is relatively low and/or is known to have only small fluctuations, a densitometer alone can be used to measure tin ion concentrations. This is due to the strong correlation of anolyte density alone with the concentration of heavy metal (e.g. tin) ions and due to relatively weak dependence of density on acid concentration. An experimental plot, showing dependence of density on metal ion concentration at various fixed concentrations of acid shows relatively weak dependence of density on acid concentration, as can be seen in FIG. 12A. When conductivity is measured in addition to density in the same solution, a more accurate determination of metal ion concentration can be made using a plot showing dependence of conductivity on metal ion concentration at various fixed concentrations of acid. When the electrolyte generator is used to generate electrolyte having spectrophotometrically active ions (such as copper or nickel ions), the sensor measuring metal ion concentration may be a spectrophotometer which allows for measurement of the metal ion concentration in even more facile way than measurement of tin ion concentration through the use of density. In the case of spectrophotometrically active ions, one can accurately determine concentrations of metal ions in anolyte using plots of optical absorbance dependence on metal ion concentrations. Further, data on conductivity for various metal ion concentrations and acid concentration, can be used to determine the concentration of acid.

The electrolyte generating apparatus further includes a catholyte chamber configured to contain a cathode and a catholyte, wherein the catholyte chamber is separated from the anolyte chamber by an anion permeable membrane. This separation may be direct or indirect. For example, when the separation is direct, the cathode-housing chamber and the anode-housing chamber are directly adjacent to each other and there is a membrane between these two chambers. When the separation is indirect, there may be one or more additional chambers, between the anode-housing chamber and the cathode-housing chamber. These chambers are typically also separated from each other by anion-permeable membranes.

The catholyte chamber preferably contains an inert, hydrogen-generating catalytic cathode. Examples of such cathodes include titanium or stainless steel cathodes coated with platinum or with iridium oxide, where the coating catalyzes the cathodic reaction. Such coatings are provided, for example, by Optimum Anode Technologies of Camarillo, Calif. A cathodic reaction is shown in equation (3).

$$2H^+ + 2e^- \rightarrow H_2 \quad (3)$$

The separation membrane allows the anions to pass through the membrane, but preferably prevents metal ions from passing. The purpose of the membrane is to keep the catholyte substantially free from the ions of the metal, which, if present, would be reduced at the cathode and will lead to its degradation. The membrane allows anions, such as methanesulfonate, and sulfate to pass through the membrane, when current is applied to the electrodes. In some implementations, water and acid (e.g., MSA) may also pass through the membrane, when current is applied. Examples of suitable anionic membranes include polymers functionalized with quaternary ammonium moieties, provided on a support structure. One example of such polymeric functionalized anionic membrane is Fumasep® FAB-PK-130 PEEK (polyether ether ketone) reinforced anion exchange membrane available from Fumatech of Bietigheim-Bissingen, Germany.

Figure 2:
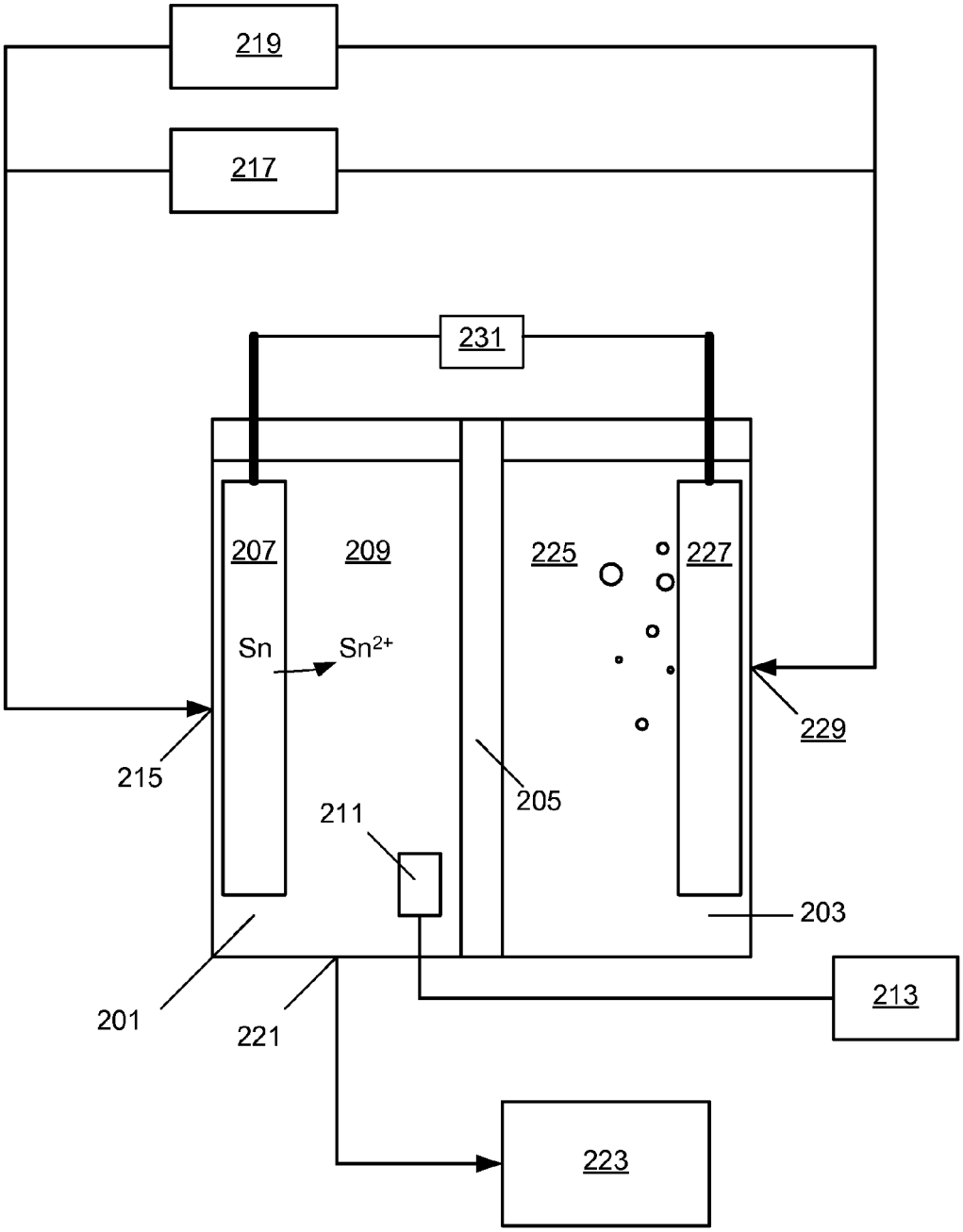
FIG. 2 is a schematic cross-sectional view of an electrolyte generating apparatus according to an embodiment provided herein.

One embodiment of an electrolyte generating apparatus is illustrated by FIG. 2, which shows a cross-sectional schematic view of an apparatus where the anode-holding chamber 201 and a cathode-holding chamber 203 are directly separated by an anion-permeable membrane 205. The low alpha tin anode 207 resides in anolyte 209, which initially (before current is applied to the electrodes) is composed of an aqueous solution of acid (e.g., methansulfonic acid and/or sulfuric acid), and, in some embodiments, may include $Sn^{2+}$ ions in addition to the acid. As the anode 207 is dissolved during the electrolyte generating process, the concentration of $Sn^{2+}$ ions in the anolyte is increased. The concentration of the tin ions is measured during the generation process by a densitometer 211, which is in communication with the controller 213. Alternatively, the concentration of the tin ions is measured by a combination of a densitometer and a conductivity meter. The anolyte chamber 201 has an inlet 215 for receiving an aqueous solution of acid (e.g., methanesulfonic acid or sulfuric acid) from the source of acid 217, and deionized water from the source of deionized water 219. In those embodiments, where the anolyte initially contains a solution of $Sn^{2+}$ ions, a pre-made, or commercially available solution containing tin salt and, preferably, an acid is initially added through the inlet to the anolyte chamber to bring the starting concentration of tin ions and acid to a desired range.

The anolyte chamber 201 further includes an outlet 221 for removing anolyte 209 to an electrolyte storage tank 223 (e.g., when the concentration of tin ions reaches a target concentration), or to a drain. In some embodiments, there is also an anolyte recirculation loop associated with the anolyte chamber. Portions of the anolyte can be removed from the anolyte chamber through the outlet, and after filtration they can be returned to the anolyte chamber through the inlet.

The catholyte chamber 203 contains the catholyte 225 (typically containing the same type of acid as the anolyte, but often at a higher concentration) and a hydrogen generating cathode 227. In the depicted example the catholyte chamber has an inlet 229 for receiving acid from the source of acid 217, and deionized water from the source of deionized water 219. In some embodiments the catholyte chamber further includes an outlet, and an associated fluidic conduit that allows for removal of portions of catholyte to a drain. The membrane 205 is permeable to anions but is substantially non-permeable to metal cations. Therefore, the concentration of tin ions in the catholyte is kept at a negligible level. A power supply 231 is electrically connected with the anode 207 and the cathode 227, and is configured to bias the cathode negatively relatively to the anode and to cause dissolution of the tin anode into the anolyte. The controller 213 is in communication with the electroplating apparatus and has program instructions for adjusting any of the parameters of electrolyte generating process, such as removal of electrolyte from the anolyte chamber to the electrolyte storage tank, addition of acid and water selectively to anolyte and catholyte, duration of application of current by the power supply, the level of current that is being applied, etc.

The electrolyte generating apparatus shown in FIG. 2 can be improved in one or several aspects, according to several embodiments provided herein. The improvements may relate to management of tin ion distribution in the electrolyte, automation of reagent dosing and feedback, removal of released hydrogen, and management of released heat. It is understood that not all of the improvements described with reference to FIGS. 3-5 need to be present in a single apparatus, as the apparatus may include any combination of features described herein.

It was observed that a single anion-permeable membrane between the anolyte chamber and the catholyte chamber may not be entirely sufficient for blocking tin ions from migrating from anolyte to catholyte. The presence of tin ions in the catholyte is highly undesirable, as they tend to be reduced to tin metal at the cathode and, in large quantities, can make the cathode unusable. In order to address this problem, an apparatus configuration with one or more additional catholyte chambers in addition to the cathode-housing catholyte chamber is provided. Thus, such apparatus includes a first catholyte chamber configured to contain a first catholyte and separated from the anolyte chamber by a first anion-permeable membrane, and a second catholyte chamber configured to contain the cathode and a second catholyte, wherein the second catholyte chamber is separated from the first catholyte chamber by a second anion-permeable membrane. Both anion-permeable membranes are configured to impede migration of cations, such as tin ions, through the membrane, and, therefore, migration of tin ions to the cathode will be significantly less pronounced than in a configuration with a single membrane. It is understood that the membrane separating the first catholyte chamber and the anolyte chamber may separate them directly or indirectly. When the separation is direct, the anolyte chamber is directly adjacent to the first catholyte chamber. When the separation is indirect, one or more additional catholyte chambers may be present between the first catholyte chamber and the anolyte chamber.

In one embodiment the electrolyte generating apparatus is equipped with a catholyte-to-anolyte cascade where the apparatus includes a fluidic conduit that is configured for delivering catholyte from the first catholyte chamber to the anolyte chamber. The purpose of this conduit is twofold. First, it can be used to replenish the anolyte with acid (since catholyte is an acidic solution in an embodiment, where acidic tin electrolyte is generated). It can be used instead of or in combination with the direct addition of acid to the anolyte from an external acid source. Secondly, the first catholyte chamber can contain a small amount of tin ions that could have inadvertently migrated through the first anion-permeable membrane. The removal of a portion of the first catholyte helps flush the tin ions from the first catholyte, thereby reducing the possibility of tin ion migration through the second anion-permeable membrane to the cathode-housing second catholyte chamber. This apparatus configuration is illustrated in FIG. 3A, which shows a schematic cross sectional view of an electrolyte generator, having a catholyte-to-anolyte cascade and an anolyte cooling capability.

Figure 3A:
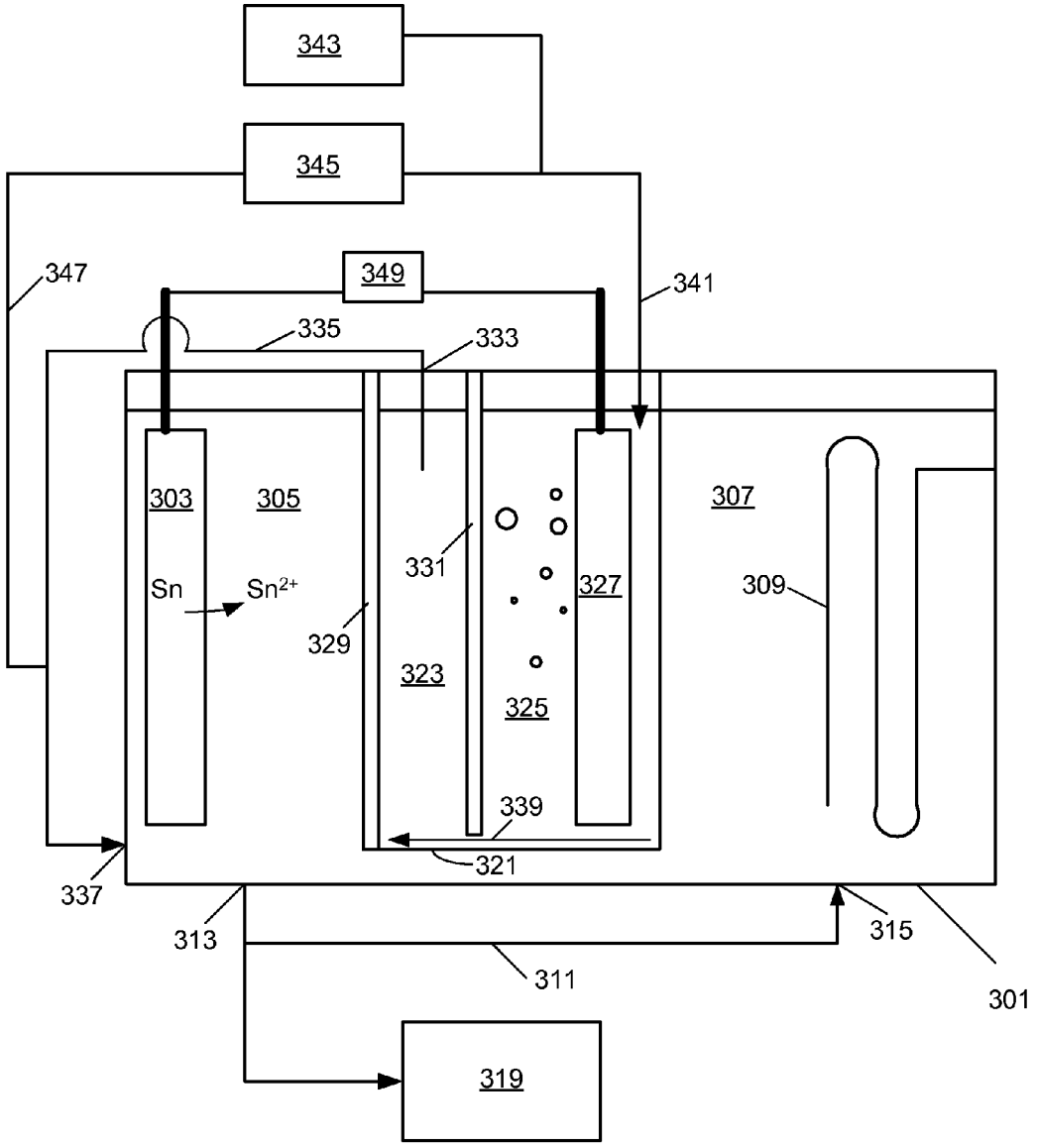
FIG. 3A is a schematic cross-sectional presentation of an electrolyte generating apparatus according to an embodiment provided herein, where the presentation illustrates a configuration of fluidic connections.

Referring to FIG. 3A, the apparatus includes a large anolyte chamber 301, which houses the low alpha tin anode 303 and an anolyte. The anolyte chamber can be divided into two sections: section 305 in the proximity of the anode reaction zone, and section 307, which is primarily dedicated to cooling of the anolyte with a cooling structure 309. While section 305 and section 307 are not separated by a membrane in the depicted embodiment, the diffusion between these sections is not very fast, and the apparatus includes a fluidic conduit 311 with an associated pump (not shown), which is configured to deliver anolyte from an anolyte outlet 313 in section 305 to an anolyte chamber inlet 315 in the cooling section 307. The transfer of anolyte within the anolyte chamber from the proximity of the anode to the cooling section is performed to facilitate heat exchange and cooling of the anolyte, (heated due to ohmic heat generated in the resistive electrolyte), and further to speed up mass transfer of anolyte in the anolyte chamber in order to avoid fluctuations of tin ion concentration at different portions of the anolyte chamber and to ensure accurate measurement of tin ion concentration. The anolyte outlet 313 is also connected with a fluidic conduit to an electrolyte product storage tank 319, and the apparatus is configured to deliver the anolyte to the electrolyte product storage tank 319, when desired. For example, the apparatus may be configured to deliver anolyte to the storage tank after concentration of tin ions in the anolyte reaches a target concentration (for example, after a defined amount of charge has passed through the apparatus, and the densitometer has confirmed that a target concentration range has been reached).

The apparatus depicted in FIG. 3A has a removable cathode-housing assembly 321, which includes a first catholyte chamber 323, and a second catholyte chamber 325, where the second catholyte chamber 325 houses the cathode 327. The assembly 321 can be inserted into the anolyte chamber between section 305 and the cooling section 307, and can be releasably attached to the anolyte chamber. The positioning of the cathode-housing assembly and the fact that it is removable offer a number of advantages including compactness, design simplicity, and ergonomic access for both anolyte and catholyte chamber maintenance. Furthermore, such design eliminates the need for a sealing between anolyte and catholyte chambers.

The cathode-housing assembly is equipped with a first anion-permeable membrane 329 that, in the depicted embodiment, directly separates the anolyte chamber and the first catholyte chamber. The membrane can be mounted onto a wall having one or more openings that are covered by the membrane after the membrane is mounted. The first catholyte chamber 323 and the second catholyte chamber 325 are separated by a second anion-permeable membrane 331, which may also be mounted onto a wall with openings. The first catholyte chamber has an outlet 333, and a fluidic conduit 335, which is configured to deliver the catholyte from the first catholyte chamber 323 to the anolyte chamber through an anolyte chamber inlet 337. For example, the anolyte may be dosed with the first catholyte from the first catholyte chamber, if the concentration of acid in the anolyte becomes too low, because, in the depicted embodiment the first catholyte is more acidic than the anolyte, and can be used as the source of acid. The anolyte may be also dosed with the first catholyte from the first catholyte chamber when tin ions that inadvertently migrate from the anolyte through the first membrane need to be flushed from the first catholyte chamber. When the first catholyte is transferred from the first catholyte chamber to the anolyte chamber, the level of the first catholyte would drop and the first catholyte would need to be replenished. In the depicted embodiment the first catholyte is replenished via a fluidic conduit 339, which connects the second catholyte chamber with the first catholyte chamber. In some embodiments, the fluidic conduit 339 is a hollow tube that is open from both ends, and which permits the second catholyte to automatically transfer to the first catholyte chamber, until the pressure in both chambers is equalized. In some embodiments the fluidic conduit 339 is a long and narrow line, which impedes diffusion of the first catholyte into the second catholyte chamber, and thereby impedes inadvertent transfer of tin ions into the second catholyte chamber.

The second catholyte chamber has an inlet and a fluidic conduit 341 coupled with this inlet, where the fluidic conduit is connected with a source of acid 343, and a source of water 345. Acid and water can be added through the conduit 341 to the second catholyte in the second catholyte chamber, as desired. The source of water 345, in the depicted embodiment, is also fluidically connected via a conduit 347 to the anolyte chamber, and the apparatus allows for water dosing into the anolyte. The tin anode 303 and the cathode 327 are electrically connected to a power supply 349, which is configured to bias the anode positively at a potential that is sufficient to cause dissolution of the anode.

The fluidic configuration shown in FIG. 3A is referred to as a cascade configuration. In this configuration the second catholyte cascades from the second catholyte chamber through conduit to the first catholyte chamber, and the first catholyte, in turn, cascades from the first catholyte chamber through conduit to the anolyte in the anolyte chamber. The second catholyte chamber is fed with acid and water through the sources of acid and water.

In one modification of the cascade configuration, the apparatus further comprises a fluidic conduit connecting the source of acid 343 with the anolyte chamber 301. Thus, in this configuration, the anolyte can receive acidic solution both from the first catholyte chamber and from the source of acid. In some embodiments the source of acid is a removable tote that is fluidically connected to the anolyte chamber and a second catholyte chamber through a buffer tank, that is configured to provide an uninterrupted supply of acid.

Figure 3B:
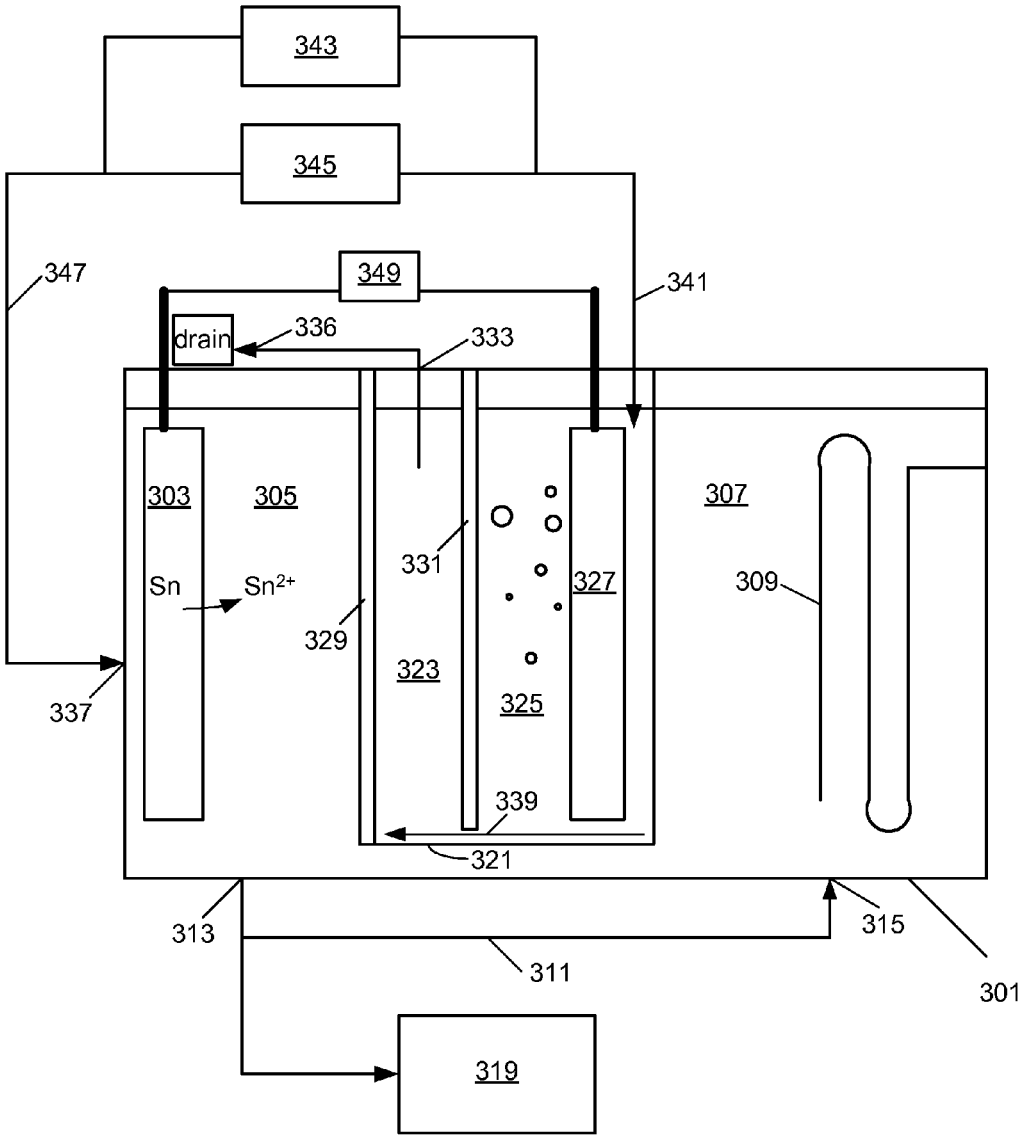
FIG. 3B is a schematic cross-sectional presentation of an electrolyte generating apparatus according to an embodiment provided herein, where the presentation illustrates another configuration of fluidic connections.

In an alternative fluidic configuration, depicted in FIG. 3B, the apparatus comprises a fluidic conduit connecting the source of acid 343 with the anolyte chamber 301, but does not have the conduit 335 connecting the first catholyte chamber with the anolyte chamber. Instead the apparatus includes a fluidic conduit 336 connected with the first catholyte chamber at the outlet 333 and configured to deliver a portion or all of the first catholyte to drain, or for recycling it outside the electrolyte generating apparatus. In this configuration, the anolyte is replenished with acid only from the source of acid 343.

In the configurations shown in FIGS. 3A and 3B, the first catholyte chamber 323 does not have a dedicated inlet for introduction of acidic solution, and, instead, receives all necessary acid from the second catholyte chamber 325 through the conduit 339. In an alternative fluidic arrangement (which is applicable to both configurations shown in FIG. 3A and 3B), the conduit 339 is absent, and instead the first catholyte chamber 323 contains an inlet in fluidic communication with an acid source 343, and the apparatus is configured to dose the first catholyte in chamber 323 with an acid from this source. Optionally, the source of water 345 may be also fluidically connected to the first catholyte chamber inlet in this embodiment, and the apparatus may be configured to deliver water to the first catholyte chamber when needed.

It is noted that, in some embodiments, the same cascading principle that is illustrated in FIG. 3A can be applied for modification of an apparatus having a single catholyte chamber shown in FIG. 2. In some embodiments, this apparatus is equipped with a fluidic conduit (other than a membrane) that is configured to deliver catholyte to anolyte. This fluidic conduit may be used instead of the acid source-to-anolyte delivery line or in addition to this delivery line. In an alternative embodiment the apparatus shown in FIG. 2 includes a fluidic line configured to deliver portions of catholyte to waste or for recycling outside of the apparatus.

In addition to the fluidic lines shown in FIGS. 3A and 3B, the apparatus may include an anolyte recirculation and filtration system that is configured to remove portions of anolyte from the anolyte chamber, and reintroduce the anolyte into the anolyte chamber after filtration. Further the apparatus may include fluidic lines configured for removing portions of electrolyte (e.g., anolyte, first catholyte, second catholyte and combinations thereof) to a drain if needed.

The fluidic lines described with reference to FIGS. 3A and 3B are coupled to a pump or pumps and can be used in conjunction with valves or valve manifolds that allow for controlled selective introduction of fluids to different destinations. These pumps, valves and associated flow meters are not shown to preserve clarity. In some embodiments, the apparatus is configured to separately control each of the fluidic streams. For example, the timing of dosing of fluids, and the amount of dosed fluids can be separately controlled with a combination of flow meters and valves, connected with a system controller. In some embodiments, all of the fluidic conduits shown in FIG. 3A and FIG. 3B with the exception of conduit 339 that connects the first and second catholyte chambers, are coupled with pumps and are equipped with valves that are configured to keep the conduits open and closed. The conduit 339, in some embodiments, functions without a pump or a valve, and the movement of the second catholyte to the first catholyte chamber is achieved solely due to the pressure differential between the first and second catholyte chambers. In some embodiments, one or more fluidic conduits of the apparatus are connected with filters, and allow for filtration of various fluidic streams in the system. For example, the anolyte directed from the anolyte chamber to the electrolyte storage tank, in some embodiments, is passed through a filter before it enters the electrolyte storage tank to remove any insoluble impurities.

In some embodiments the apparatus presented herein, is further configured to deoxygenate the electrolyte. Deoxygenation is preferably performed in the anolyte chamber, and is primarily used to prevent oxidation of $Sn^{2+}$ ions to $Sn^{4+}$ ions. Formation of $Sn^{4+}$ ions is highly undesirable, because it can lead to precipitation in the electrolyte and generally to deterioration of quality of the formed electrolyte. In some embodiments deoxygenation is performed by bubbling an inert gas (e.g., nitrogen or argon) through the anolyte, e.g., in the anolyte chamber. Thus, in some embodiments, the apparatus includes a conduit connected to a source of an inert gas that is configured to bubble the inert gas through the anolyte in the anolyte chamber. Further, in some embodiments, similar deoxygenation is also performed in the electrolyte storage tank, and, in some cases, in the catholyte chamber (e.g., first and/or second catholyte chamber).

Figure 4:
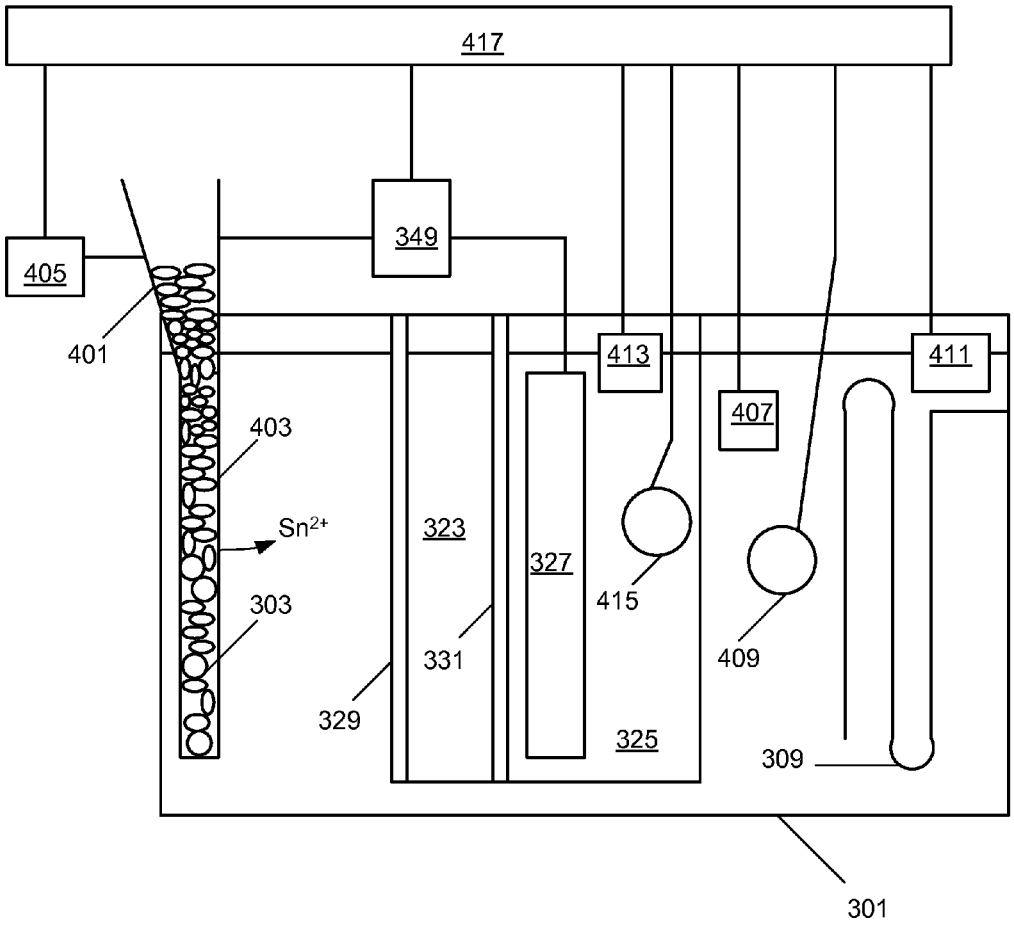
FIG. 4 is a schematic cross-sectional presentation of an electrolyte generating apparatus according to an embodiment provided herein, where the presentation illustrates a configuration of sensors in the apparatus, according to an embodiment provided herein.

The fluidic features of the electrolyte generating apparatus, in some embodiments, communicate with a system controller, where the controller is also configured to communicate with one or more sensors of the electrolyte-generating apparatus. The sensors provide feedback to the controller, which is programmed with the instructions to adjust one or more process parameters in response to the data provided by the sensors. FIG. 4 provides a cross-sectional schematic view of an electrolyte-generating apparatus, illustrating different types of sensors that can be used to provide data to the controller for accomplishing fully or partially automated generation of the electrolyte. The apparatus shown in FIG. 4 is similar to the apparatus of FIG. 3A, and it is understood that the fluidic features shown in FIG. 3A and FIG. 3B are to be used with one or more sensors shown in FIG. 4. The apparatus shown in FIG. 4 differs from the apparatus shown in FIG. 3A, in that the low alpha tin anode in FIG. 3A is a single piece of low alpha tin metal (available from Mitsubishi Materials Corporation of Tokyo, Japan or Honeywell International, Inc. of Morristown, NJ), whereas the apparatus shown in FIG. 4 employs a plurality of low alpha tin pellets placed in an ion-permeable container, where the pellets serve as an anode. Typically the pellets are smaller than 6 mm (referring to the largest dimension), for example, smaller than 3 mm. The pellets can be cylinders, spheres or particles of any other shape, including mixtures of randomly shaped pellets. One specific example of suitable pellets are cylindrical pellets, where each pellet is about 2.5 mm in diameter and is about 2.5 mm long. Alternatively, round pellets of nominally the same dimension are used. Both types of the anode can be used in apparatuses having fluidic features shown in FIG. 3A and FIG. 3B and with sensors shown in FIG. 4 (with the exception of pellet level sensor, which is used only for pellet-based anode).

Referring to FIG. 4, the apparatus includes an anolyte chamber 301 and a gravity fed hopper 401 that provides low alpha tin pellets into the anode container 403. A charge plate in electrical communication with the power supply 349 is integrated with the anode container 403, and serves to electrically bias the low alpha tin pellets covered with the anolyte. The pellets wetted with the anolyte and biased by the charge plate collectively serve as an anode 303, and are dissolved to form tin ions which are released into the anolyte during the electrolyte-generating process. Therefore, in order to release tin ions into the anolyte the anode container 403 is permeable to ions. In some embodiments the charge plate serves as the anode container. In other embodiments, the container is an ion-permeable membrane (e.g., made of a polysulphone material) that does not serve as a charge plate, while the anode is biased using a conducting rod that contacts the pellets and that is connected to the power supply.

Tin pellets are loaded into the gravity hopper 401, and the level of tin pellets gradually moves down, as the anolyte-covered pellets are dissolved during electrolyte generation, and the dry pellets from the hopper settle down under the force of gravity, become covered with the anolyte and start functioning as the anode. The apparatus shown in FIG. 4 includes a sensor 405 configured to determine if the pellets have settled below a critical level, and to signal that replenishment of the pellets is needed if they did. The sensor 405 may be an optical sensor or a capacitive sensor, such as an optical through-beam sensor or a capacitive sensor available from Balluff Inc. of Florence, Ky. The replenishment of the hopper with tin pellets can be carried out automatically or manually. For example, after the level of pellets is determined by the sensor to be critical, the hopper may be manually or automatically reloaded with between about 5-30 kg of tin pellets.

The anolyte chamber 301, in the depicted embodiment further includes a sensor (one or more sensors) for determining the concentration of tin ions 407, a sensor (one or more sensors) for determining the concentration of acid 409, and an anolyte level sensor 411. In one of the preferred embodiments, a densitometer is the sensor primarily used to determine concentration of tin ions, and a conductivity meter is the sensor primarily used to determine the concentration of the acid in the anolyte. It was observed that the density of the anolyte depends to a greater degree on the concentration of the tin ions than on the concentration of the acid, and that concurrent measurement of anolyte density and anolyte conductivity can be used to accurately determine concentrations of both tin ions and acid in the anolyte. The densities and conductivities of electrolytes at different tin ion concentrations and acid concentrations can be pretabulated for different types of acid and can be used by the controller to determine the actual concentrations of tin ions and acid from the data provided by the conductivity sensor and the densitometer. Alternatively, the controller can be programmed with density and conductivity values that correspond to target concentration ranges, and actual calculation of the concentration may be unnecessary. An example of a suitable densitometer is a Micro-LDS densitometer available from Integrated Sensing Systems of Ann Arbor, Mich., or a similarly capable device available from Anton-Paar of Ashland, Va. It was discovered that in highly conductive electrolyte solutions, such as in acidic electrolyte solutions, it is preferable to use inductive conductivity meters, such as a toroidal conductivity sensor (e.g., model 228, available from Rosemount Analytical (Emerson Process Management) of Irvine, Calif.). While in some embodiments, more conventional conductivity meters that rely on measuring conductivity between two electrodes can be used, the inductive conductivity meters have the advantage of being more compact since in highly conductive solutions the distance between electrodes should be quite large in order to obtain an accurate measurement. It is understood that alternative measuring sensors or system can be used to measure intrinsic properties of the anolyte (spectrophotometers, refractive index sensors, IR or Raman spectroscopy equipment), or a combination of sensors (for example, balance/weight sensors in combination with a fluid volume sensor) can also be used. The anolyte level sensor 411 is configured to determine if the level of anolyte drops below a critical level. The anolyte level sensor 411, in some embodiments, is an optical sensor.

The second catholyte chamber 325 includes a sensor 413 configured to measure acid concentration (e.g., an inductive conductivity sensor) and a catholyte level sensor 415 (e.g., an optical sensor) configured to determine when the level of catholyte in the catholyte chamber falls below a critical level. The sensors 405, 407, 409, 411, 413 and 415 are in communication with the controller 417, which receives and processes data from the sensors.

In some embodiments, the electrolyte generating apparatus provided herein is equipped with a hydrogen management system. Because the inert cathode in the catholyte chamber generates hydrogen gas, which can form explosive mixtures with air, it is advantageous to provide a hydrogen management system that is configured for diluting hydrogen to a safe concentration (well below lower explosion limit or LEL), and for removing diluted hydrogen out of the apparatus. The hydrogen management system can be integrated with an apparatus having a single catholyte chamber (such as with an apparatus shown in FIG. 2), or with an apparatus having multiple catholyte chambers (such as with an apparatus shown in FIG. 3A and FIG. 3B).

In one implementation the hydrogen management system includes a diluent gas conduit configured to deliver a diluent gas to a space above a catholyte, and to dilute hydrogen gas accumulating in that space, wherein the space above the catholyte is covered with a first lid having one or more openings that allow for transfer of diluted hydrogen into a space above the first lid. For example, in the apparatus shown in FIG. 3A and FIG. 3B, such lid can cover the second catholyte chamber that houses the cathode generating hydrogen gas. In some embodiments, the hydrogen management system further includes a second lid over the first lid and spaced apart from the first lid such that there is a space between the first and second lids; and a second diluent gas conduit configured to deliver a diluent gas to a space between the first and second lid and to move the diluted hydrogen gas from the space between the first and second lids towards an exhaust. The diluent gases provided through the first and second conduits may be the same or different. A diluent gas may be a mixture of gases or a single gas. Examples of diluent gases include air and inert gases, such as nitrogen and argon. In one of the preferred embodiments, an inert gas, such as nitrogen or argon is used as first diluent gas to ensure safe first dilution of hydrogen below the LEL. After the hydrogen has first been diluted with an inert gas, air can be safely used as the second dilution gas. In another embodiment, inert gases are used both as the first and second dilution gases.

Figure 5:
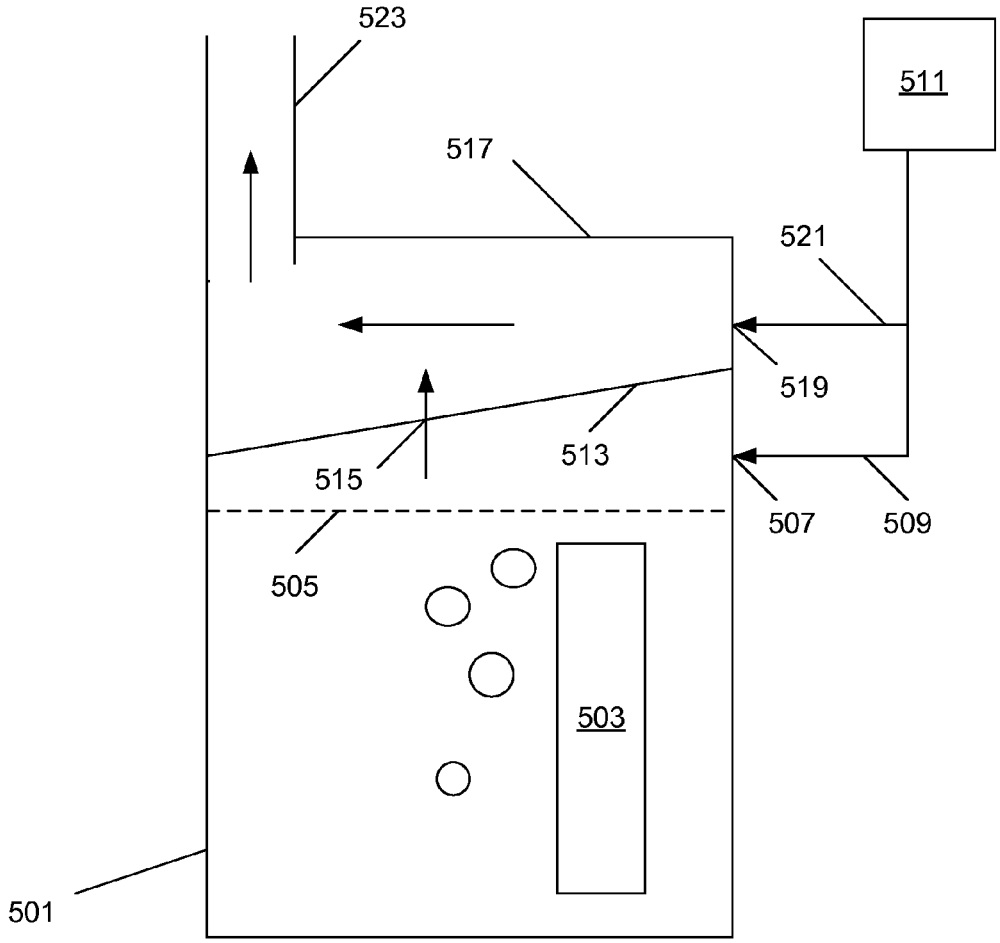
FIG. 5 is a schematic cross-sectional presentation of a catholyte chamber having a two lid hydrogen management system according to an embodiment provided herein.

FIG. 5 provides a schematic cross-sectional view of an example of a catholyte chamber equipped with a hydrogen management system. The catholyte chamber 501 houses an inert hydrogen generating cathode 503 immersed into a catholyte (shown at a fluid level 505). The catholyte chamber has an inlet 507 connected with a diluent gas conduit 509, and is configured to admit the diluent gas provided from the source of the diluent gas 511 through this inlet into the space above the catholyte. A first lid 513 is disposed above the catholyte and has one or more openings 515 through which the diluted hydrogen gas is transferred upward. A second lid 517 is disposed above the first lid 513, and the space between the first and second lids is equipped with an inlet 519, coupled with a diluent gas conduit 521 configured to deliver a diluent gas from the source of diluent gas 511 into this space and to move the diluted hydrogen gas through this space in a horizontal direction towards the exhaust 523, which removes the diluted hydrogen gas from the apparatus.

Figure 6A:
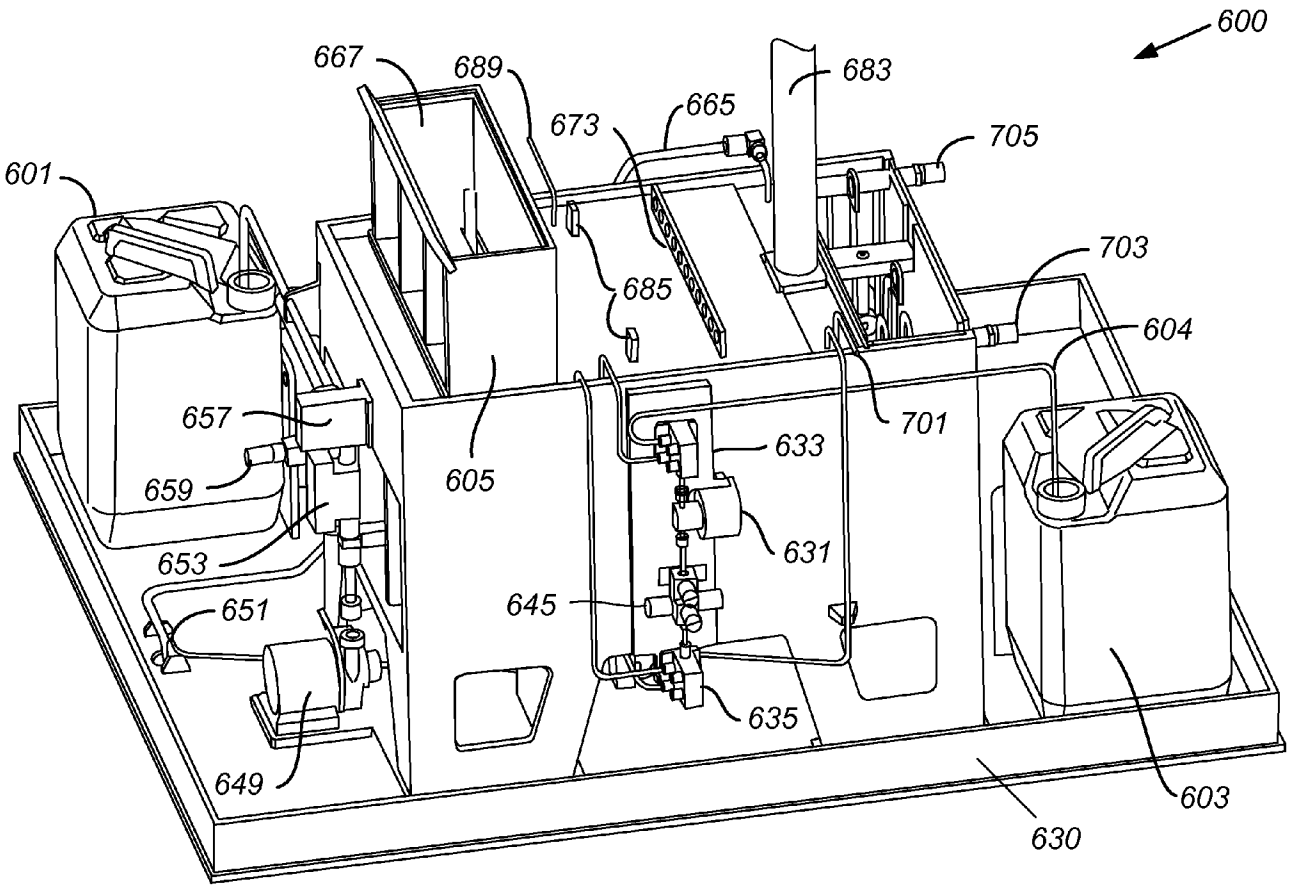
FIG. 6A is a side view of an electrolyte-generating apparatus according to an embodiment presented herein.
Figure 6B:
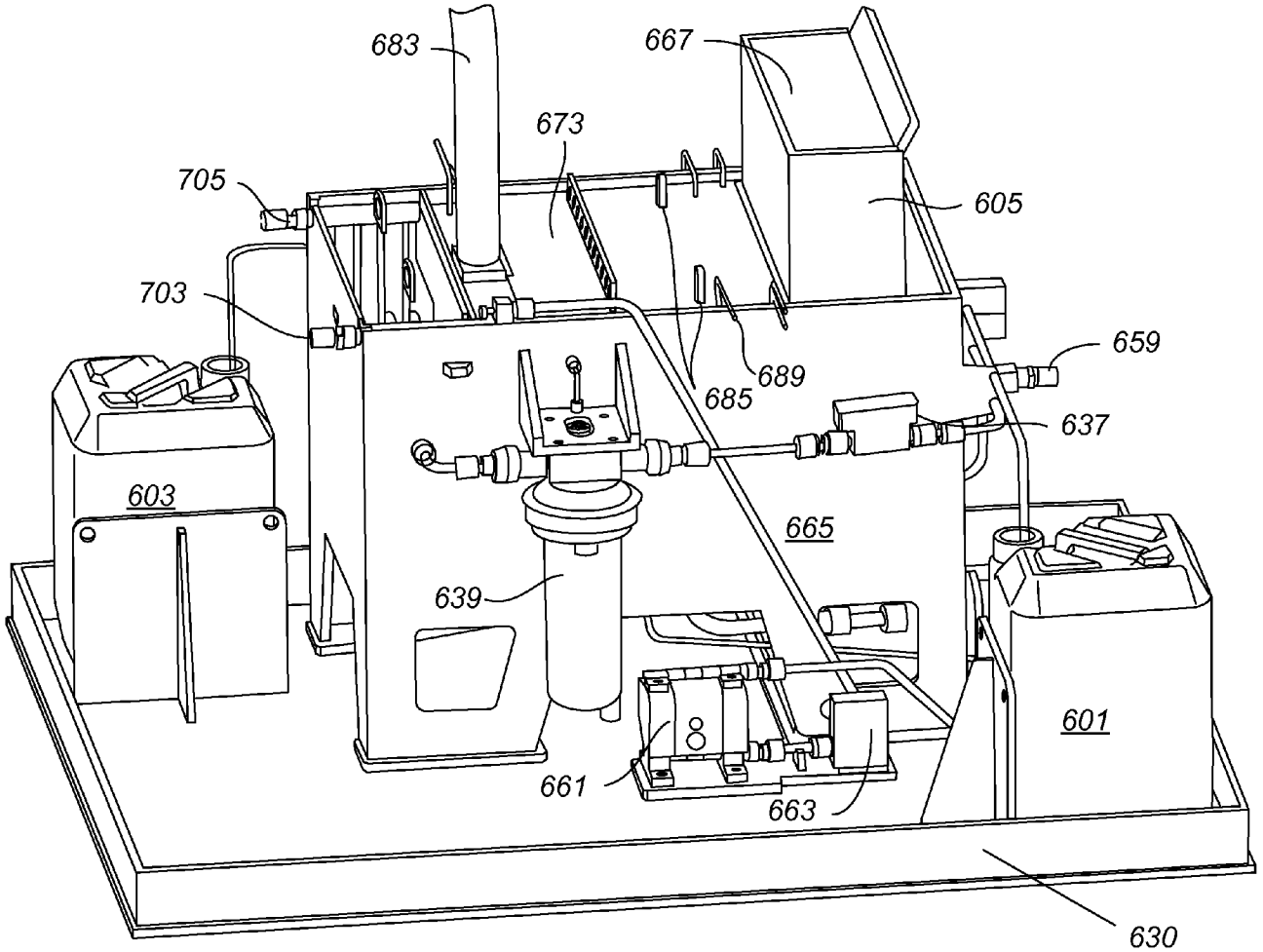
FIG. 6B is a side view of the electrolyte-generating apparatus shown in FIG. 6A illustrating the opposite side of the apparatus.
Figure 6C:
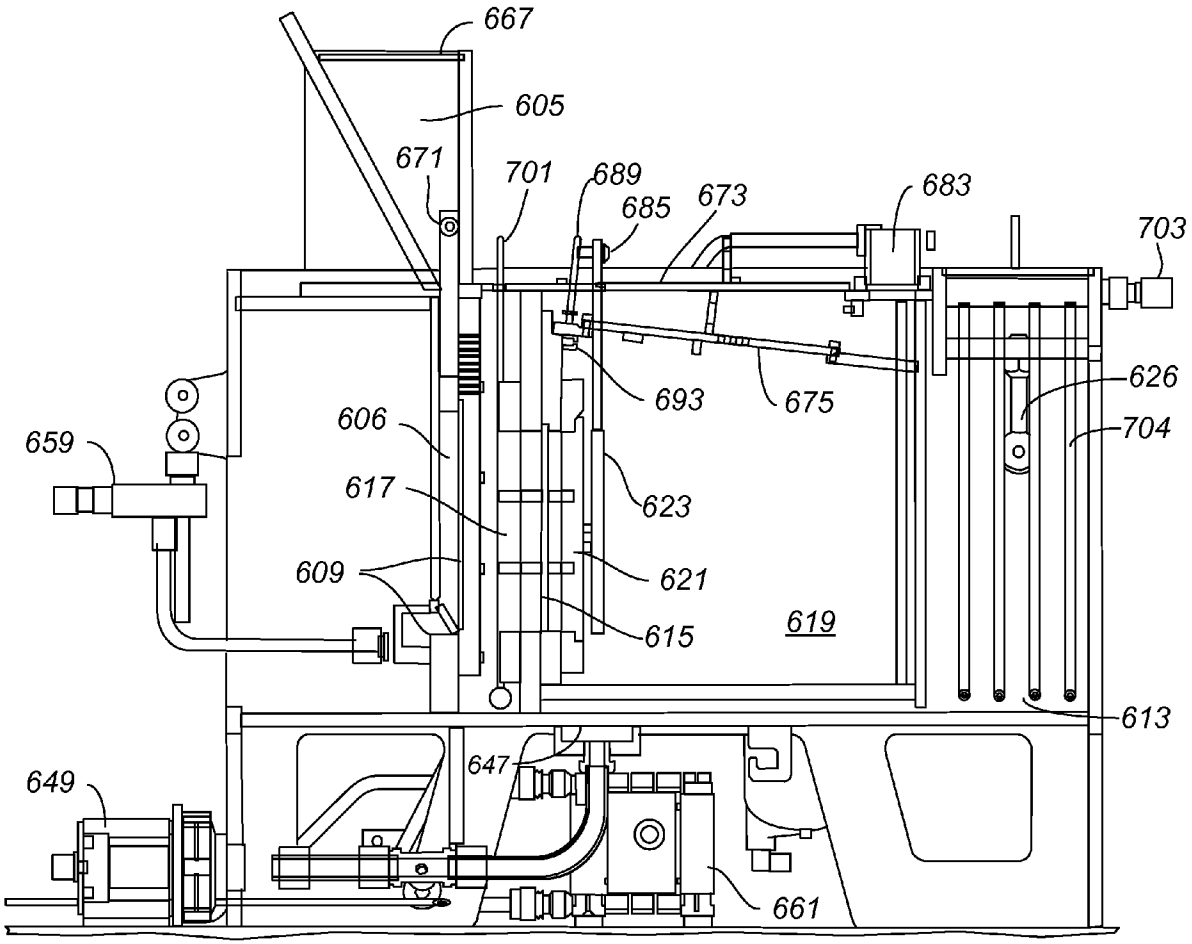
FIG. 6C is a cross-sectional view of the electrolyte-generating apparatus.
Figure 6D:
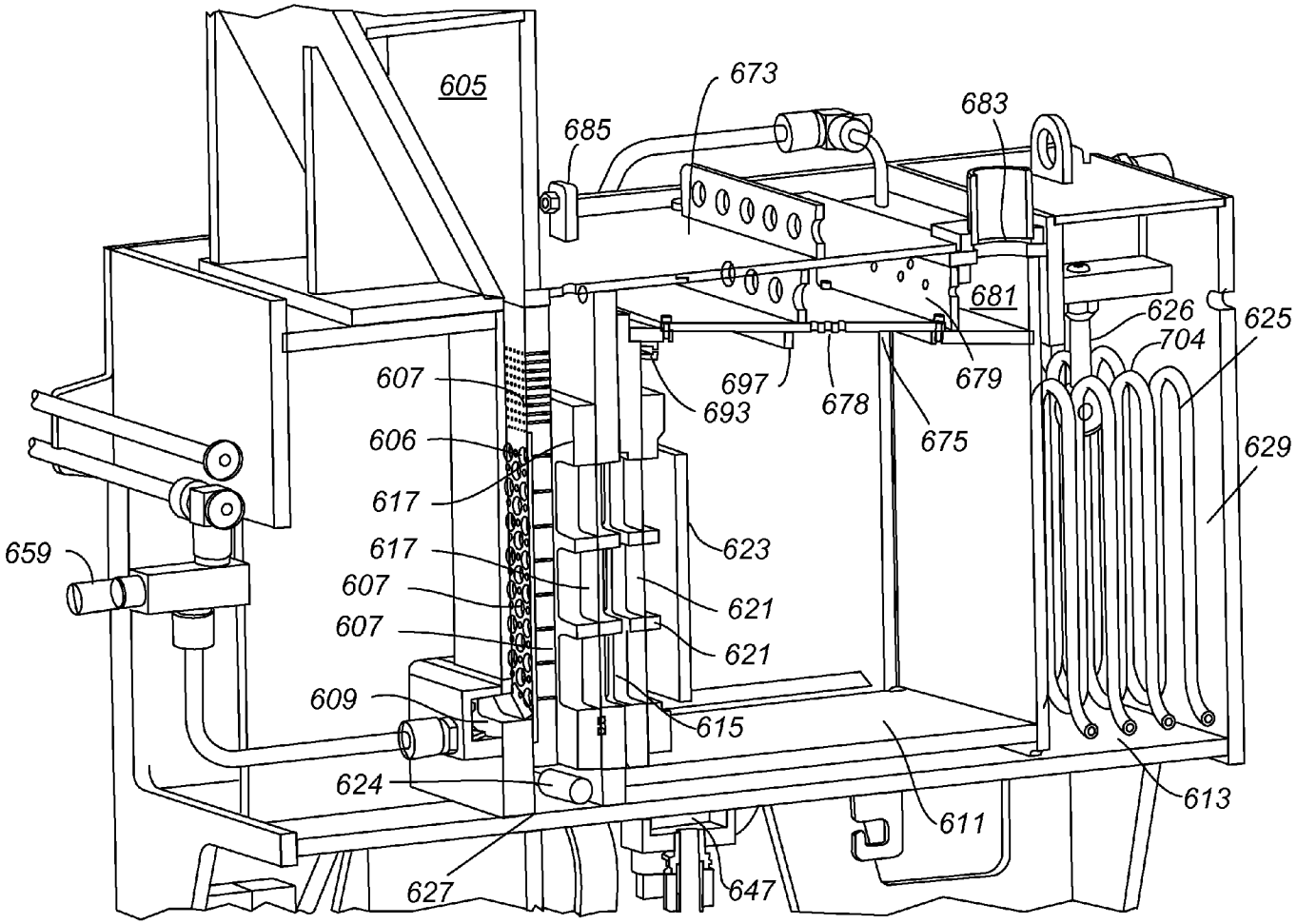
FIG. 6D is another cross-sectional view of the electrolyte-generating apparatus.
Figure 6E:
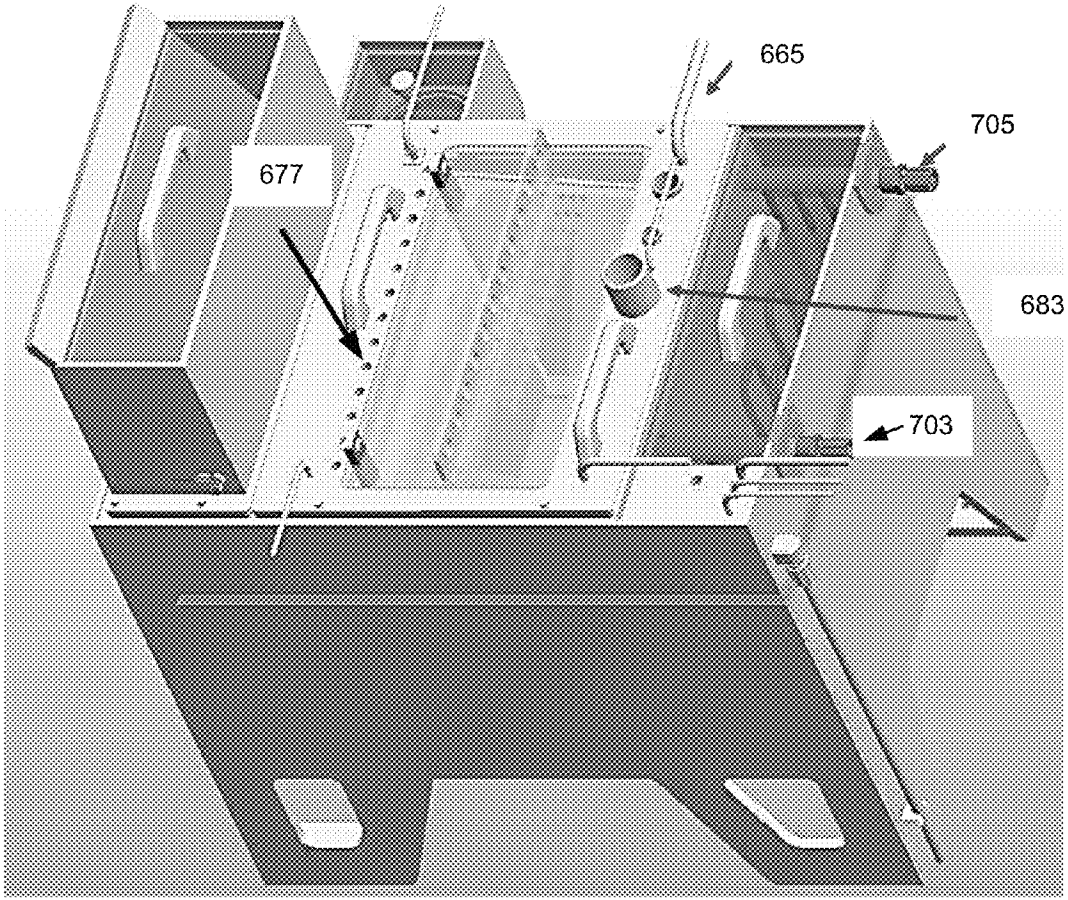
FIG. 6E is a perspective view of the electrolyte-generating apparatus

A specific example of an electrolyte-generating apparatus is illustrated by FIGS. 6A-6I, and FIGS. 7A-7C. FIGS. 6A and 6B provide side views of the apparatus (from two opposite sides), FIG. 6C provides a cross-sectional view of the apparatus, and FIG. 6D provides another cross-sectional view. FIG. 6E provides a perspective view of the apparatus.

Figure 6F:
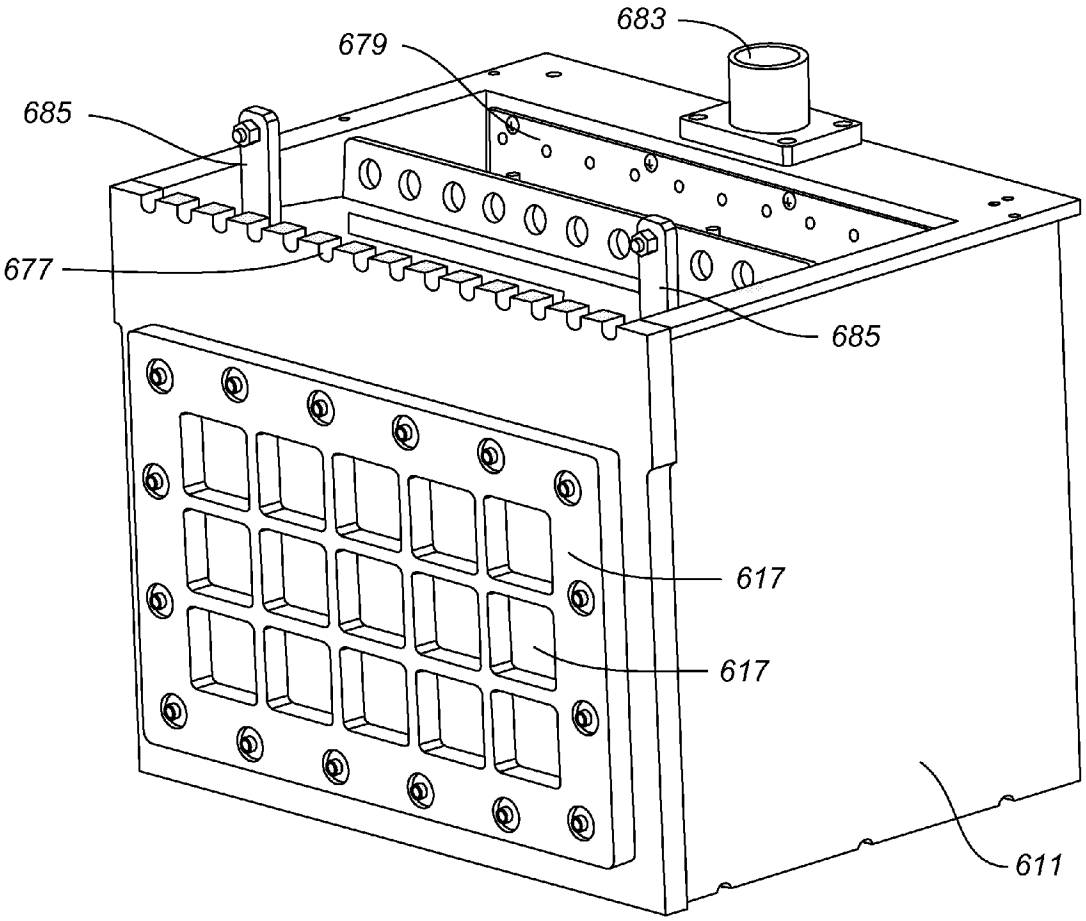
FIG. 6F is an isometric view of a removable cathode-housing assembly according to an embodiment provided herein.
Figure 6G:
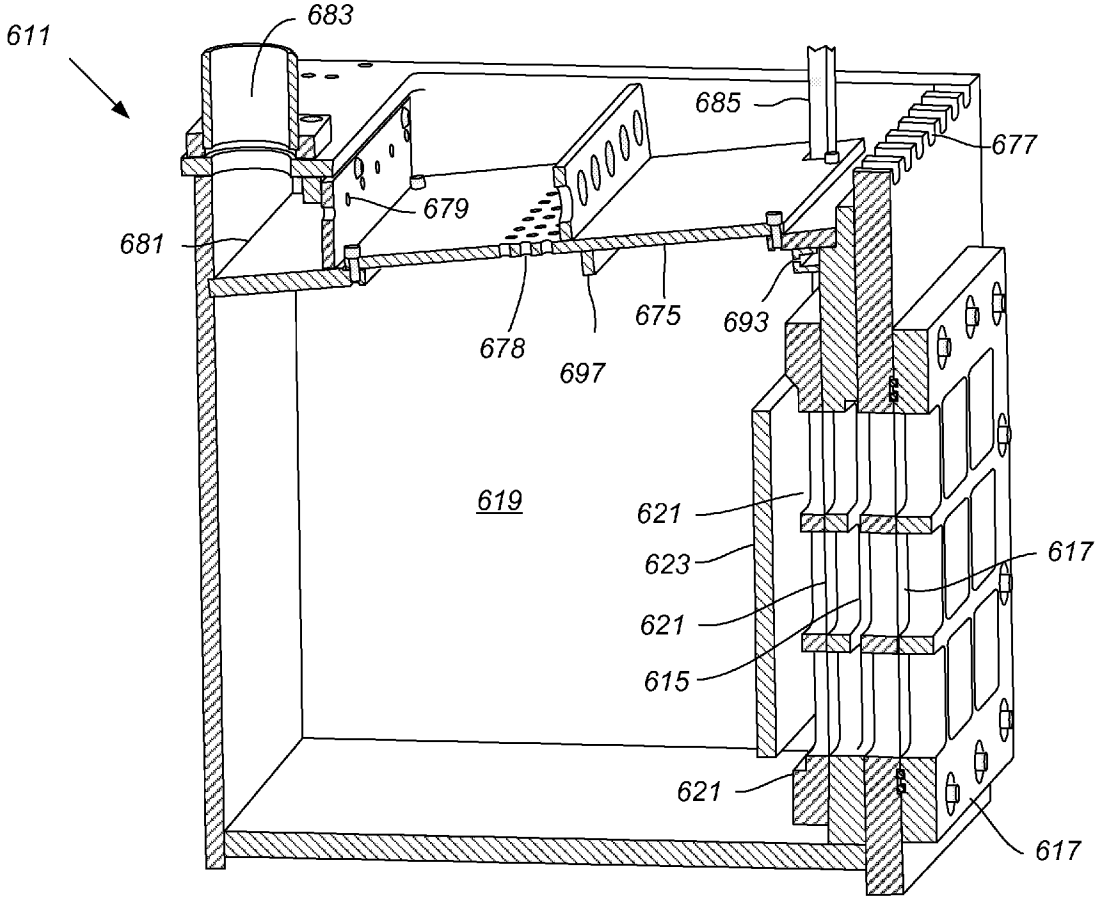
FIG. 6G is a cross-sectional view of the removable cathode-housing assembly.
Figure 6H:
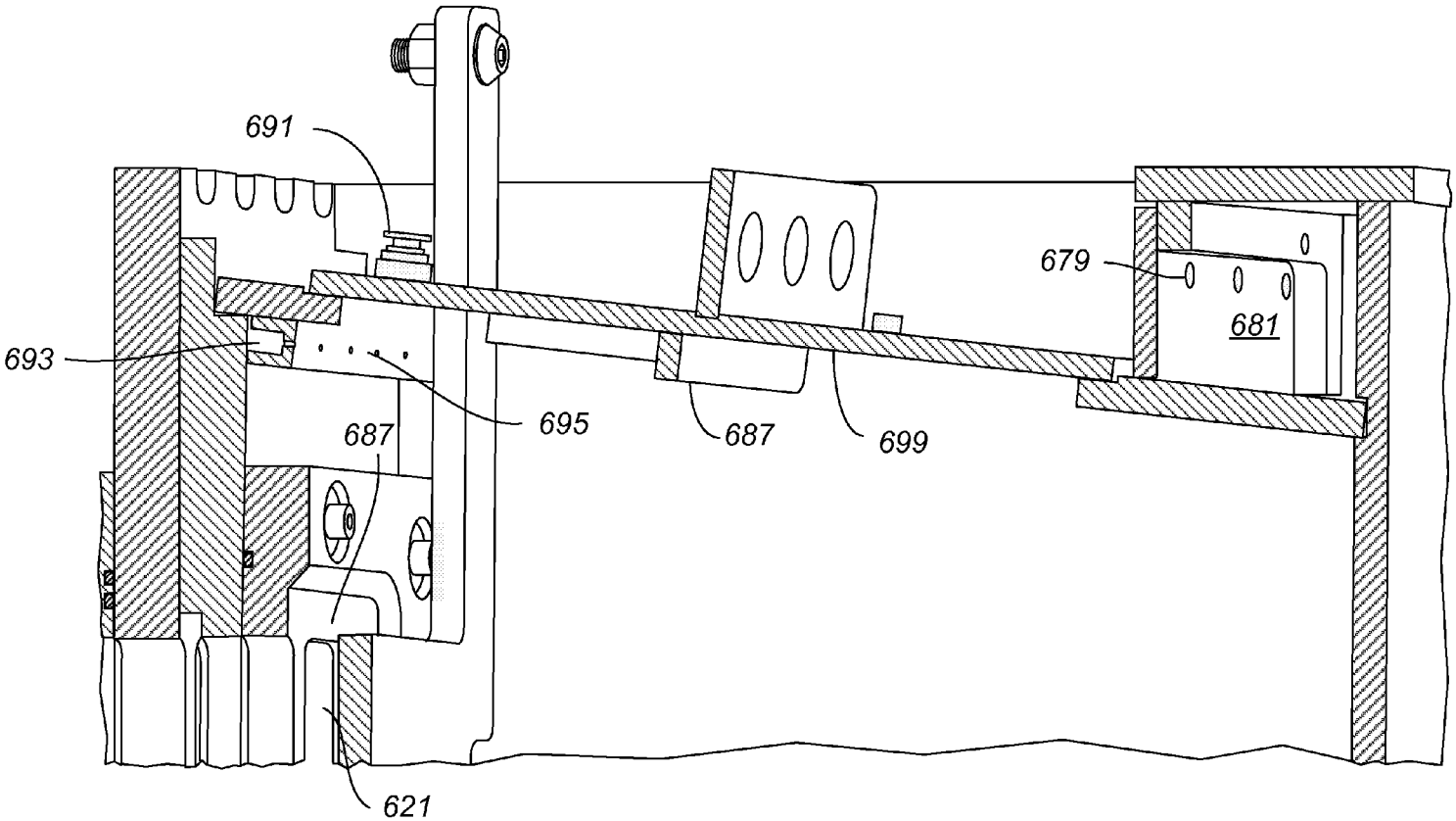
FIG. 6H is another view of the removable cathode-housing assembly.
Figure 6I:
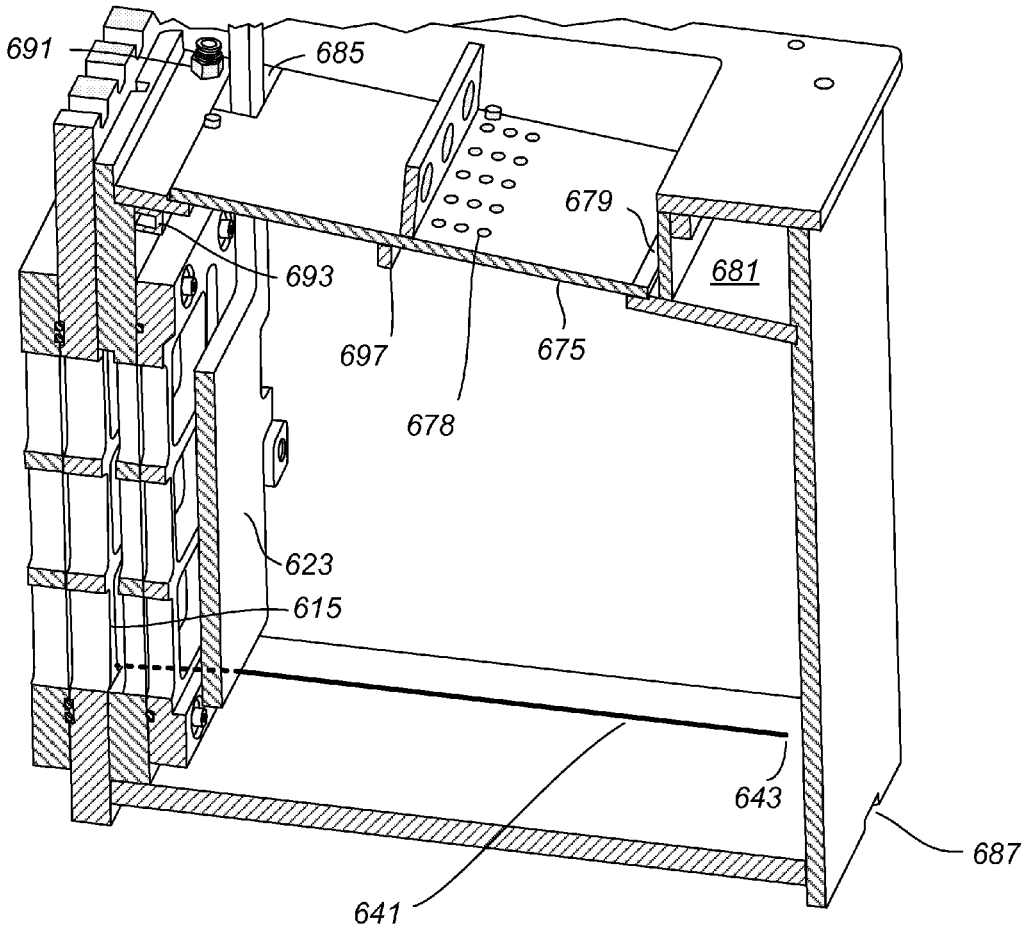
FIG. 6I is a close-up view illustrating the inner lid in the cathode-housing assembly.
Figure 7A:
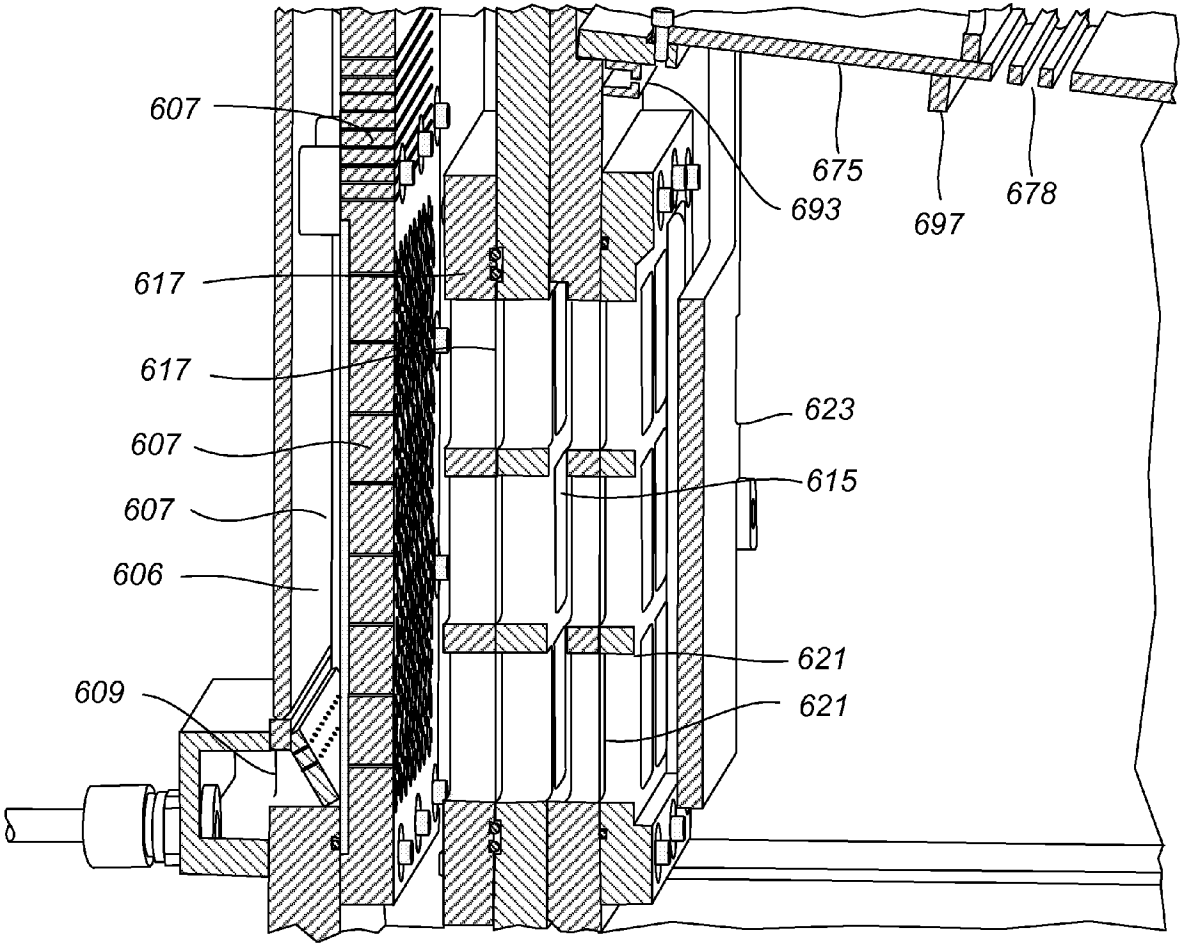
FIG. 7A is a side view of a portion of an electrolyte-generating apparatus according to an embodiment presented herein, where the interface between the anolyte and catholyte chamber is illustrated.
Figure 7B:
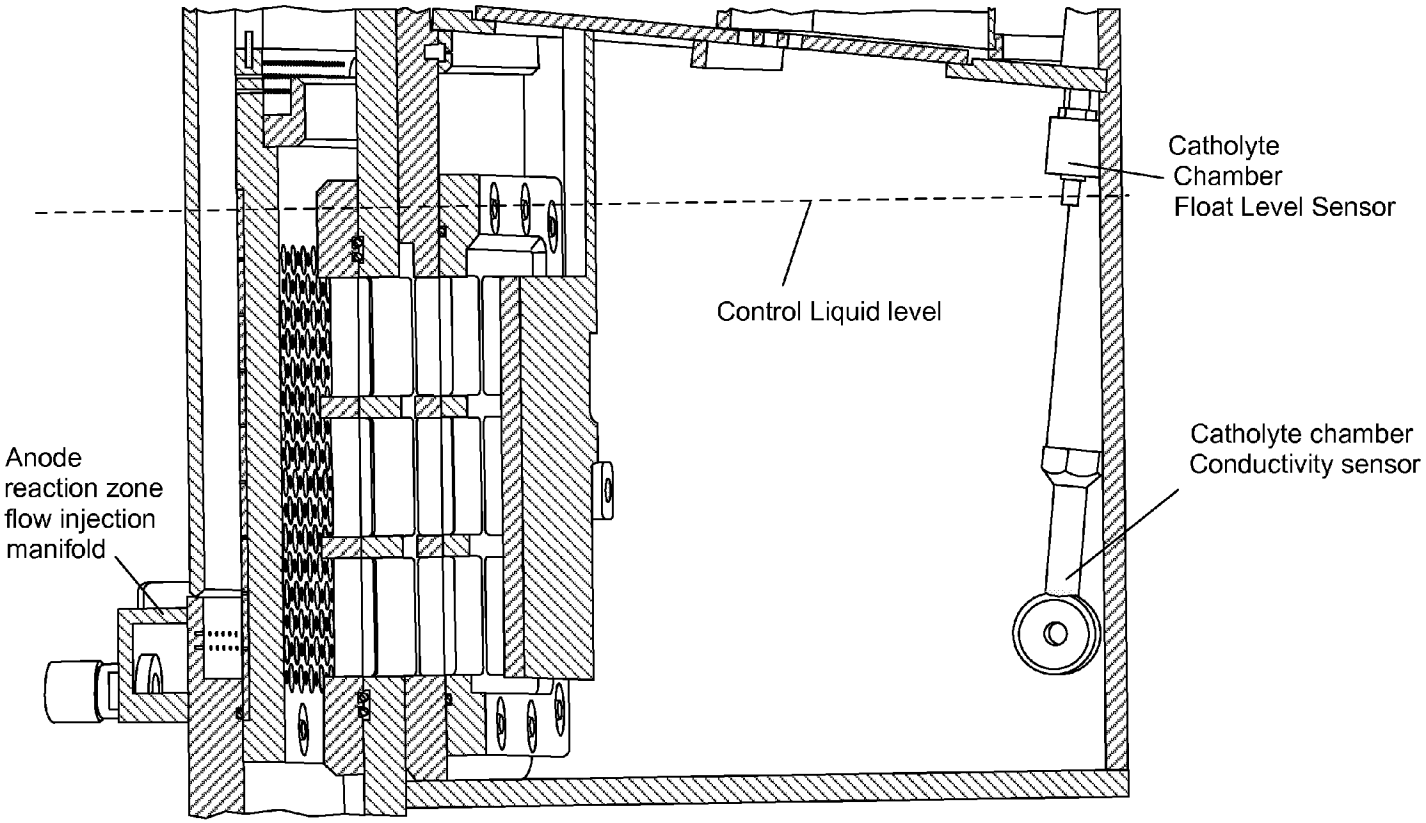
FIG. 7B is another side view of a portion of an electrolyte-generating apparatus according to an embodiment presented herein, where the interface between the anolyte and catholyte chamber is illustrated.
Figure 7C:
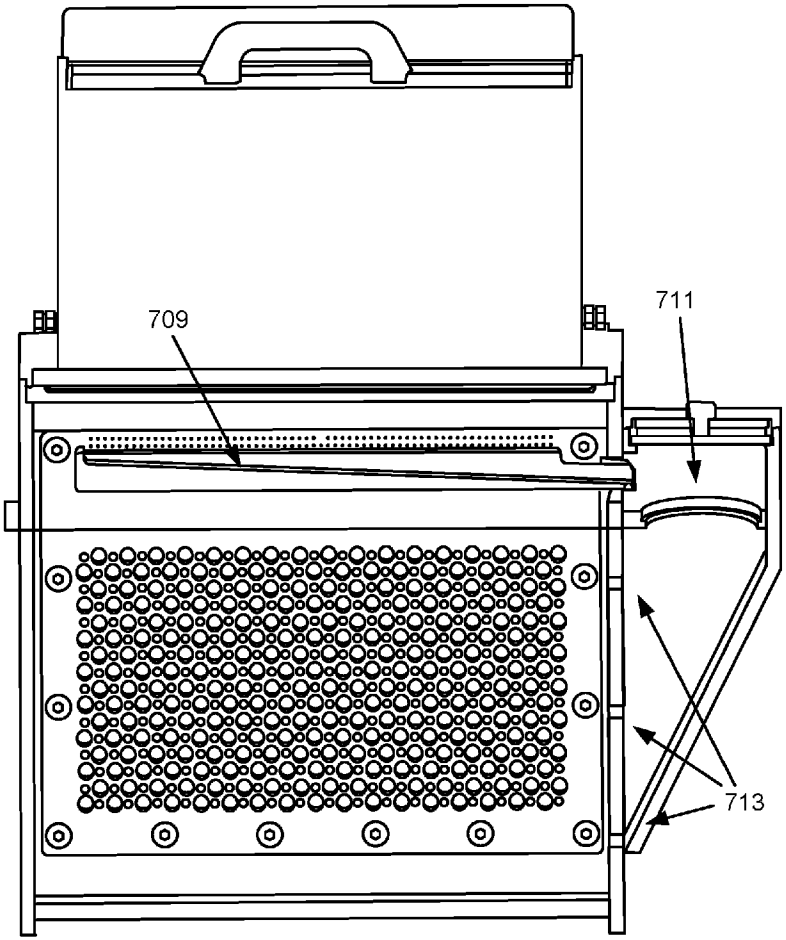
FIG. 7C is a cross-sectional view of the electrolyte-generating apparatus according to an embodiment provided herein.

The illustrated apparatus includes a removable cathode-housing assembly, where the assembly has a first catholyte chamber and a second, cathode-housing catholyte chamber, wherein the two chambers are separated by an anion permeable membrane. The apparatus is equipped with a catholyte-to-anolyte fluidic cascade, a two-lid hydrogen management system, and a cooling system. FIGS. 6F-6I show different views of the cathode-housing assembly, where FIG. 6F shows an isometric view of the cathode-housing assembly, while FIGS. 6G-6I show different cross-sectional views of the same assembly illustrating different aspects of the hydrogen management system. FIGS. 7A-7B provide views of the interface between the anolyte chamber and the first catholyte chamber. FIG. 7C illustrates a part of the apparatus showing an embodiment with a gutter for removing overflow anolyte to a filtration assembly.

The apparatus shown in FIGS. 6A-6E combines a number of advantageous features. The apparatus includes two anion-permeable membranes separating the anode and the cathode (as previously illustrated by membranes 329 and 331 in FIG. 3A and FIG. 3B). When a single separator is used as shown in the embodiment illustrated in FIG. 2 (assuming the separator is an anion-permeable membrane), the separator is often not completely impermeable to tin ions. Therefore, tin ions can migrate from the anolyte to catholyte and poison the cathode. The embodiments illustrated by FIG. 3, and FIGS. 6A-E provide an additional, middle catholyte chamber that can be flushed with acidic solution to remove any tin ions that inadvertently migrated into the middle catholyte chamber. In the depicted embodiment the catholyte from the first catholyte chamber (middle chamber) is transferred to the anolyte chamber, while the middle chamber is replenished with the catholyte derived from the second catholyte chamber. In such reverse double membrane cascading, two anionic membranes that inhibit the migration of metal cations (and to a lesser extent protons from the acid) are employed as a preferred separator.

While in some embodiments provided herein, the apparatus includes a solid single-piece anode (as illustrated in FIG. 2 and FIGS. 3A and 3B), the use of solid metal anode does not allow for efficient automatic replenishment of anode material. In some embodiments provided herein (illustrated in FIG. 4, and in FIGS. 6A-6E) this problem is addressed by providing a gravity hopper containing metal pellets. The hopper feeds the pellets into the anode active zone as the anode material is being dissolved. That is, there are dry metal pellets on the top of the hopper which feeds directly into the anode active zone where the pellets are wetted by the electrolyte. As the wet anode pellets are dissolved in the reaction, the dry pellets shift under gravity into the anode active zone, are wetted and are dissolved during the reaction.

Further, as it was previously noted, the generation of hydrogen gas at the cathode can be hazardous because the mixture of hydrogen with air can be explosive. In some embodiments (illustrated in FIGS. 6A-6F) the apparatus includes a double lid design that is configured to keep the composition of hydrogen-containing gas at a safe specification. For example a conduit for delivering an inert gas (e.g., $N_2$) into the apparatus may be used.

Finally, in the apparatus illustrated by FIGS. 6A-6F, a number of features that are configured for providing automated electrolyte generation, storage, and delivery, are provided.

Referring to FIGS. 6A-6F, the automated electrolyte distribution and generator equipment is provided. The equipment includes an electrolyte generator 600, in fluidic communication with an electrolyte storage tote 601 configured to accept the generated electrolyte from the generator and to store the generated electrolyte. The generator is also in fluidic communication with a concentrated acid tote 603 that is configured to deliver the concentrated acid via line 604 to the electrolyte generator 600. In other embodiments, the generator is in communication with the concentrated acid tote through an acid buffer container, which allows for the tote to be replaced or replenished without stopping the electrolyte generation process. In some embodiments the concentrated acid tote or a buffer container contains an aqueous solution of MSA, sulfuric acid, sulfamic acid or any combinations of these acids. In one specific embodiment the concentrated acid solution consists essentially of MSA solution having a concentration of between about 900-1000 g/L. In the depicted embodiment, the electrolyte generator 600 includes a self-regulating gravity-feeding hopper 605 that meters the flow of metal (e.g. low alpha tin) pellets into a vertical porous bed of metal anode reactant, forming an anode reactant column 606. In other embodiments an auger-regulated hopper may be used. As the pellets are consumed during the electrochemical dissolution of pellet-based anode, they are replaced by fresh pellets from above. The apparatus further includes a pellet restraining and/or retaining charge plate 607 electrically connected with an anode power buss that is electrically connected to a power supply that positively polarizes the anode pellet bed. In the depicted embodiment, the charge plate serves to both physically contain the pellets of the anode in place and to conduct charge from the power buss to the pellets and to provide ionic communication between the pellets and the anolyte, such that the generated metal ions could be released into the anolyte. Accordingly, in the depicted embodiment, the charge plate is a porous, ionically permeable, electrically conductive element that is insoluble under electrolyte generation conditions (also referred to as inert). In other embodiments, the pellets are contained with an ion-permeable membrane (e.g., made of a polyethersulphone material), which can be reinforced with a support structure, but does not necessarily need to be connected to a power buss and serve as a charge plate. In this embodiment charge is delivered by the electrically conductive buss bars contacting the pellets and connected to the power supply. In some embodiments the apparatus includes inert current collector buss bars and a fine anode membrane (e.g. a porous polyethersulphone (PES) membrane) with a support frame configured to contain the anode pellets, and may optionally include a conductive porous current collector mesh screen (charge plate) electrically connected to the buss bars.

The apparatus further includes an anode bed recirculating flow feeding injection manifold 609, which is configured in the illustrated embodiment to force a portion or all of the recirculating anolyte flow to move from the bottom of the anode upwards. This anolyte then exits the anolyte chamber through a porous weir and a gutter at the top of the electrolyte generator, is filtered, and is then returned to the anolyte chamber at the bottom portion of the anode bed with the manifold 609.

The gravity hopper, in some embodiments further includes a sensor or sensors (e.g., capacitive or optical sensors) to indicate to system controller and/or apparatus operator when the hopper metal pellet supply is low and needs replenishment.

In the depicted embodiment, the anode bed is a fixed packed bed, where the metal granules are packed by gravity and are wetted by the anolyte solution injected from the bottom portion of the bed. In the depicted embodiment the granules are not substantially moved by the flow of the anolyte. In alternative embodiments, a fluidized bed of metal particles can be used. In the fluidized bed, the metal particles are not packed but are continuously moving as they are impacted by the flow of the anolyte. The use of a packed fixed bed offers several advantages over the use of a fluidized bed. First, it is easier to ensure electrical contact of the particles in a packed bed than in a fluidized bed. Secondly, the use of fluidized bed requires a metering device for addition of particles. In the absence of such metering device, addition of too many metal particles will result in the loss of particle mobility leading to transformation of the bed to a non-fluidized packed form. If too few particles are added, the particles in the fluidized bed would not be able to make sufficient electrical contact with the charge plate and with each other. Therefore, in a fluidized bed, instead of a self-regulating gravity hopper, a hopper with a metering device, such as an auger hopper or a metering gate/valve, should be used, in order to provide a required amount of particles into the bed to accurately compensate for the calculated amount of consumed metal. In contrast, when a fixed, packed bed is employed, the metal particles can be fed through the gravity hopper, which automatically replenishes consumed particles. The additional particles can be added to the gravity hopper when the hopper sensor indicates that the level of the particles in the hopper is too low, but the amount of added particles need not exactly match the amount of consumed particles in the packed bed embodiment. The fluidized bed further can give rise to problems related with different sizes of the particles. As the particles are consumed, smaller particles will tend to rise and new added particles will tend to drop to the bottom in the fluidized bed, which can lead to destabilization of the bed. Further, particles of different sizes will be fluidized differently by the stream of anolyte in a fluidized bed, and velocities of such different particles may be difficult to control.

The depicted apparatus further includes a removable cathode-housing assembly 611, which is inserted into the anolyte chamber 613. The cathode-housing assembly 611 has two chambers, separated from each other by an anion-permeable membrane. The first catholyte chamber 615 (also referred to as middle chamber) is separated from the anolyte chamber 613 by a first anion-permeable membrane 617. The second catholyte chamber 619 is separated from the first catholyte chamber 615 by a second anion-permeable membrane 621, and is configured to house an inert hydrogen generating cathode 623. The separation does not need to be complete (prevent all fluid motion under pressure gradients), and in some embodiments, there is a long and narrow channel (641) that allows for fluidic communication and pressure equalization between the first and second catholyte chambers while simultaneously presenting a long diffusion path for transport of compounds located in the middle chamber (e.g. $Sn^{4+}$ byproduct and $Sn^{2+}$ metal that leaks to the mid chamber) from reaching the second cathode chamber. The cathode-housing assembly 611 (including the first catholyte chamber 615 and the second catholyte chamber 619) is removable as a complete sub-assembly from the electrolyte generator 600 and anolyte chamber 613. The cathode-housing assembly 611 is designed to be installed in an opening from above and into the anolyte chamber 613, fitting within the contained volume of the anolyte chamber. The anolyte chamber 613 contains sufficient volume and necessary hardware to allow the insertion, mounting, and removal of the catholyte chamber. The anolyte chamber 613 includes various process monitoring sensors, deoxygenating features and features for maintain low oxygen concentration in the anolyte. For example, an inert gas bubbler 624, connected with a source of an inert gas, such as argon or nitrogen, may be placed in the anolyte chamber, and may be configured to bubble inert gas through the anolyte for anolyte deoxygenation purposes. The anolyte chamber 613 may be configured for removal of process heat and may include a heat exchanger 625. In the illustrated embodiment the apparatus is also configured for measuring concentrations of anolyte components during electrolyte generation. The concentrations are measured by measuring the density of the anolyte with a densitometer and also measuring the conductivity of the anolyte with a conductivity meter, such as the anolyte conductivity meter 626. These two parameters (density and conductivity) can be combined and the concentration of metal ions and the concentration of acid in the anolyte can be calculated based on these parameters. The calculated concentrations from these two parameters (or the parameters themselves) are used to monitor and run the electrolyte generation process so that the product (electrolyte) is manufactured with concentrations of components falling into target ranges. The calculation and/or determination of whether the measured parameters are within the target ranges can be performed automatically by the controller. The anolyte chamber 613 contains a volume sufficient to accept the anode and associated hopper, the removeable cathode-housing assembly, and also has a volume for storing the generated anolyte (where cooling of the anolyte, deoxygentaion of anolyte, and measurement of anolyte parameters, such as density, conductivity, pH, and optical absorbance takes place). In the depicted embodiment the anolyte chamber 613 can be viewed as having a portion 627 proximate the anode and a cooling portion 629, arranged such that the cathode-housing assembly 611 resides between these two portions.

In the depicted embodiment the apparatus is further equipped with a mechanism and fluidic features to enable cascade of catholyte (which consists essentially of acid with no more than a trace amount of tin ions) from the first catholyte chamber (middle chamber) to the anolyte chamber. This cascade is advantageous for impeding transport of tin ions towards the cathode, as it can prevent the tin ions from reaching the hydrogen generating cathode. Thereby tin plating on the cathode and loss of cathode efficiency can be avoided. Further, this cascade prevents particle generation in the second cathode-housing chamber, since tin particles could form if tin ions are reduced in the cathode-housing chamber. Therefore, such cascade increases the life of the electrolyte generator between operator interventions and maintenance. In an alternative embodiment, portions of catholyte from the first catholyte chamber are removed from the mid chamber and transferred to waste (to a drain), and the first catholyte chamber is charged with fresh acid, thereby resulting in a decrease of residual tin ion concentration in the first catholyte.

Referring to side views of the generator (FIGS. 6A and 6B), the electrolyte generator 600 is shown in a simple generator containment vessel, 630, which is optional. More typically, the containment is part of the overall tool and system enclosure that also houses electronics, programmable logic controllers (PLC's) and computers, chemical feed access points, and general facilitation, where general facilitation includes sources of deionized water, supply of cooling water, sources of compressed dry air, sources of nitrogen, sources of electrical power, and exhaust.

A dosing and fluid transfer pump 631, shown in FIG. 6A as attached to the wall of the generator, is connected to a number of pump-source and pump-destination control valves (e.g. 633 and 635), so that this single pump can serve multiple generator-relevant fluid transferring operational tasks at different times in the generation process. The dosing and fluid transfer pump 631 is connected to a source of concentrated liquid acid feed stock 603. In some embodiments the source of acid 603 contains a concentrated acid (e.g. 98% sulfuric acid) or an aqueous acid solution (e.g., 70% methanesulphonic acid or 30% sulfamic acid solution). In alternative embodiments, depending on the type of the electrolyte produced, a different type of feedstock solution may be loaded into the tote 603. For example, in some embodiments, when a non-acidic electrolyte is generated, a neutral salt solution, an alkaline solution or a solution containing a metal chelator can be loaded into the feedstock tote. By setting the positions of the pneumatic valves to an appropriate combination of states, the concentrated acid solution can be transferred from the acid tote 603 to the cathode-housing assembly chamber 611, or to the anolyte chamber 613. The part of the total anolyte recirculation flow that returns to the anolyte chamber 613 without passing through the anode reaction zone 606 is monitored by a flow meter 637 before or after being filtered by filter.

The same dosing and transfer pump 631 is configured to draw a known amount of fluid out of the cathode-housing assembly 611 and to move it to either a waste drain, or to the anolyte chamber 613. In an embodiment previously illustrated with reference to FIG. 3A, pump 631 draws catholyte from the first catholyte chamber (mid chamber) of the cathode-housing assembly, and transfers the acidic catholyte to acidify the anolyte product in the anolyte chamber 613.

This process serves three primary functions. First, because the anion-permeable membranes 617 and 621 are not always completely effective in inhibiting positive ions (metal and hydrogen ions) from migrating across the membranes under the influence of the electric field applied to the electrolytic cell, a small amount of migrated metal ions and protons can transfer through the first anion-permeable membrane 617 (closest to the anode) and can start to accumulate in the first catholyte chamber (middle chamber) 615. In order to avoid the accumulation of metal ions in the first catholyte chamber 615 to a high enough concentration that would eventually allow them to move across the second membrane 621 to the second catholyte chamber 619 and be reduced to metal at the cathode in the second catholyte chamber 619, the catholyte is periodically drawn from the first catholyte chamber 615 and is either sent to waste, or, in some embodiments, is transferred to the anolyte chamber 613. The first catholyte chamber 615 preferably contains a relatively small volume of catholyte relative to that in the cathode-housing chamber. In some embodiments the total volume of catholyte (including catholyte in the first and second chambers) is about 30 L, of which the volume of the catholyte in the first chamber is only 1.5 L. In some embodiments the volume of catholyte in the first catholyte chamber is less than about 20%, such as less than about 10% of the total volume of catholyte (catholyte in first and second chambers combined). In some embodiments the volume of the first catholyte chamber in the apparatus is less than about 20%, such as less than about 10% of the total volume of the catholyte chambers. The small volume of the first catholyte chamber is advantageous because it allows for facile flushing of this chamber to remove tin ions, without having to transfer large amounts of liquid. The existence of the first catholyte (middle) chamber 615 allows for the transfer of ionically or mechanically leaked metal ions from catholyte back to the anolyte in such fashion that the leaked metal ions do not substantially come into contact with the cathode 623. This configuration greatly improves the robustness of the electrolyte-generation process, reducing the maintenance labor and increasing the long term reliability of the electrolyte generator.

The second advantage of the catholyte-to-anolyte cascade relates to acid management. When the acidic catholyte is transferred from the first catholyte chamber 615 to the anolyte chamber 613, it functions to replace the protons that are drawn out of the anolyte chamber into the first catholyte chamber during the electrolytic process. The physical transfer of acidic catholyte from the first catholyte chamber back to the anolyte chamber is a cost effective way of reversing the effect of this anionic membrane proton "leakage".

The third advantage of the catholyte-to-anolyte cascade also relates to replenishment of anolyte with acid. When small batches of generated electrolyte are removed from the anolyte chamber to the storage tank, the lost volume needs to be replenished before the next batch of electrolyte is generated. If that anolyte volume decrease were compensated for by solely adding water, the acidity of the anolyte will drop. This drop in acidity can become significant and problematic after several batches of electrolyte are generated and removed to the storage from the anolyte. If the acidity continues to fall, the solubility of the metal ions generated by the anode dissolution will tend to decrease. Therefore, transferring acidic catholyte from the first catholyte chamber to the anolyte chamber serves the purpose of replenishing acid in the anode chamber and for maintaining the acid balance and process stability. Preferably, the acid balance in the anolyte is maintained such that the acid content in the anolyte does not fluctuate by more than 50% of a target level. For example, when MSA or sulfuric acid is used, preferably acid content should not fluctuate by more than 15 g/L from a target concentration of 45 g/L during the electrolyte generation process (including during generation of individual batches and between generation of the batches). Preferably, when tin electrolyte is generated, the acid content of the anolyte is not allowed to drop below 15 g/L (referring to MSA or sulfuric acid content).

When the catholyte is drawn out of the first catholyte chamber, the level of catholyte in this chamber would decrease over time and the first catholyte chamber will eventually run completely dry. Therefore, the apparatus is equipped with fluidic features for replenishing the first catholyte chamber with acid and water. In one of the preferred embodiments, the first catholyte chamber is replenished via a fluidic conduit (other than a membrane) that fluidically connects the second catholyte chamber with the first catholyte chamber. In the illustrated embodiment the base of the cathode-housing assembly 611 contains a long and narrow conduit or channel 641 that fluidically connects the first catholyte chamber 615 with the second catholyte chamber 619. For example, the channel may be about 30.5 cm long having a cross sectional flow area of less than 2 $cm^2$. This channel serves as a flow ballast connection between the first catholyte chamber 615 and the cathode-housing second catholyte chamber 619, effectively working to keep the levels of catholyte in the two chambers equal. In one of the preferred embodiments, as catholyte is drawn out of the first catholyte chamber 615 and is transferred to the anolyte chamber 613, the catholyte in the cathode-housing assembly will spontaneously flow from the second catholyte chamber 619 (having a slightly higher level after the catholyte is drawn from the first catholyte chamber) through the connection conduit 641 and into the first catholyte chamber 615. In one embodiment, the conduit inlet 643 is located at the base of the cathode-housing assembly and at the distal end relative to the first catholyte chamber, thereby maximizing the distance and diffusion resistance for any metal ions that could possibly move by diffusion down the conduit 641, from the first catholyte chamber 615 into the second catholyte chamber 619 and reach the cathode 623. The volume and mass of the materials (e.g., water and acid) removed from the first catholyte chamber are replaced by adding an equal volume and mass of materials into the second catholyte chamber, measured, for example, using the dosing and transfer pump 631. This can be accomplished by using an appropriate configuration of valves 633 and 635 configured to draw acid from the acid tote 603 and to transfer this acid to the second catholyte chamber 619. In an alternative embodiment, the conduit 641 is absent, and fresh acidic solution and deionized (DI) water is added directly to the first catholyte chamber from an acid supply and DI water supply.

The apparatus depicted in FIGS. 6A-6E is further configured for supplying deionized water to both the anolyte chamber 613 and the second catholyte chamber 619. An anti-diffusion valve 645 is used in combination with other valves to direct DI water to catholyte or anolyte chambers. The anti-diffusion valve 645 is designed to prevent water stagnation and back-contamination of the DI water feed source. The anolyte chamber 613 has a drain 647 at its base through which the anolyte is drawn out by the main circulation pump 649. The drawn anolyte can be directed via line 651 to any of a number of destinations. When the anolyte reaches the required concentrations specified for generated electrolyte, the anolyte product from the anolyte chamber outlet can be transferred to the electrolyte storage container tote 601. If the required concentration of metal ions in the anolyte is not reached, or if transfer of product is not desired for any reason, the anolyte from the outlet can be transferred to the cooling portion of anolyte chamber 629, where the heat exchanger is located, or it can be injected back into the anode porous bed region 606 of the anolyte. The direction of the anolyte flow from the outlet can be controlled by periodically adjusting the settings of the valves. For example, periodically the recirculating anolyte is directed to the electrolyte storage tote, if the anolyte has target concentrations of components.

A flow meter 653 measures the fraction of the total flow of the anolyte that is used for recirculation. That flow starts from the outlet 647 and passes through the pump 649. The amount and/or fraction of flow going to either the anode reaction zone 606 via a manifold at the bottom of the reaction zone, or to the cooling portion 629 of the anolyte chamber is regulated by a control valve 657. In the illustrated example this regulation is accomplished by opening of a needle valve knob 659 of the anode reaction flow branch.

A diaphragm pump 661 is used for removing materials from the electrolyte generator for maintenance and cleaning Depending on the state of two way valve 663, the pump 661 can remove catholyte via line 665 from the second catholyte chamber, or it can remove anolyte from the anolyte outlet line before that line reaches the main circulation pump 649.

As it was previously mentioned, the metal pellets are supplied to the anode reaction zone 606 via a metal pellet hopper 605. The hopper has a lid 667, and one or more surfaces slanted from top to bottom, such that the pellets supplied from the top opening are contained and the flow of pellets is directed through the reaction chamber pellet entrance (or throat) and into the anode reaction zone 606. When the electrolyte generator is "on" and an anodic current and potential is applied to the anode buss 671, current passes onto the anode charge plate 607 and to the pellets. Two anode busses 671 run along the periphery of the anode reaction zone 606 and pass through the plastic wall of the anode hopper 605 using a connection bolt.

The apparatus illustrated in FIGS. 6A-6F is configured for maintaining the level of hydrogen below the lower explosion limit (LEL). The apparatus includes a main access lid 673 which covers the top of the electrolyte generation reactor and is functional in controlling the flow of air, such that the hydrogen gas level in the chamber below the lid remains lower than the LEL for hydrogen in air. Dilution air (which acts as a diluent gas in this case) enters the chamber between the top lid 673 and an inner lid 675 covering the cathode-containing assembly 611 through a set of inlet openings 677, which are visible in the view of the apparatus shown in FIG. 6E The diluent gas moves substantially parallel to the horizontal plane in the space between the lids 673 and 675, mixing with hydrogen-containing gas that exits the cathode-housing assembly 611 through openings 678 in the inner lid 675. The mixed gas then reaches the exhaust manifold distribution plate 679, enters the exhaust manifold 681 and exits through the exhaust 683.

In the depicted embodiment, an additional flow of a diluent gas is directed into the space above the catholyte above the cathode 623 and below the inner lid 675. The structure of the inner lid and of the cathode-housing assembly is visible in FIGS. 6F-61. The second catholyte chamber 619 contains a hydrogen-generating cathode 623 which is also referred to as a dimensionally stable cathode (DSC), which generates hydrogen gas during electrolyte generation. The cathode has external connection buss points 685, which are connected to a power supply that negatively biases the cathode during electrolyte generation. Inert DSC cathodes are commonly used as a hydrogen generating electrodes in electro-synthesis and fuel cell applications as a well as cathodes for the chloro-alkali industry. These cathodes are distinct from dimensionally stable anodes (DSA) that are commonly used in electrowinning and chlorine production in the chloro-alkali industry. The DSC is commonly made of an underlying titanium or similar electrochemically inert substrate or a plate that is coated with a relatively thin film (e.g., less than 100 microns thick, such as 10-90 microns thick) of a material having catalytic properties for the reaction of water and acid electrolysis and more generally for hydrogen formation. Common coating materials include platinum, niobium, ruthenium, iridium dioxide, and mixtures thereof. During operation of the electrolyte generator, hydrogen bubbles are formed at the cathode 623 in the gap 687 between the anode-facing surface of the cathode and the second anion-permeable membrane 621. The atmosphere in the cathode-housing assembly 611 below the inner lid 675 is composed of a mixture of hydrogen generated at the inert cathode 623 and a diluent gas (e.g., diluent air) that is introduced into the cathode-housing assembly via line 689, through fitting 691 and through catholyte chamber manifold 693. The diluent gas is introduced uniformly just above the location of the emerging hydrogen bubbles through a set of manifold hole 695. The flow rate of the diluent gas is configured such that it will result in a hydrogen concentration in the chamber below the inner lid (assuming complete and uniform mixing) well below the lower explosion limit of hydrogen. In some embodiments the concentration of hydrogen under the inner lid is 4 times lower than hydrogen's LEL or is less than 4% (or less than 40000 ppm) of $H_2$ in air. The required flow rate of the diluent air can be calculated from the amount of current used during electrolyte generation, which is correlated with the rate of hydrogen generation at the cathode. For example, if the reactor current is I Amperes, the expected volumetric rate (R) of hydrogen generation in liters per minute will be:

$$R=22.4\times I\times 60/(n\times F),$$

where 22.4 L is a volume of one mole of gas at a standard temperature and pressure (at 1 atmosphere and 20 degrees C.), 60 is the number of seconds in a minute, n is the number of electrons required per mole of hydrogen product produced (2 electrons), and F is a Faraday's constant (96500 coulombs per mole of electrons). For a system running at 100 Amps, the rate of hydrogen gas generation calculated according to this formula will be about 0.007 liters per minute. If an air diluent stream with a volume flow rate of (0.007×4)/0.04=0.7 1 pm is introduced into manifold 693, the concentration of hydrogen will, on average be ¼ the LEL level in that chamber. In one of preferred embodiments and in order to increase the safety of the operation, an inert gas (e.g. nitrogen or argon) is used as the diluent gas instead of air. In this case, there is essentially no oxygen in the chamber, and the mixture exiting the chamber is at a dilution level that is far below the required dilution if the diluent were air. In this case any subsequent dilutions with air will always lead to decreasing hydrogen concentration below the LEL. This configuration significantly minimizes fire and explosion risks both in the cathode-housing assembly and elsewhere in the electrolyte generator.

In some embodiments, an optional feature 697 is provided on the cathode-facing side of the inner lid 675, where the feature acts as a splatter flow separation guard. As bubbles of hydrogen break while they rise from the gap 687, droplets of catholyte may be splattered onto the inner lid 675 and can accumulate on the inner portion of the lid under the influence of surface tension forces, particularly right above the gap. In one of the embodiments the inner lid 675 is positioned at an angle to the horizontal plane, preferably at an angle of between about 5-20 degrees. The slope of lid 675 allows the accumulated catholyte droplets to move by gravitational force in the general direction of the inner lid outlet holes 699. The splatter flow separation guard 697 is positioned to prevent the droplets from flying through the holes, or from flowing along the surface of the inner lid and being drawn up onto the opposite (top) surface of the inner lid 675. The splatter guard 697 also redirects the flow of the splattered catholyte on the bottom surface of the inner lid 675 downwards and back into the catholyte below. This prevents the splattered catholyte from being potentially drawn up by the gas flow out of the catholyte chamber.

The fluid levels in the anolyte chamber and in the second catholyte chamber are actively monitored in the depicted apparatus for reliability problems (such as for low level of electrolyte and for overflow of electrolyte). The monitoring is performed by fluid level sensors that are in communication with an apparatus controller. One example of a particularly useful low cost level sensor is the combination of a pressure transducer (available, for example, from Dwyer of Wilmington, N.C.) teed into a line and connected to a gas bubbling line 701, where the sensed pressure is correlated to the fluid surface level above the end of the bubbling line tube opening "h", by the following expression:

$$\Delta P=\rho gh.$$

If an inert gas (e.g., nitrogen or argon) is used for bubbling in this type of sensor, such bubbling sensor would have the additional benefit of serving as a deoxygenation device for the fluid that is being measured (e.g., anolyte or catholyte). Therefore, in some embodiments an inert gas is supplied from an inert gas source to the sensor and is bubbled through the fluid. Another example of a continuous level monitoring sensor is an ultrasonic reflection depth sensor. These and similar functional sensors can continuously measure the actual level of fluid (e.g., anolyte and catholyte), in contrast to trip level type sensors, which send a unique signal when the level of fluid is either above or below a target level setting. It is understood, that trip level type sensors can be used in some embodiments in the provided apparatus. Examples of target (trip) level sensors include capacitive level sensors and float switches.

In one of the preferred embodiments, the electrolyte-generating apparatus includes a densitometer and a conductivity meter configured to measure both the density and conductivity of the anolyte. The combination of density and conductivity is correlated to compositional data of the anolyte to simultaneously determine and control the metal and acid content in the anolyte. An inline densitometer, such as an in line MEMS based densitometer unit produced by Integrated Sensing Systems of Ypsilanti, Mich., can measure the fluid density of the anolyte with an accuracy of 0.0005 $g/cm^3$. In one embodiment, the target density of the tin anolyte, when it reaches the desired concentration of tin ions and becomes the product electrolyte is about 1.50 $g/cm^3$. The density of metal-containing product electrolyte typically has a stronger dependence on metal ion content than on acid content, due to the larger partial molar density of metal ions. A family of data curves of conductivity and density as a function of metal ion content (at different fixed acid concentrations) can be obtained and used to determine the compositional unknown quantities (e.g., metal ion and/or acid concentrations) continuously and accurately. Thus, monitoring of density and conductivity is useful for determining two compositional concentrations (e.g. acid and metal content), and allows for process adjustments such as addition of acid, water, or provision of additional charge for generation of additional metal ions. A similar process can be used if using different measured intrinsic property measurements pairs. The minimum number of measurements is equal to the number of materials (ionic pairs) being measured (two for a two component system with a single anion, or three for three components with three components and a single anion). Examples of intrinsic properties that could be used/measured in combination include density, viscosity, osmotic pressure, conductivity, refractive index, pH, and optical absorbance at a given frequency. As some of these intrinsic variables can have strong temperature dependency (density and optical absorbance of a fluid being notable exceptions) it is also important to measure the temperature and record change in property response with temperature if temperature is not fixed during the measurement, and to know the differential change in the response with temperature. Many sensors include build in thermal couples or thermistors.

The passage of current through the resistive electrolyte in the reactor generates heat. In some embodiments, a heat exchanger is provided in either the anolyte chamber, the catholyte chamber, or both. In the depicted example, the heat exchanger is provided only in the cooling section 629 of the anolyte chamber 613. The illustrated heat exchanger is composed of a main titanium pipe inlet manifold 703, which feeds several (e.g., 4) weld-connected heat exchange titanium pipes 704 of smaller diameter that serpentine back and forth in the anolyte reactor cooling area. At the opposite end of the chamber, the smaller tubes 704 connect to an exit port manifold 705. A cooling fluid, such as facility liquid cooling water or a cooling fluid generated and circulated by an external chiller unit, circulates through the heat exchanger to cool the anolyte and maintain it at a target temperature (e.g., at less than about 40° C.). In one embodiment, the temperature of the anolyte is controlled by opening a liquid cooling water inlet valve when the temperature of the electrolyte exceeds a target maximum temperature. In other cases the temperature is actively controlled using the sensed temperature and a feedback controller of an external fluidic chiller unit. An anolyte temperature sensor is provided for this purpose.

The depicted electrolyte-generating reactor further contains an overflow weir. A fluid entering the anode reaction region and passing upwards through the porous anode particles flows upwards to an overflow porous region or "weir". After the flow reaches the weir, it changes direction and then flows through the anode containment plate assembly in a horizontal direction. In one of embodiments, the apparatus includes a fluid and particle diversion trough or "gutter" 709 that has a sloped collection surface that is configured to collect and confine the fluid flowing out of the overflow weir and to direct it to a peripheral coarse particle filtering assembly 711. This fluid will typically contain particles formed at the anode that should be removed by filtration. The gutter 709 empties the fluid into a removable sock-type filter unit (not shown), which is configured to remove coarse particles from the fluid. The fluid enters into the open portion of the sock-type filter and after filtration the fluid exits the filter assembly 711 through openings in the wall of the main anode chamber 713. The filter sock can be removed and cleaned or disposed of and replaced. The coarse particle filtering assembly 711 with accessible removable filter sock diverts recirculated flow for separation of coarse particles in the product, reduces the load on the fine filter assembly 639, and allows for the quick and easy removal of the filter without draining the reactor or turning the reactor off. The gutter is illustrated primarily with reference to FIG. 7C which presents a cross-sectional view of a portion of the apparatus where the plane of the cross-section is perpendicular to the plane of the cross-section used in FIG. 6C.

Electrolyte Generation Process

The metal electrolyte generation and control processes are illustrated in FIGS. 8A - 8B, and 9A - 9F. The processes are carried out in the electrolyte generation systems described herein. In a batch process, illustrated in FIG. 8A, the process starts in 801 by passing current through an apparatus having an active anode (e.g., low alpha tin anode) and a hydrogen-generating cathode separated by a membrane. The apparatus (anolyte and catholyte chambers) is originally charged with an electrolyte (e.g., with an aqueous solution of an acid), and power supply delivers sufficient current to the anode and the cathode to cause the dissolution of the anode. In one example, an initially empty anolyte chamber having a tin anode is charged with a predetermined appropriate amount of acid (e.g., methanesulfonic acid and/or sulfuric acid) and water, and the catholyte chamber (or chambers) is also charged with a predetermined amount of acid. In some embodiments, the concentration of acid in the anolyte before current is applied is lower than the concentration of acid in the catholyte. Furthermore, in one of the preferred embodiments, the anolyte (before current is applied) contains tin (II) salt in addition to the acid. For example, in one embodiment the anolyte initially contains tin (II) methanesulfonate and MSA, while catholyte contains only MSA at a higher concentration than the concentration of MSA in the anolyte. It was discovered that it is preferable (although not necessary) to start the process by providing tin ions in the anolyte that would be at least about 60%, more preferably at least about 80% of the tin target concentration, and particularly preferable at least about 90% of the tin target concentration, and to start with an acid concentration in the anolyte of less than 1 M, such as between about 0.3 - 0.7 M, e.g., 0.5 - 0.7 M. For example, in some embodiments it is preferable to provide a concentration of tin ions in the anolyte (before application of current) of at least about 200 g/L, such as at least about 250 g/L. Providing tin ions in the anolyte before application of current provides the advantage of improved anolyte and system stability. Specifically, it was discovered that solutions containing low concentrations of tin ions (and secondly high concentrations of acid) are relatively less stable than solutions with higher tin ion concentrations (and low acid). By providing a relatively high concentration of tin ions before current is applied, it is ensured that the concentration of tin ions will only increase after the current is applied and the anolyte will remain highly stable. The formation of undesirable $Sn^{4+}$ ions and associated particle generation is generally suppressed under these preferred operating anolyte concentrations. Furthermore, if no tin ions are in the anolyte before application of current, the concentration of tin ions will increase from zero to a target concentration (e.g., to 300 g/L), which may cause undesired osmotic effects and can impact the membrane more than a more modest increase in tin ion concentration (e.g., from 250 g/L to 300 g/L). The maintenance of a relatively low concentration of acid (e.g., 0.3 - 1M concentration) in the anolyte also confers higher stability to the anolyte.

Referring again to FIG. 8A, in operation 801, current is supplied to the reactor to cause dissolution of metallic (e.g., low alpha tin) anode. The current is supplied such that the total charge delivered to the system is sufficient to generate the target concentration range of tin ions in the anolyte. For example if the broad target concentration range for tin ions is between about 280-320 g/L, the current is supplied for an amount of time that is necessary to generate the required amount of tin ions in the anolyte and to reach the target concentration in a known volume of the anolyte. The time is calculated based on Faraday's law of electrolysis, given that the level of supplied current and the volume of the anolyte are known parameters. The apparatus typically includes a timer interfacing with the apparatus controller, where the controller provides instructions for starting and stopping application of current based on the input from the timer. In one example, the charge required to generate 456 g of tin ions in the anolyte is about 206 A·h. In this example, current can be applied at a level of 100 A for about 124 minutes. The level of current provided to the apparatus can vary and will generally depend on the circulation flow rate in the reactor, and on the projected area of the anode pellets to the counter electrode.

The concentration of metal ions in the anolyte is measured in operation 803. For example, the concentration of tin ions can be measured using densitometry, either alone or in combination with the measurement of conductivity of the anolyte. The concentration can be measured continuously before, during, and after application of current, or intermittently. In some embodiments, the concentration of metal ions is measured shortly after application of current is stopped. After the target concentration of metal is reached, and it is confirmed by the metal concentration sensor, the anolyte is transferred in an operation 805 to the electrolyte storage container. Optionally, the concentration of acid in the anolyte is also measured and may be adjusted before the anolyte is transferred to the electrolyte storage container. The concentration of acid can be measured using a conductivity sensor measuring the conductivity of the anolyte (provided that the concentration of metal ions is known). After the target concentration of metal ions is reached in the anolyte, the residual acid concentration at that point may be at a target level, too high or too low. If the concentration of acid is at the target level, the batch process is completed, and the anolyte (all of it or only a portion of it) is transferred to the electrolyte storage container in the operation 805. If the concentration of acid is low, additional acid is transferred to the anolyte in the amount that is necessary to reach the target level of acid. If that dilution due to the acid addition is sufficiently small to not drive the metal ion concentration below the lower control target limit (below the broad metal ion target concentration range), the batch generation cycle is complete, and the anolyte is transferred to the electrolyte storage container. If the amount of added acid does dilute the anolyte such that the metal ion concentration is below the target metal ion concentration range, additional charge is applied to the system to bring the metal ion concentration into the broad range for target concentration. The adjustment process (addition of acid to anolyte, and passing of additional charge through the system) can be repeated, and can also include removal of a portion of anolyte from the reactor to waste, if needed, until the target concentrations of metal ions and of acid are achieved. If the acid concentration is too high, one method of recovery is to remove a portion of the anolyte to waste, replace some or all of that removed volume with water, and generate additional metal ions by passing additional current through the apparatus until both the metal and acid concentrations are inside the broad target concentration control limits. In subsequent cycles, information related to the corrective actions for this cycle is used to modify the initial amount of acid/water and charge for the cycle. The role of the metal ion concentration sensor may be monitoring of metal ion concentration in the electrolyte to prevent transfer of electrolyte to the storage container, if the concentration of metal ions is not within the broad target range, collection of data for adjustment of process parameters in subsequent batches during electrolyte generation if the concentration of metal ions is within the broad target range but is outside the narrow target range. Additionally, in some embodiments the metal concentration sensor will directly signal the controller to stop the application of current after target concentration range of metal ions (e.g., target density range) is reached. In this embodiment the sensor can be used instead of the timer to provide the "current-off" signal.

In some embodiments the electrolyte generation process is performed continuously using a plurality of cycles, wherein each cycle generates a batch of electrolyte. The process flow diagram shown in FIG. 8B illustrates a cyclic process for electrolyte generation, where each cycle involves removal of only a portion of generated electrolyte product to the electrolyte storage container. The process starts in 809, similarly to the process shown in FIG. 8A, by passing current through an apparatus having an active metal anode and an inert hydrogen generating cathode, and monitoring concentration of metal ions in operation 811. Next, after a target concentration of metal ions is reached in the anolyte, only a portion of the anolyte (electrolyte product) is removed to the electrolyte storage container in operation 813. In one of the preferred embodiments, the removed portion is relatively small and is preferably less than about 20%, such as less than about 15%, such as between about 1-10% (e.g., about 5%) of the total volume of the anolyte. Next, in operation 815, the anolyte chamber is replenished with acid. In this step, an appropriate amount of acid and water is added to the anolyte. Next, current is delivered to the electrolytic cell again, until the concentration of the anolyte returns to the broad target control range, and a portion of electrolyte is again removed to the storage container. Thus, as shown in operation 817, the steps 809-813 are repeated. In some embodiments, each cycle further includes adding a necessary amount of acid to the catholyte.

Transfer of small amounts of electrolyte product to the storage in a single cycle has a number of advantages over transfer of the entire anolyte, and over transfer of large amount of anolyte. When small amounts of electrolyte product are transferred to storage, the perturbation from the target concentration of both acid and metal ion is small over the course of each cycle, because the amount of dilution at the beginning of the cycle is small (e.g. 5%), and because the change in ionic strength and therefore osmotic pressure of the anolyte relative to the catholyte over the cycle is small. The process can be designed such that osmotic pressure on the catholyte side is nearly identical to the pressure on the anolyte side, and water transport due to osmosis can be minimized. While electro-osmotic drag, which tends to transfer water with the moving ions (in this case with the anions moving through the anionic membrane) can be significant, it is measureable, calculable and repeatable for each of the process sequences. Therefore, the amount of water lost by the anolyte due to electro-osmotic drag in each cycle is known, and the lost water can be easily replaced. Therefore, in some embodiments the process is conducted such that the concentration of $Sn^{2+}$ in the anolyte does not fluctuate by more than 10%, such as by more than 3% over the course of several generation cycles (e.g., 5 generation cycles). Also, preferably the concentration of acid in the anolyte does not fluctuate by more than 100%, such as by more than 50% over the course of several generation cycles (e.g., 5 generation cycles).

Another advantage of removing only a small amount of electrolyte per each cycle is that the concentration of metal ions can be maintained throughout the cycles at a relatively high level. It was observed that an electrolyte having high concentration of $Sn^{2+}$ ions and methanesulfonate as a counter ion is much more resistive to oxidation to $Sn^{4+}$ species than an electrolyte having a low concentration of $Sn^{2+}$. Therefore, in some embodiments, the concentration of $Sn^{2+}$ ions is maintained at least at 250 g/L, more preferably at least at 270 g/L during one cycle or during a plurality of cycles. In some embodiments the concentration of tin ions at the beginning of each cycle is at least about 90% of the target tion ion concentration. In one example, the concentration of tin ions is about 95% of the target tin ion concentration. For example at the beginning of the cycle concentration of tin ions may be 285 g/L, and after generation is complete the anolyte reaches a target tin ion concentration of 300 g/L. Maintaining a high anolyte tin concentration throughout the process has significant advantages related to the purity of obtained electrolyte and efficiency of the process.

When cyclic process is used, the current can be applied to the generator electrodes continuously or intermittently. In one of the embodiments, when current is applied to the electrodes, no acid or water is added to the apparatus, and the electrolyte product is not transferred to the storage tank. This embodiment is advantageous because it is easier to maintain the balanced concentrations of components and to orchestrate transfers of fluids, since concentration of metal ions in the anolyte is constant when current is not applied. In other embodiments, acid may be added to the anolyte without turning off the current. The advantage of this embodiment is that small amounts of acid can be added to the anolyte with high frequency, thereby minimizing acid concentration fluctuations in the anolyte and minimizing related osmotic effects. Finally, in other embodiments application of current may be continuous and is not stopped when electrolyte product is transferred to the storage container, and when the anolyte and catholyte are dosed with acid and water. The advantage of this embodiment is its high efficiency.

Figure 8A:
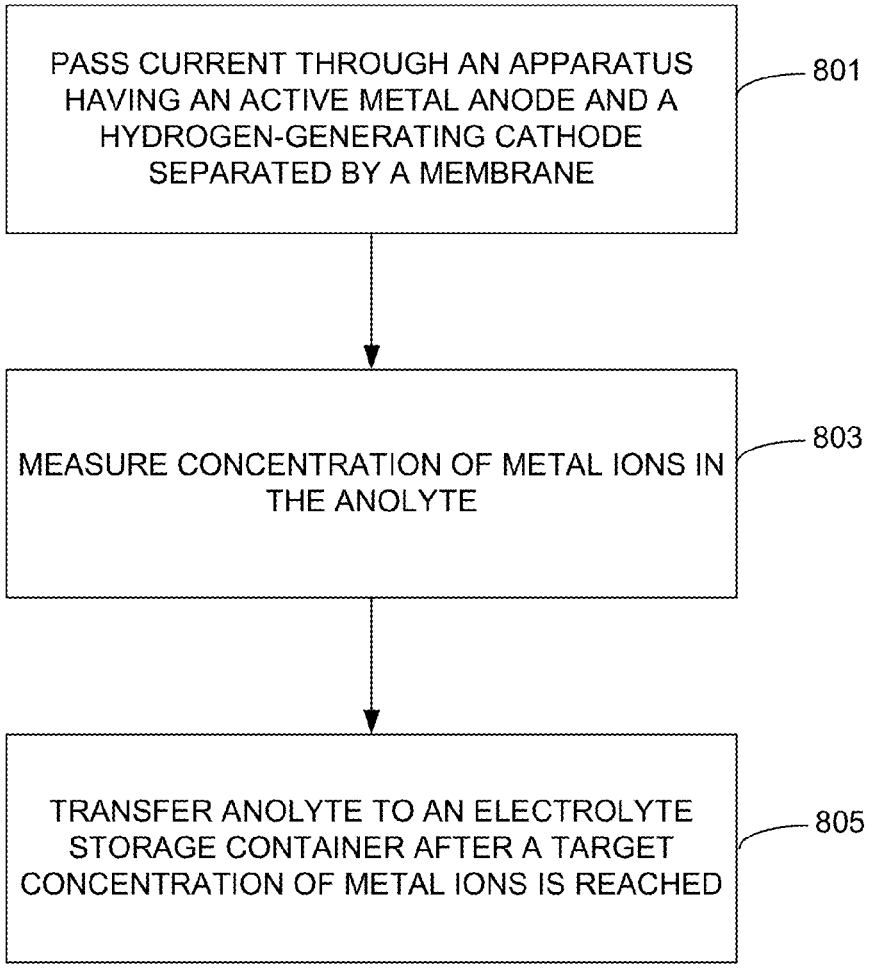
FIG. 8A is a process flow diagram for a method of generating electrolyte according to an embodiment provided herein.
Figure 8B:
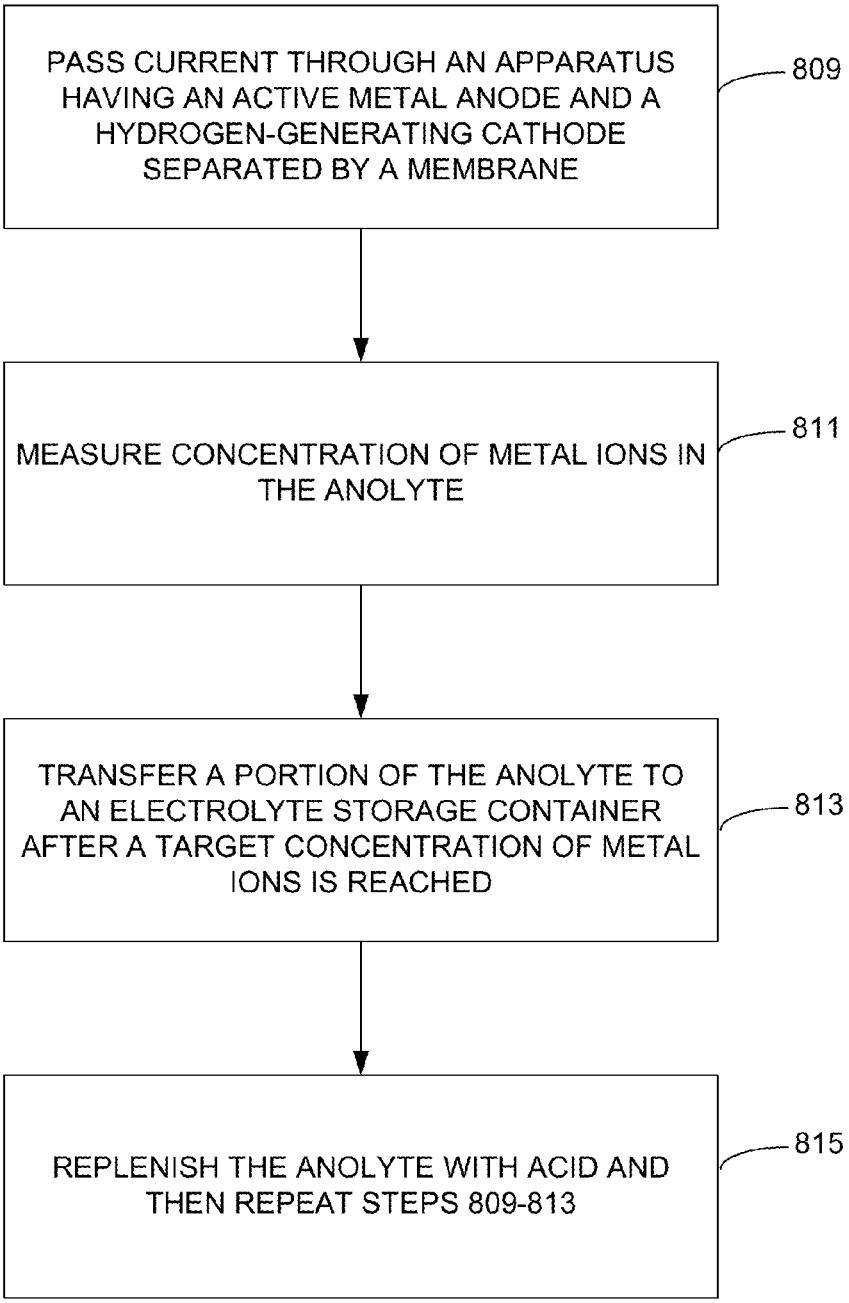
FIG. 8B is a process flow diagram for a method of generating electrolyte according to an embodiment provided herein.

It is understood that the methods illustrated in FIGS. 8A and 8B can further incorporate any of the steps that were previously discussed in conjunction with the description of the apparatus. Thus, the methods may involve providing one or more diluent gases to the electrolyte generating apparatus in order to dilute generated hydrogen gas and remove the diluted gas through an exhaust. The methods may further include deoxygenating anolyte and/or catholyte by, for example, bubbling an inert gas. Furthermore, the methods may involve periodically removing the second catholyte (e.g., a portion of the second catholyte) from the second catholyte chamber and filling the second catholyte chamber with a fresh acidic solution.

One of the important features of an automated multi-cycle electrolyte generation process, is the maintenance of stable concentrations of anolyte and catholyte components and maintenance of mass balance for these components throughout the cycles. Maintaining mass balance involves adding defined amounts of acid and water to anolyte and catholyte to accurately compensate for consumed and transferred acid and water in the anolyte and catholyte chambers. For example, in a cyclic process that involves application of current to the electrodes to generate tin ions in the anolyte, followed by transfer of a portion of anolyte product from the anolyte to the storage tank, and followed by addition of acid solution (and optionally water) to the anolyte and catholyte, the amounts of added water and acid are calculated such that the amount of tin ions and acid in the anolyte, and the amount of acid in the catholyte before application of current is substantially the same as the corresponding amounts of tin and acid at the end of the cycle (after current has been applied, a portion of electrolyte has been transferred, and acid and/or water have been added to the anolyte and catholyte chambers). More preferably, not only the amounts of tin ions and acid are substantially the same, but also the concentrations of tin ions and acid are substantially the same.

The amounts of acid and water that need to be added to anolyte and catholyte to maintain mass and concentration balance over a plurality of cycles, can be calculated and programmed into a system controller. For example, in one of the embodiments employing tin ions, methanesulphonate (MS) ions, and MSA, and an anion-permeable membrane, the amounts of acid and water are calculated based on the facts that during application of a defined amount of charge, a known amount of MSA moves from the anolyte chamber to the catholyte chamber, and a known amount of MS moves in the opposite direction from the catholyte chamber to the anolyte chamber along with some amount of water. Furthermore, the calculation takes into account the known amount of tin that is generated during application of charge in the anolyte, the known amount of acid that is lost from the catholyte during application of charge to generate hydrogen gas, and the amounts of acid and tin that are removed during transfer to the product storage tank.

Figure 9A:
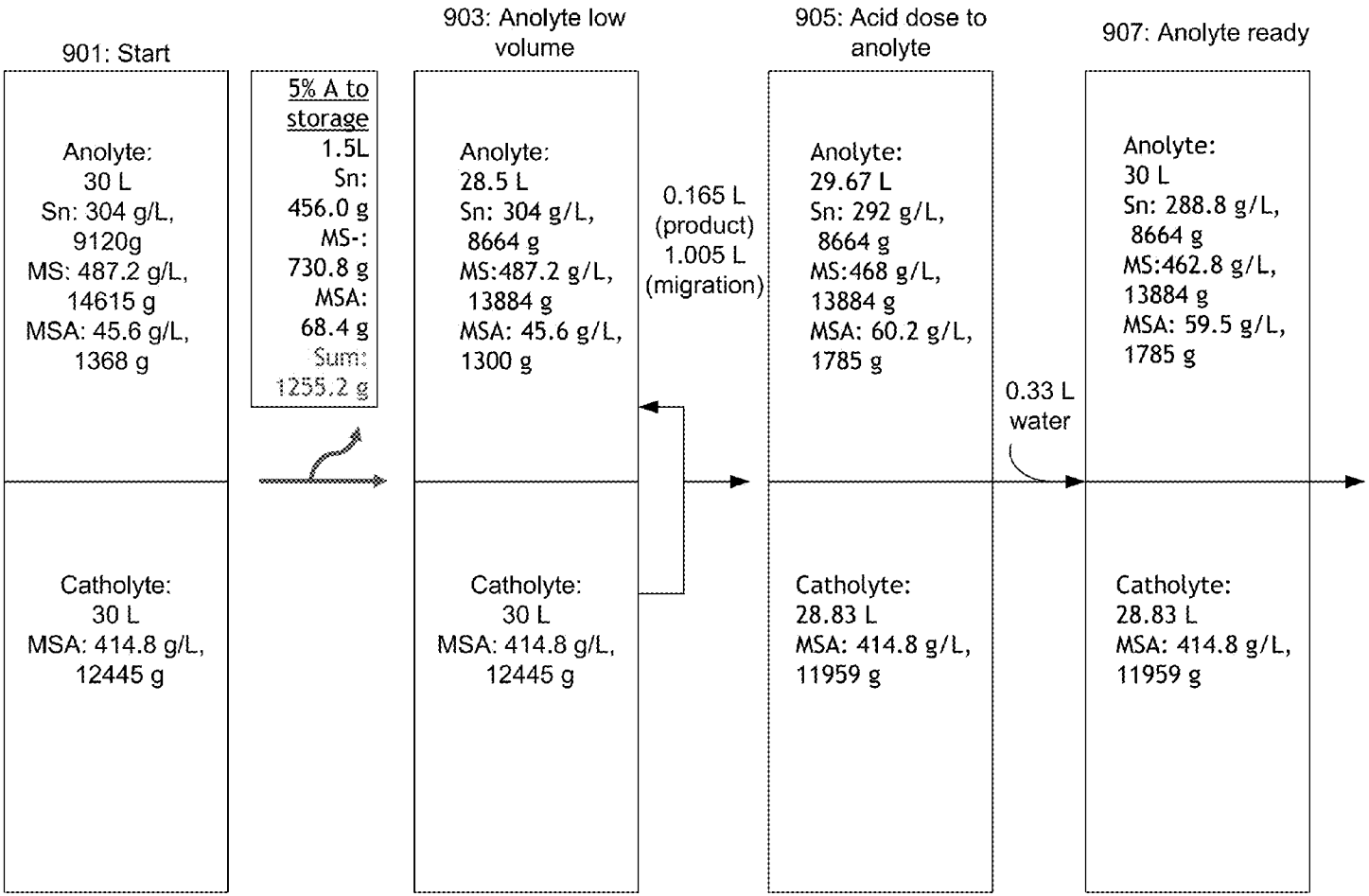
FIG. 9A is a first portion of a diagram illustrating anolyte and catholyte compositions during electrolyte generation according to an embodiment provided herein.
Figure 9B:
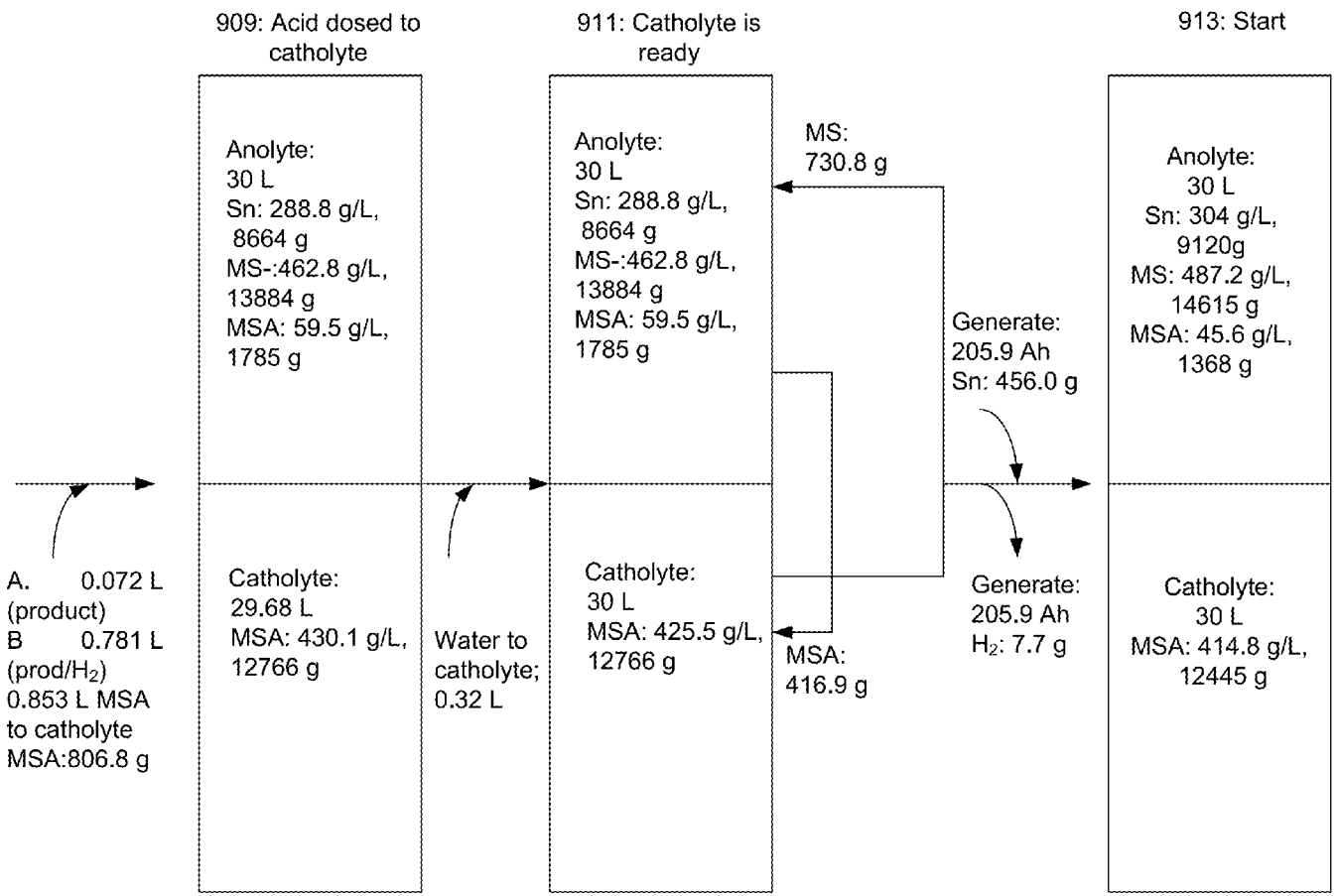
FIG. 9B is a continuation of a diagram provided in FIG. 9A.
Figure 9C:
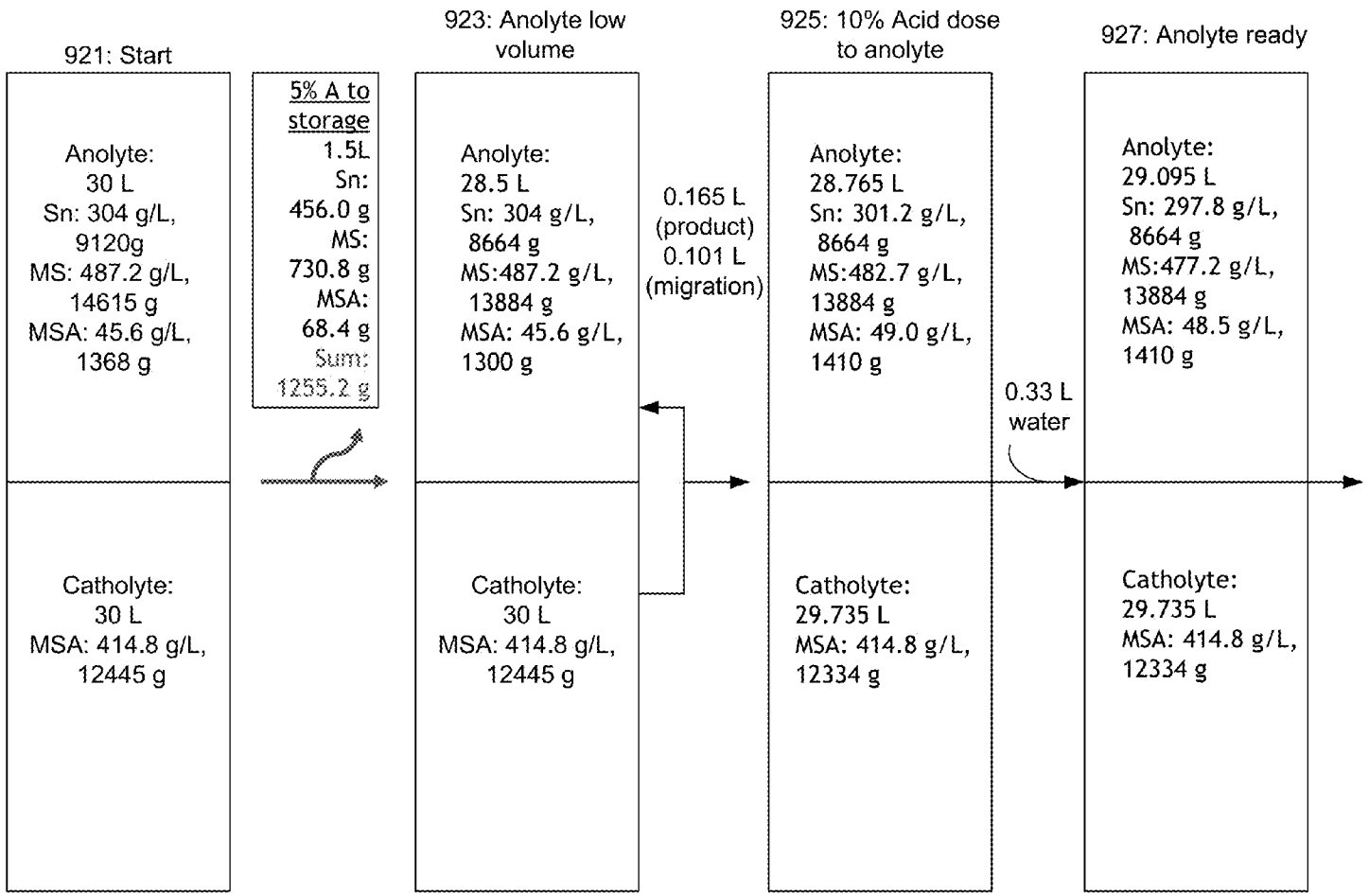
FIG. 9C is a first portion of a diagram illustrating anolyte and catholyte compositions during segmented acid electrolyte generation according to an embodiment provided herein.
Figure 9D:
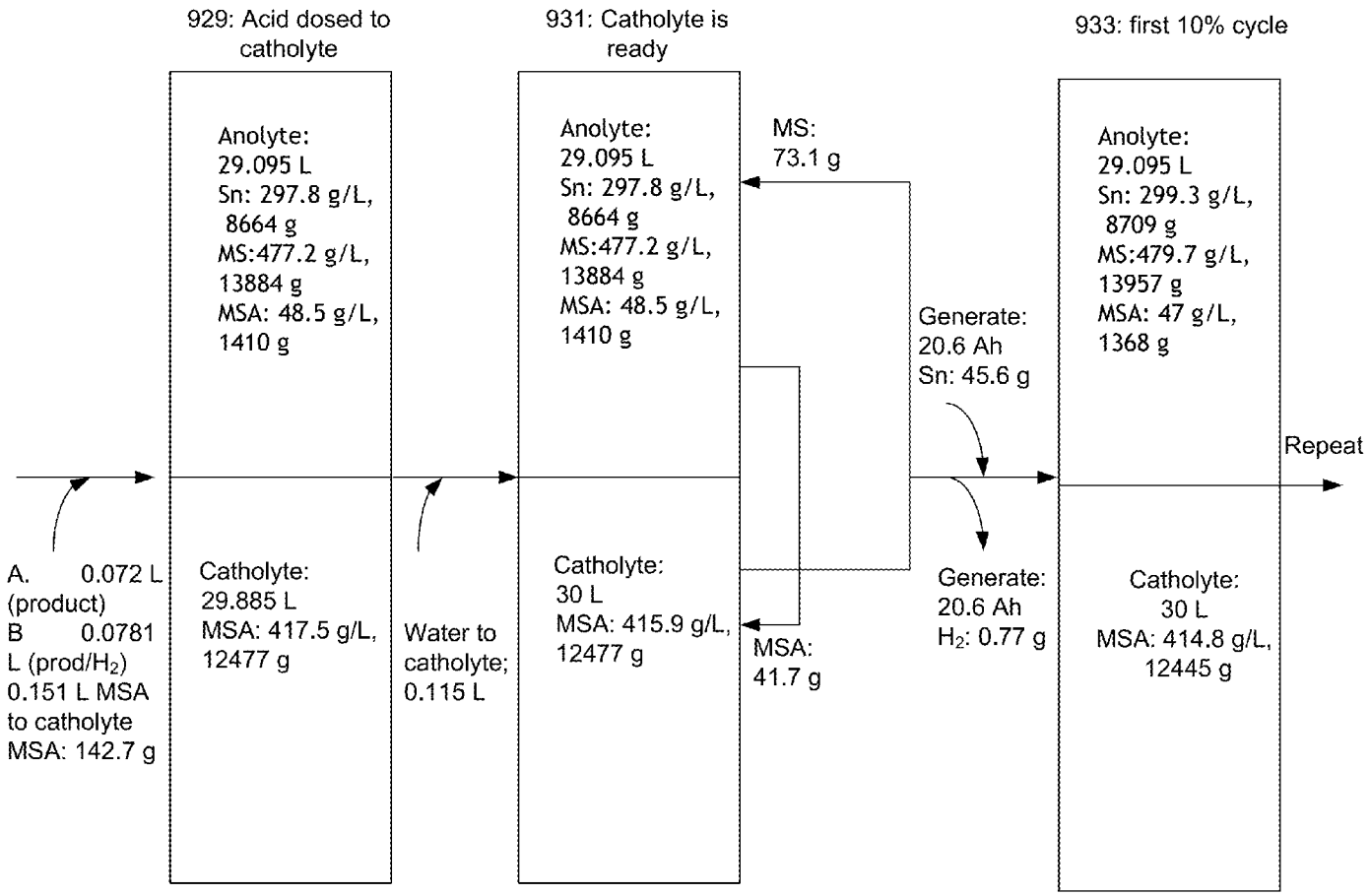
FIG. 9D is a continuation of a diagram provided in FIG. 9C.

Three examples of maintaining mass balance in three different cyclic processes are illustrated in FIGS. 9A-9F. These schemes show the concentrations and amounts of components in the anolyte and catholyte at different stages of the process. FIGS. 9A-9B illustrate a cycle in which no material transfer is occurring when current is applied to the electrodes, and where catholyte (first catholyte chamber) serves as the source of acid for the anolyte (a cascade embodiment). The depicted process starts in 901, where the electrolyte at a target tin ion concentration of 304 g/L has been generated in the anolyte. When the electrolyte is generated, the concentrations of tin ions and of acid in the anolyte are measured by the conductivity and density sensors. If the concentrations of tin ions and acid are too high at the end of generation, water is added to the anolyte to bring the concentrations to the target. If the concentration of tin is too low, additional charge is passed through the system to reach the target concentration. If the concentration of acid is insufficient, then acid is added to the anolyte. If both concentrations of tin ions and of acid are at a broad target level, 5% of the total anolyte volume (1.5 L of 30 L anolyte) is transferred to an electrolyte storage container, as shown in FIG. 9A. Next, in 903, after a portion of the anolyte has been removed to storage, the volume of the anolyte is low and is at 28.5 L. The conductivity of the anolyte is checked, and, if it is too high, more water is added to the anolyte. If the conductivity is too low, then more acid is added. If the conductivity is at the broad target level, 1.17 L of catholyte (acid) is transferred to the anolyte. The 1.17 L of catholyte are used to make up for 0.165 L of acid transferred from the anolyte to the storage container with the product electrolyte and for 1.005 L of acid that migrated from the anolyte to catholyte through the membrane during tin ion generation. This results in composition 905, in which the anolyte has the required amount of acid. Next, water is added to the anolyte until the original anolyte volume (30 L) is reached, resulting in composition 907, in which the anolyte is ready for application of current. In the next step, acid needs to be added to the catholyte to make up for the acid transferred to the anolyte and removed with the electrolyte to storage (0.072 L) and for the acid that will be used to make hydrogen gas in the following run (0.781 L). Therefore, 0.853 L of 70% MSA are dosed to the catholyte from the acid tote resulting in composition 909. Finally, deionized water is added to the catholyte to top it off to 30 L resulting in composition 911, in which both the anolyte and the catholyte are ready for generation of electrolyte. Next, power is applied to the anode and the cathode and a pre-calculated amount of charge (205.9 Ah) is passed through the system to generate more tin ions in the anolyte. While power is applied, 416.9 g of MSA are transferred from the anolyte to catholyte, and 730.8 g of methanesulfonate are transferred from the catholyte to the anolyte through the membrane. Also, during the course of electrolyte generation 456 g of tin ions are formed in the anolyte from the anode, and 7.7 g of hydrogen are removed from the catholyte. The resulting compositions of the anolyte and catholyte 913 at the end of application of current are the same as after previous application of current 901. In sum, 806.8 g of MSA are added to the electrolyte generator from the acid tote, and 456 g of tin ions are added to the solution from the anode, resulting in 1262.8 g of total added materials, whereas 1255.2 g of product electrolyte is removed to storage and 7.7 g of hydrogen is removed from the apparatus, resulting in 1262.9 g of removed materials, thereby substantially completing the mass balance.

While in the embodiment illustrated by FIGS. 9A and 9B, addition of acid and water to the anolyte is performed while the power is not provided to the electrodes, in other embodiments it is possible to add acid to the apparatus while generating electrolyte (while applying power to the electrodes). This embodiment is illustrated with reference to FIGS. 9C and 9D. The steps 921-923 of this method are similar to the steps illustrated in FIGS. 9A and 9B, while the amount of acid dosed to anolyte and catholyte is scaled down to reflect than only 10% of the amount of charge that was applied in the method illustrated in FIGS. 9A and 9B. Thus, while charge is being applied (at the 10% level), acid is being dosed to anolyte and catholyte (at the appropriate level corresponding to 10%). This intermittent acid dosing can be performed for example 10 times while more charge is applied. This method is referred to as the segmented acid method to indicate that unlike in the previously illustrated method, where the acid was added to the anolyte and catholyte at 100% when current was applied, in this method the acid is divided into ten segments that are added at regular intervals while current is being applied to the electrodes of the apparatus. Transfer of the product to the storage tank can be performed after current is stopped.

Figure 9E:
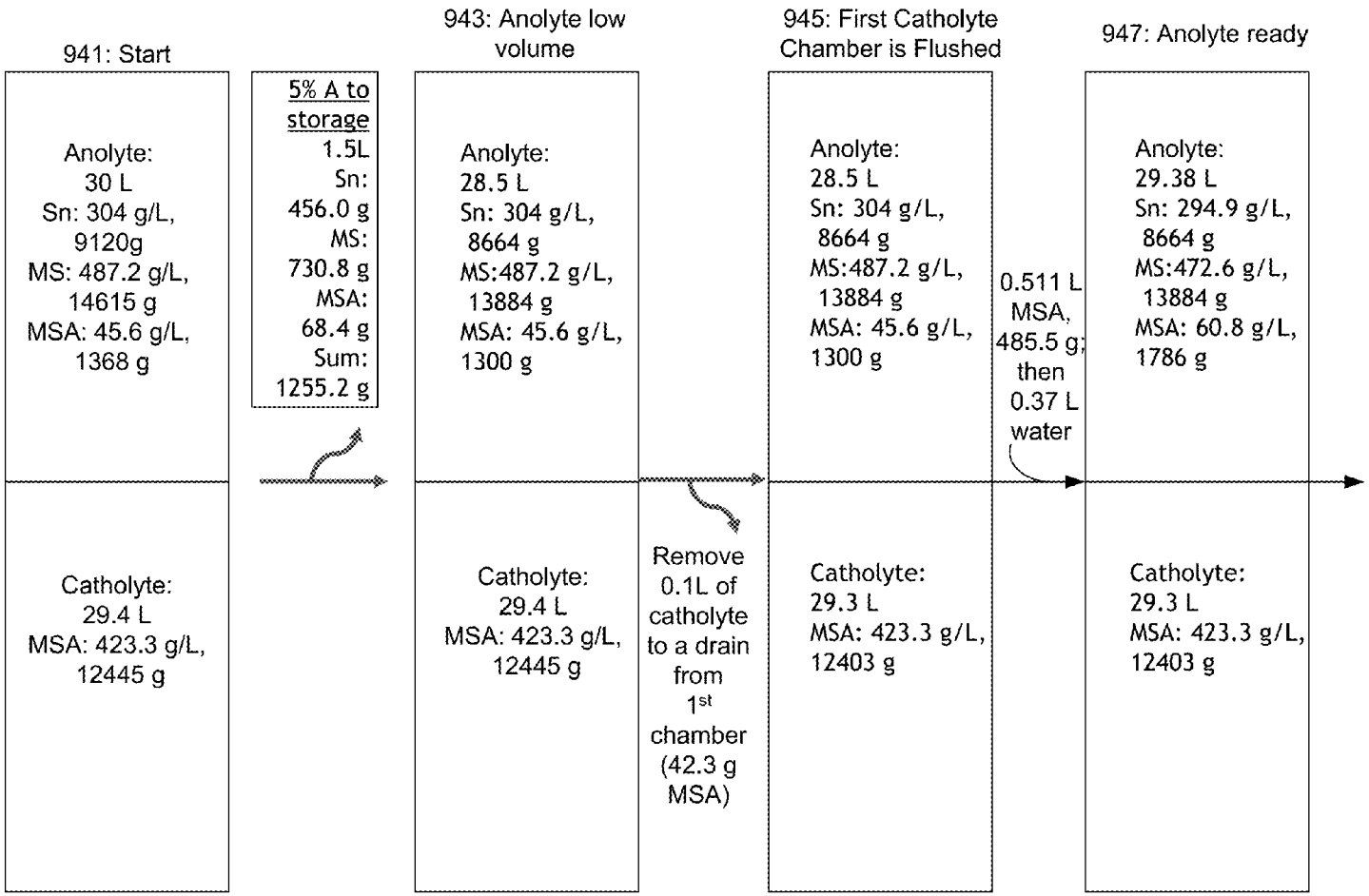
FIG. 9E is a first portion of a diagram illustrating anolyte and catholyte compositions during electrolyte generation according to another embodiment provided herein.
Figure 9F:
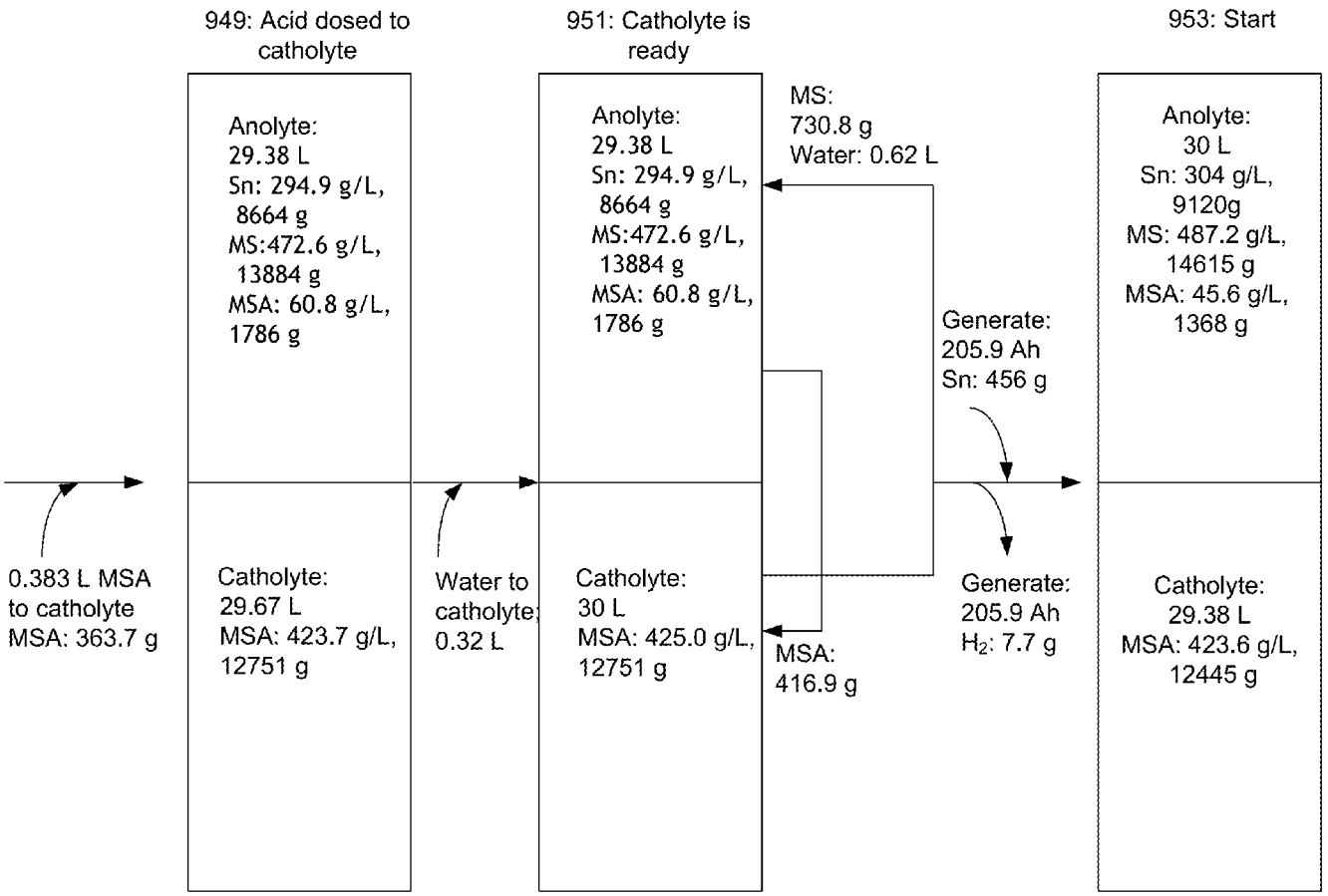
FIG. 9F is a continuation of a diagram provided in FIG. 9E.

In some embodiments it may be more preferable to remove portions of catholyte from the first catholyte chamber to drain, instead of transferring them to the anolyte chamber as was illustrated in FIGS. 9A-9D. In these embodiments, the first catholyte chamber does not serve as a source of acid for the anolyte. Instead acid is added to both the anolyte and catholyte from a source of acid, such as an acid storage tank. Removal of portions of catholyte from the first catholyte chamber to the drain may be useful, because catholyte in the first catholyte chamber may be contaminated with $Sn^{4+}$ ions, and it may be more economically feasible to remove these portions from the system. An example of a process scheme illustrating mass balance maintenance for such embodiment is shown in FIGS. 9E and 9F. Referring to FIG. 9E the process starts in 941, after a pre-determined amount of charge has passed through the generator, indicating that the anolyte has sufficient concentration and is ready to be transferred to the storage tank. At this point, density and conductivity of the anolyte are checked, and if both are within the broad target range, it is determined that the anolyte can be transferred. In the depicted example, in 941 (before the transfer), the anolyte chamber contains 30 liters of an aqueous solution containing $Sn^{2+}$ ions (9120 g), methanesulfonate ions (14615 g), and methanesulfonic acid (1368 g). The catholyte (including first and second catholytes) is 29.4 L of an aqueous solution containing methanesulfonic acid (12445 g). It is noted that in this illustration the catholyte has lost about 0.6 L of volume to the anolyte during previous cycle, because water was transferred through the membrane from the catholyte to the anolyte together with the methanesulfonate ions when current was applied to the cell in the previous cycle. After current was stopped, 5% of the total anolyte volume is transferred to the storage tank, leaving anolyte with low volume as shown in 943. In the next step, conductivity of the catholyte is checked, and if the conductivity is within a broad target range, a portion of catholyte from the first catholyte chamber is removed to drain. As shown in 945, 0.1 L of catholyte containing 42.3 g of methanesulfonic acid is removed from the first catholyte chamber, leaving 29.3 L of total catholyte volume and 12403 g of the MSA in the catholyte (including catholyte in the first and second catholyte chambers that fluidically communicate through a conduit other than a membrane). The next step is to replenish the anolyte, such that a mass balance is maintained. In this step, the anolyte is dosed with the acid, such that the amount of added acid is substantially equal to the sum of amount of acid removed from the anolyte to the electrolyte storage tank (68.4 g of MSA) and the amount of acid that will be transferred from the anolyte to the catholyte through the membrane, when current will be applied (416.9 g). The latter amount is known for a specific type of membrane that is used, based on the known amount of charge that is being passed through the electrolyte generator during one run. Accordingly, an aqueous solution of MSA containing about 485 g of MSA is added to the anolyte from an acid tank. The anolyte is further topped off with water (0.37 L), until its volume reaches 29.38 L. The amount of water that is added in this step, is determined such as to bring the volume of the anolyte to the desired target (in this illustration 30 liters) after water will be transferred from the catholyte to the anolyte during application of current to the cell. After acid and water were added to the anolyte, the anolyte is ready for electrolyte generation, as shown in 947. Next, catholyte is replenished with the acid. In this step 363.7 g of MSA is added to the second catholyte chamber from the MSA solution tank. This amount of added acid is substantially equal to the amount of MSA that will be lost from the catholyte during this cycle to generate $H_2$, plus the amount of MSA that was transferred to the drain from the first catholyte chamber in 945 flush, minus the amount of MSA that will migrate from the catholyte to the anolyte during this cycle when current will be applied. The composition of the resulting catholyte is shown in 949. Next, the catholyte is topped off with 0.32 L of water to bring the catholyte volume to 30 L. At this point the catholyte is ready as shown in 951. Next, a pre-determined amount of charge (205.9 A·h) is passed through the cell, resulting in generation of 456 g of $Sn^{2+}$ ions in the anolyte, and removal of 7.7 g of $H_2$ at the cathode. Also, during application of current to the electrodes, 416.9 g of MSA is transferred from the anolyte to the catholyte through the membrane, and 730.8 g of methanesulfonate along with 0.62 L of water is transferred from the catholyte to the anolyte across the membrane. After the pre-determined amount of charge has been passed, the cycle is completed and the anolyte and catholyte compositions in 953 are substantially the same as they were at the start of the cycle in 941. In total the mass of MSA and tin ions that enter the generator in one cycle is equal to the mass of $H_2$, MSA, and tin ions that exit the generator in the cycle (to the exhaust, to the product storage and to the drain). In the depicted example 1305.2 g of materials entered and exited the system as described.

One of the prominent features of the provided electrolyte generating apparatus is its ability to provide feedback on electrolyte composition using one or more sensors, such as an anolyte density meter, anolyte conductivity meter, a catholyte conductivity meter, or a combination thereof. In some embodiments the sensors are used in order to adjust electrolyte generation process parameters, if an unacceptable drift in electrolyte composition is detected. The sensors are also used to signal that the process needs to be shut down, if one or more electrolyte properties fall outside a broad desired range. For example, if anolyte density, measured by the densitometer falls outside the broad target range, it indicates that the concentration of tin ions in the anolyte is not acceptable, and that the generated tin electrolyte should not be transferred to the product tank. On the other hand, if anolyte density falls inside the broad target range but outside the narrow target range, this would indicate that the anolyte still has an acceptable concentration of tin ions and can be transferred to the product storage tank, but that process parameters for subsequent generation cycles should be adjusted such that the density is restored to the narrow target range, and the drift in density is eliminated.

Figure 10:
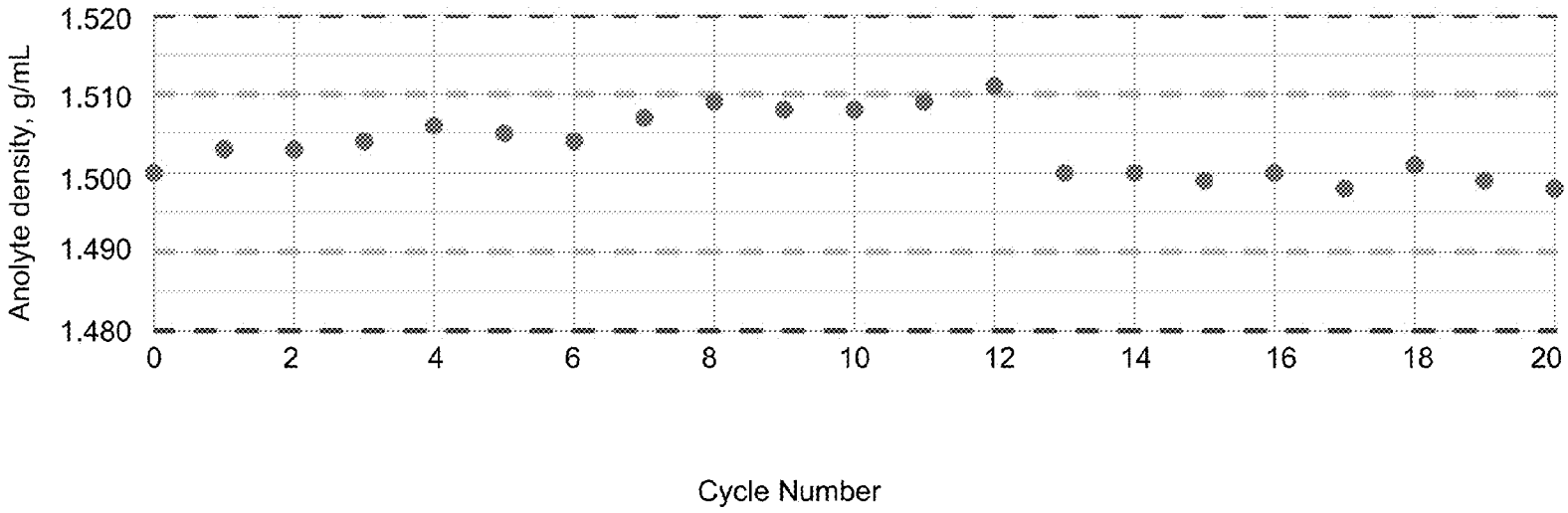
FIG. 10 is an experimental plot illustrating correction of anolyte density drift in accordance with an embodiment provided herein.

FIG. 10 provides an illustration for a method of adjusting electrolyte generation process parameters based on the anolyte density reading. FIG. 10 shows anolyte density values as a function of cycle number. In each cycle the plotted density is measured after current is stopped and before the concentrations of anolyte and catholyte are adjusted. In the depicted example the density range of 1.480-1.520 g/cm$^3$ is the broad target density range, and the density range of 1.490-1.510 g/cm$^3$ is the narrow target density range. It can be seen that in the first eleven cycles, the anolyte density falls both within the narrow and broad target ranges, and no adjustment is needed. At the 12$^{th}$ cycle the measured density of anolyte is 1.511 g/cm$^3$ which falls outside the narrow target range, but is still inside the broad target range. Therefore, the anolyte from the 12$^{th}$ cycle is still transferred to the product tank, but an adjustment of process parameters is triggered by this density reading. It can be seen that the density drifted from 1.500 to 1.511 g/cm$^3$ over 12 cycles, corresponding to a 0.011 g/cm$^3$ positive drift. Such drift in density corresponds to 6.6 g/L excess of tin ion concentration. Since the volume of anolyte is about 30 liters in this example, 6.6 g/L*30 L=198 g of excess tin ions is generated over 12 cycles. Or, 198 g/12 cycles=16.5 g of excess tin ions are generated in one cycle with the observed drift.

First, parameters in the next cycle 13 are adjusted to generate 198 g of tin ions less than in a normal cycle, and to thereby bring the density of anolyte to the target level of 1.500 g/cm$^3$. Assuming that one standard cycle generates 450 g of tin ions, the 13$^{th}$ cycle should generate 198 g less, or 252 g. In this cycle the current should be applied for 252/450=0.56 of the time that was used in a regular run (assuming the same level of current is applied for all runs). In the next step, the process parameters for all subsequent runs are adjusted based on the observed drift of 16.5 g of tin per cycle. In order to compensate for this drift, the duration of each subsequent run should be: (450−16.5)/450=0.96 of the previous run time. Alternatively, the duration of the run may remain the same, but the level of current is reduced accordingly. More generally, the amount of charge that should pass through the system is adjusted by adjusting a duration of the run, the level of applied current, or both.

Drifts in anolyte conductivity and catholyte conductivity are addressed in a similar manner, but the adjustments are made not to the duration of the run, but to the amount of acid that is being added to anolyte and catholyte during each cycle.

In some embodiments, the following rules are adhered to in order to provide optimal process stability and to avoid overcorrections of process parameters. First, it is preferable to adjust no more than one property drift per cycle, even if several sensors indicate that different electrolyte properties are outside of the narrow target range but within the broad target range. For example, if in one cycle anolyte density, anolyte conductivity, and catholyte conductivity are all outside of the narrow target range (but within the broad target range), an adjustment of parameters in this cycle is made only to address the drift in anolyte density, but not the drifts in anolyte and catholyte conductivities. If the anolyte density is within the narrow target range, but both anolyte and catholyte conductivities are outside of the narrow target range, only the drift in anolyte conductivity is addressed in one cycle. Thus, the adjustment of parameters to address the drift in anolyte density is performed before addressing the drifts in anolyte conductivity and/or catholyte conductivity. An adjustment of parameters to address the drift in anolyte conductivity is performed before addressing the drift in catholyte conductivity, and adjustments are made such that only one drift correction is made per cycle. Further, it is preferable not to make frequent corrections to one type of parameter. For example, if sensors indicate that one parameter (e.g., anolyte density) needs to be corrected more often than once in three cycles (i.e., if the parameter falls outside the narrow target range more often than once in three cycles), the automated correction of parameter is not made, and the problem is addressed by an engineer. Lower priority parameters (anolyte and catholyte conductivities) are allowed to run out of narrow target range (but not out of broad target range) to allow 3 cycles after a higher priority parameter adjustment. In the depicted example, the priority of anolyte density is higher than the priority of anolyte conductivity, which is in turn higher than the priority of catholyte conductivity. Finally, if any of the sensors indicate that an electrolyte property (anolyte density, anolyte conductivity, or catholyte conductivity) falls outside the broad target limit, the process is shut down, and the problem is addressed by an engineer.

In one embodiment of tin electrolyte generation, the broad target range for anolyte density is between about 1.4812-1.5296 g/cc; the broad target range for anolyte conductivity is between about 92-96 mS/cm; and the broad target range for catholyte conductivity is between about 451-491 mS/cm. In this illustrative embodiment, these parameters are measured after current is stopped being applied to the cell, and before addition of acid to anolyte (for correction of anolyte conductivity) and catholyte (for correction of catholyte conductivity).

Figure 11A:
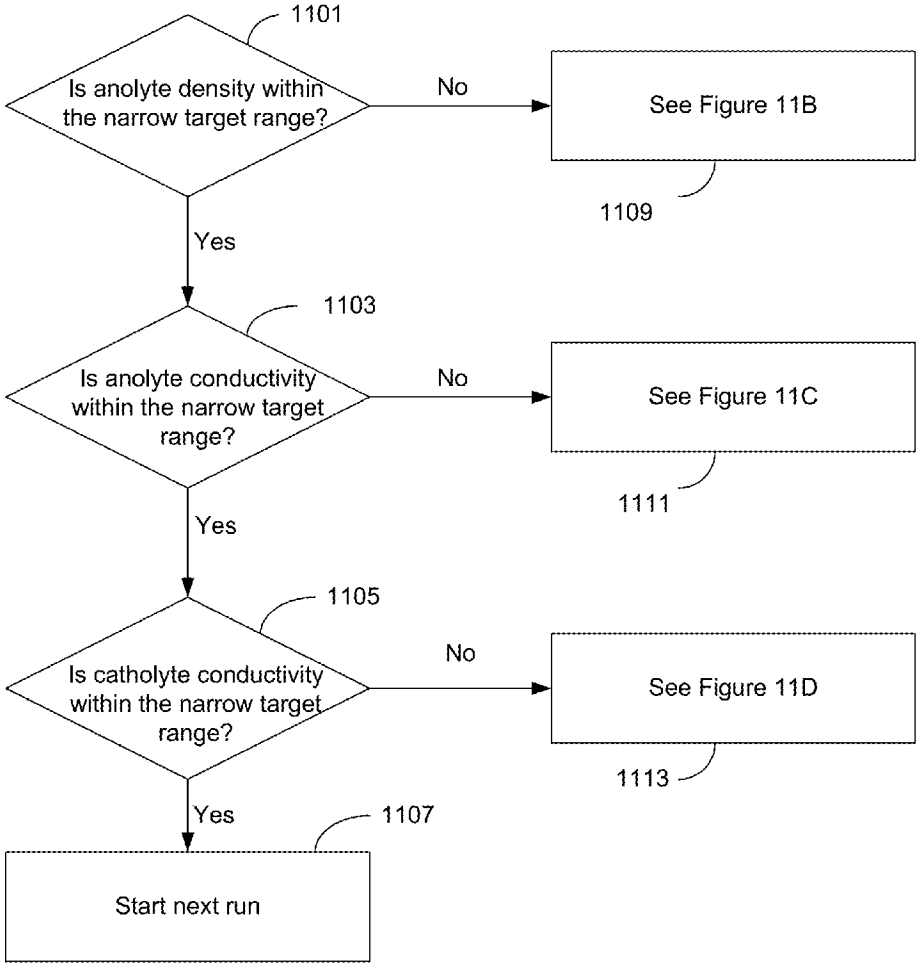
FIGS. 11A-11D are process flow diagrams illustrating adjustments to the process in response to measurements provided by sensors.
Figure 11B:
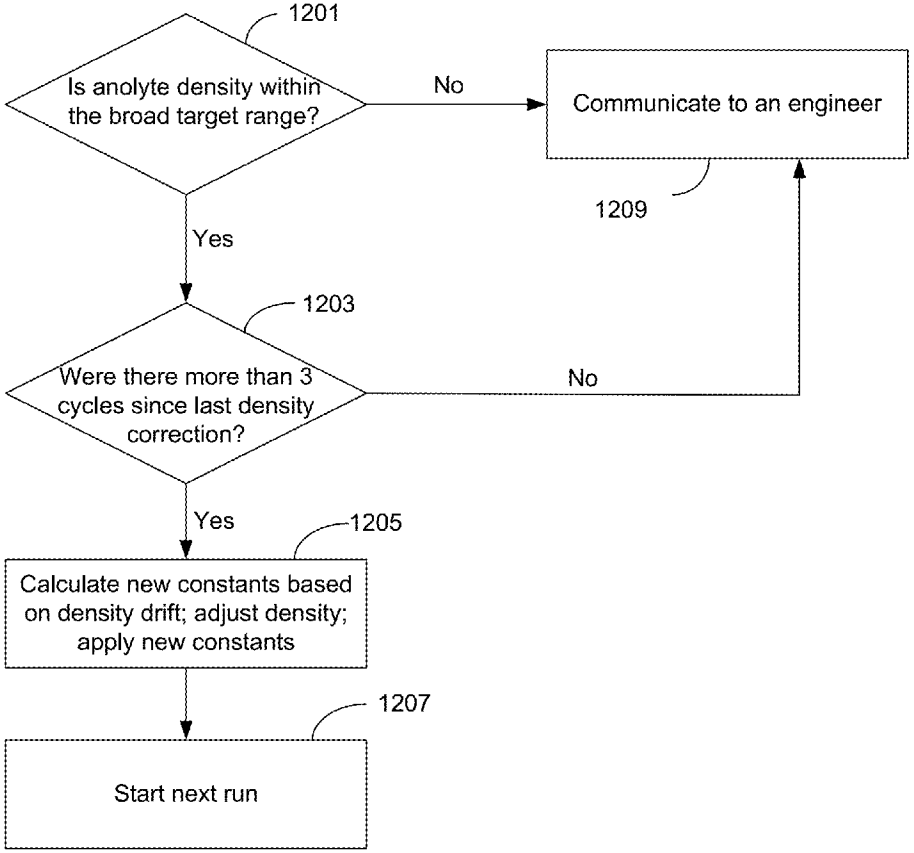

FIGS. 11A-11D provide examples of algorithms for monitoring electrolyte properties and adjusting process parameters in a tin electrolyte generation process. In each cycle, after application of current is stopped, it is first determined if the anolyte density is within the narrow target range, as shown in operation 1101 in FIG. 11A. If this is true, it is then determined if the anolyte conductivity is within the narrow target range, as shown in 1103. Next, if anolyte conductivity is within the narrow target range, catholyte conductivity is checked in 1105. If catholyte conductivity is within the narrow target range, the process can proceed to the next run in 1107, which will include replenishment of anolyte and catholyte with an acid and application of current in the next cycle. If, in operation 1101, it is determined that the anolyte density falls outside the narrow target range, the algorithm shown in FIG. 11B is followed. Referring to FIG. 11B, it is first determined in 1201 if the anolyte density is within the broad target range. If anolyte density is outside the broad target range, this is communicated to the engineer in 1209. Typically, in this case the apparatus operator will receive an error message from the controller and the apparatus will be configured not to proceed further. If anolyte density is within the broad target range, then it is determined in 1203 if there were more than three cycles since last density correction. If there were three or less cycles since last density correction, then the density drifts too fast and this problem is communicated to an engineer in 1209, and the process is not allowed to proceed until the engineer resolves the fast drift issue. If there were more than three cycles since last density correction, the process proceeds in 1205 by calculating new constants for process parameters based on density drift, adjusting the density of the anolyte, and saving the newly calculated constants for the future run. The calculation can be performed as it was shown with reference to FIG. 10. The newly calculated constants may include the new duration of application of current or the new level of current. The adjustment of anolyte density can be performed by running current through the cell. If the density of the anolyte is too high, it can be restored to a target value by running an additional short cycle (which includes removing a portion of anolyte to storage, dosing the anolyte with an acid, and running current for an amount of time that is necessary to bring density to the target value). If the density is too low, the anolyte is dosed with acid, the current is turned on, and tin ion generation proceeds for an amount of time that is necessary to bring the density to a target value. After the new process constants (e.g., level of current to be applied and/or duration of current application) are saved, the counter that monitors the number of cycles since last density correction is reset, and the process proceeds to the next run in 1207.

Figure 11C:
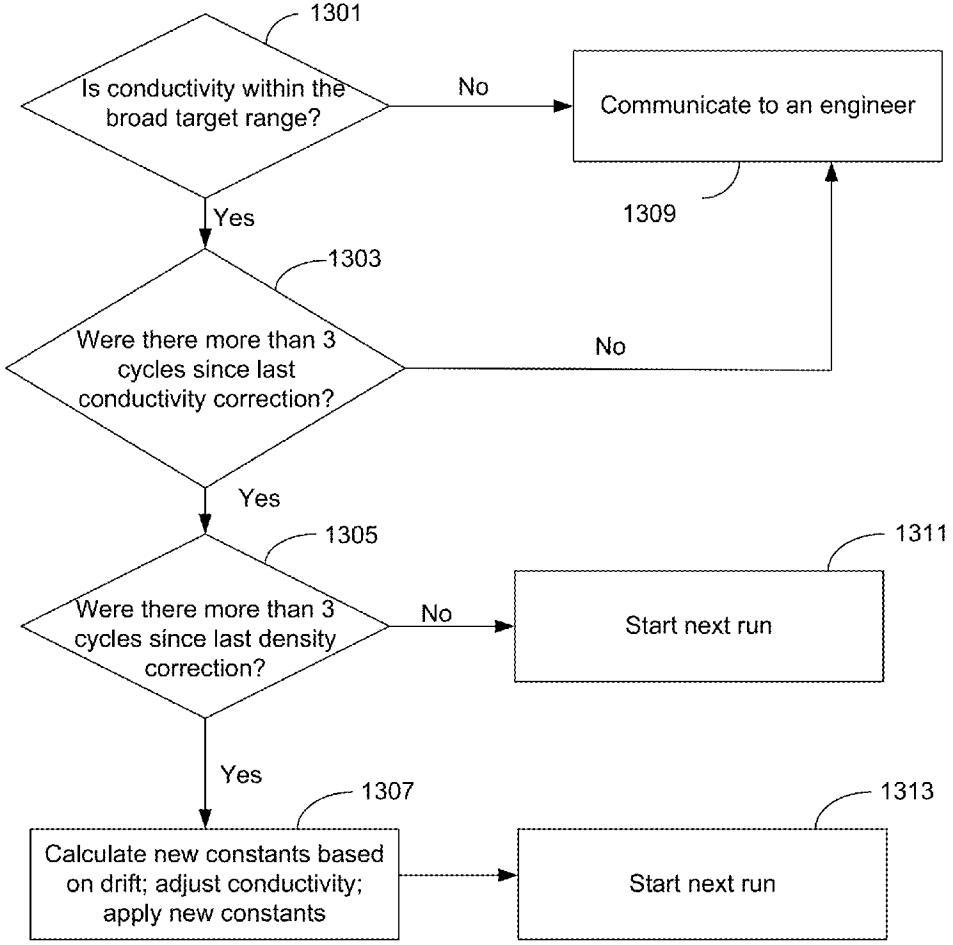

Referring to FIG. 11A, if in 1103 the conductivity of the anolyte is outside the narrow target range, then the algorithm shown in FIG. 11C should be followed. First, it is determined in 1301 if the anolyte conductivity is within the broad target range. If it is outside the broad target range, this is communicated to an engineer in 1309, and the process is not allowed to proceed. Next, it is determined in 1303 if there were more than three cycles since last anolyte conductivity correction. If there were three cycles or less, the engineer is notified in 1309. The process is not allowed to proceed and the engineer addresses the problem of excessively fast anolyte conductivity drift. If there were more than three cycles since last anolyte conductivity correction, it is determined in 1305 if there were more than three cycles since last anolyte density correction. If there were three or less cycles since last anolyte density correction, then no correction to anolyte conductivity is made in this cycle and the next run is started in 1311, while preserving the old constants. If there were more than three cycles since last anolyte density correction, then in 1307 new constants are calculated based on anolyte conductivity drift, the conductivity of the anolyte is restored to the target value, and the new constants are saved for use in subsequent cycles. If the density and conductivity data both indicate that the tin ion concentration is within the narrow target range, but the acid anolyte concentration is outside the narrow target range, the amount of acid that is to be added in a give cycle is adjusted (increased or decreased), such as to compensate for the drift in the acid concentration. If the density of the anolyte is well controlled (e.g., within 1.48-1.52 g/cm$^3$ range), then the anolyte conductivity value alone may be considered to determine if the amount of acid added in subsequent cycles should be adjusted, and the new constants for the amounts of acid to-be-added are generated. Next, a new run is started in 1303 using the newly calculated process constants.

Figure 11D:
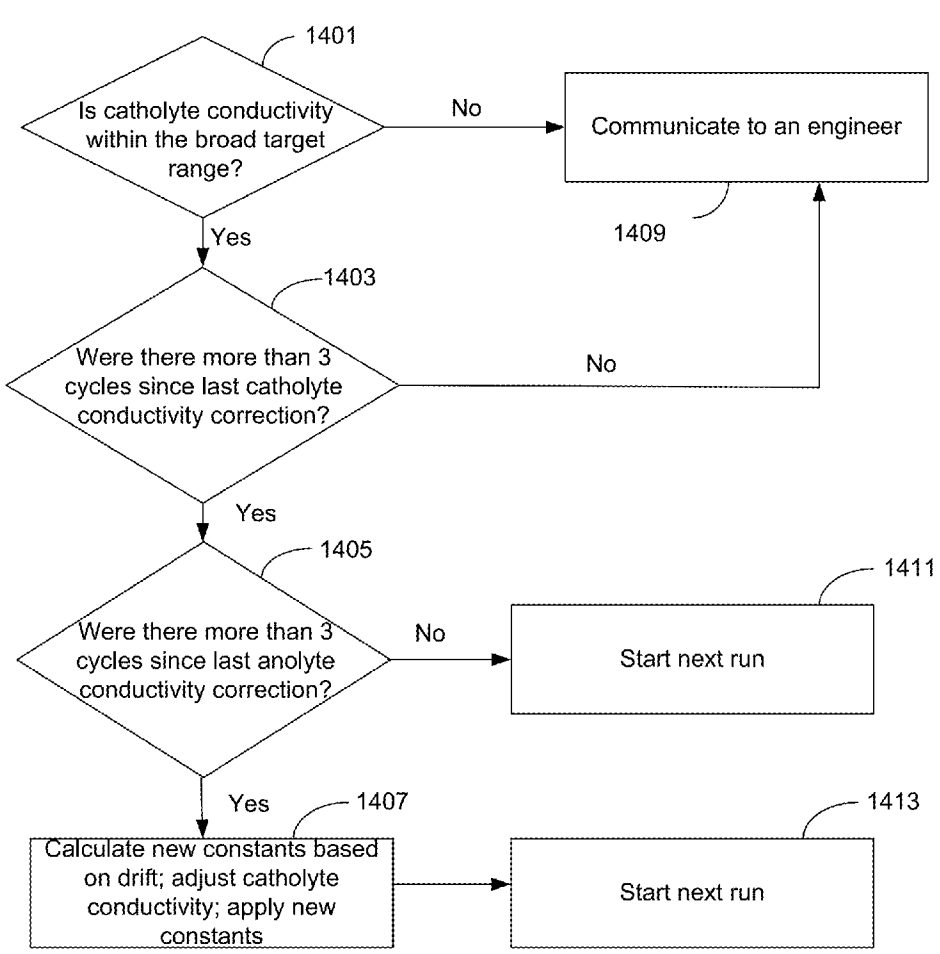

Referring to FIG. 11A, if in 1105 the conductivity of the catholyte is outside the narrow target range, then the algorithm shown in FIG. 11D should be followed. First, it is determined in 1401 if the catholyte conductivity is within the broad target range. If it is outside the broad target range, this is communicated to an engineer in 1409, and the process is shut down. Next, it is determined in 1403 if there were more than three cycles since the last catholyte conductivity correction. If there were three cycles or less, the engineer is notified in 1409. The process is not allowed to proceed and the engineer addresses the problem of excessively fast catholyte conductivity drift. If there were more than three cycles since last anolyte conductivity correction, it is determined in 1405 if there were more than three cycles since the last anolyte conductivity correction. If there were three or less cycles since the last anolyte conductivity correction, then no correction to catholyte conductivity is made in this cycle and the next run is started in 1411, while preserving the old constants. If there were more than three cycles since last anolyte conductivity correction, then in 1407 new constants are calculated based on catholyte conductivity drift, the conductivity of the catholyte is restored to the target value, and the new constants (amount of acid to be added to the catholyte) are saved for use in subsequent cycles. When the drift in catholyte conductivity is observed than the amount of acid added to the catholyte in each cycle (after the conductivity is measured, and a portion of catholyte is removed from the first catholyte chamber) is adjusted (increased if the conductivity is too high or decreased if the conductivity is too low), such that upon addition of water to the catholyte, the concentration of acid would remain in the narrow target range. Next, a new run is started in 1403 using the newly calculated process constants.

As it was previously mentioned the systems and apparatuses disclosed herein may include a process controller (or a plurality of controllers) having program instructions or built-in logic for performing any of the methods provided herein. Specifically the controller is configured to accept information from one or more sensors, such as a densitometer, a conductivity meter, an electrolyte level sensor, to process these parameters and to generate instructions for the apparatus, based on the data acquired from a sensor or sensors. In addition one or several controllers can be programmed to provide program instructions for an integrated system including an electrolyte generator and one or more electroplating apparatuses, and may be configured to provide an electrolyte having in desired amounts on demand.

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

In one aspect, a non-transitory computer machine-readable medium comprising program instructions for control of an electrolyte generation and distribution tool is provided, wherein the program instructions comprising code for performing any of the methods presented herein.

Experimental Density and Conductivity Measurements

Figure 12B:
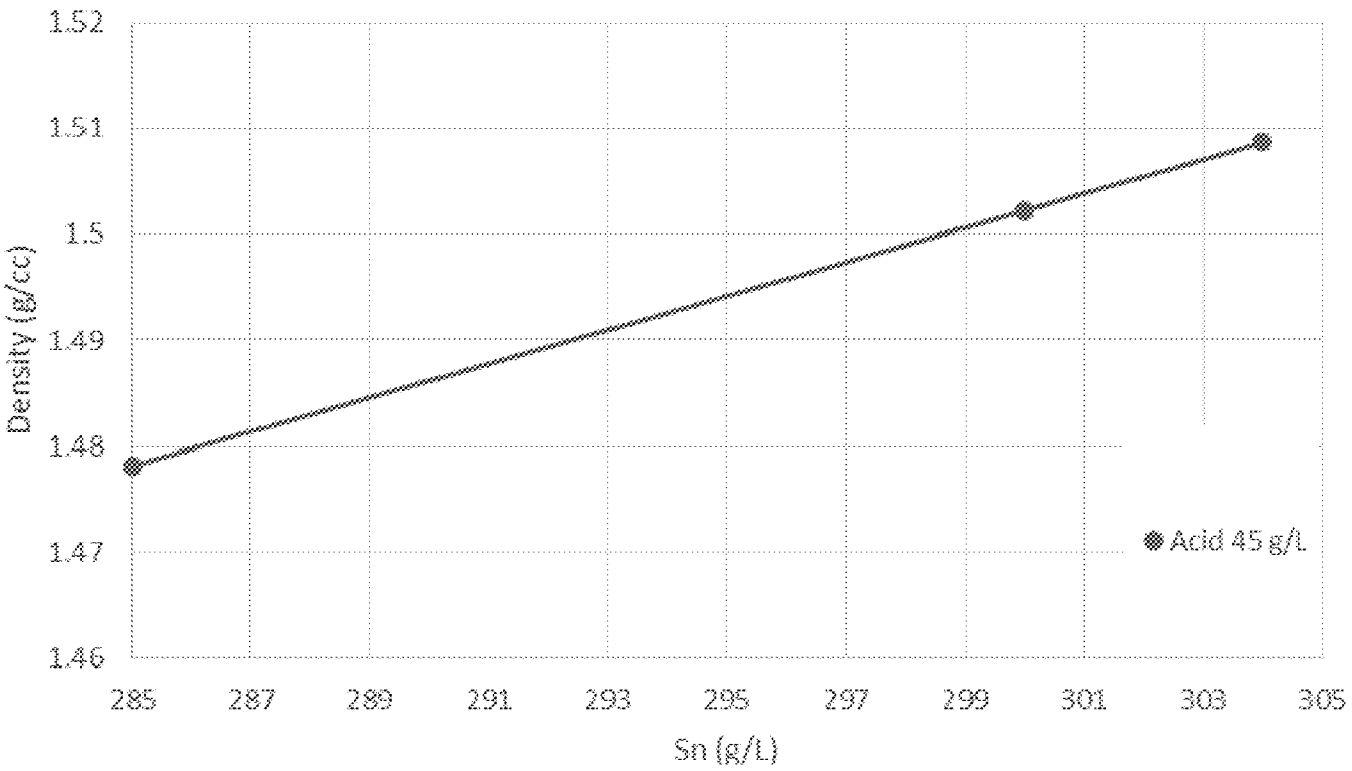

In some embodiments both density and conductivity sensors are used to determine when the metal and acid concentrations in the anolyte are within the target range. It was determined that the density of a solution containing $Sn^{2+}$ salt depends linearly on the concentration of $Sn^{2+}$ ions and exhibits relatively small changes with the variation of acid concentration. FIG. 12A provides an experimental plot illustrating dependence of density of aqueous solutions containing tin (II) methanesulphonate, on the concentration of $Sn^{2+}$ ions. FIG. 12A shows four linear dependencies, where each linear function corresponds to solutions having a constant concentration of methanesulfonic acid (0, 30, 45, and 60 g/L). It can be seen that in all four cases a linear dependence on tin ion concentration is observed over a wide tin ion concentration range (0-300 g/L of $Sn^{2+}$) and that variations in density of solutions having different acid concentrations, but same tin ion concentration, are relatively small. FIG. 12B shows dependence of solution density on tin ion concentration for solutions containing methanesulphonic acid at a concentration of 45 g/L and tin ions in a range of between 285 and 304 g/L. In some embodiments, these concentrations are the working ranges for the anolyte (i.e., the concentration of MSA is about 45 g/L and the concentration of tin ions is between about 285-305 g/L).

Figure 12C:
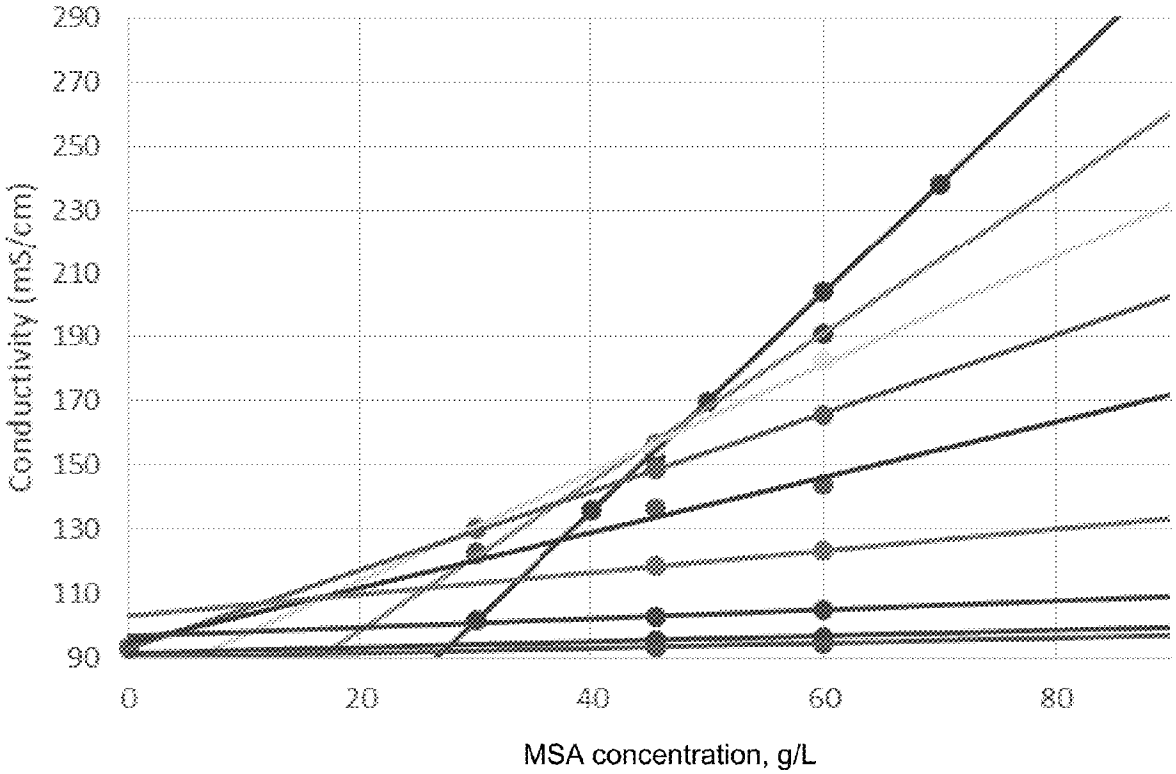
FIGS. 12C-12D are experimental plots illustrating linear dependence of solution conductivity on acid concentration.
Figure 12D:
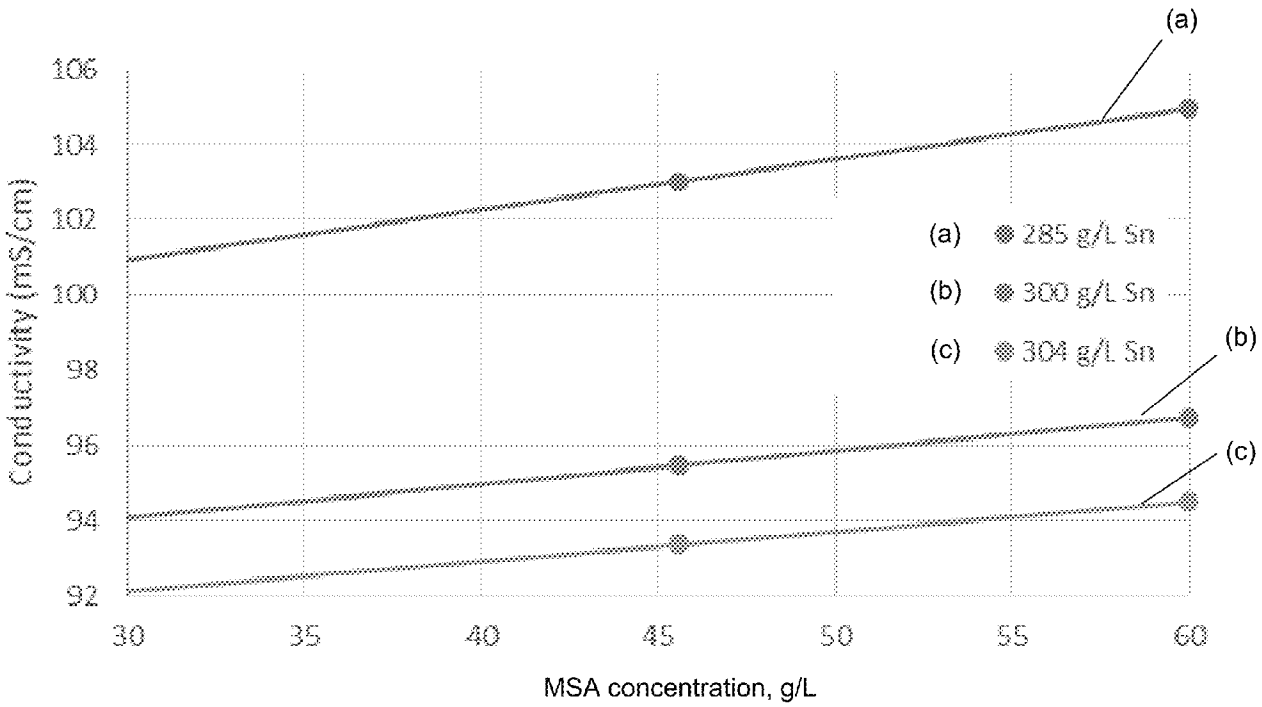

It was also shown that conductivity of solutions containing acid and a tin salt linearly depends on the concentration of acid at a variety of tin ion concentrations. FIG. 12C shows a family of linear curves illustrating the dependence of conductivity on the concentration of MSA in aqueous MSA solutions containing tin ions. The linear curve with the greatest slope corresponds to MSA solutions containing no tin ions, while the linear curve with the smallest slope corresponds to MSA solutions containing 304 g/L of tin ions. The remaining linear curves correspond to MSA solutions containing 50, 100, 150, 200, 250, and 300 g/L of tin ions, where the slope of the linear curve decreases with the increasing concentration of tin ions. FIG. 12D shows the linear curves corresponding to MSA solutions containing tin ions at concentrations of 250, 300, and 304 g/L for the MSA concentration range of between 30-60 g/L. These concentrations, in some embodiments, are encountered as working concentrations of MSA and tin ions in the anolyte during electrolyte generation. When the concentration of tin ions is stable, the conductivity alone can be used to determine the concentration of acid in the anolyte, and to determine if adjustments to acid concentration are needed.

The invention claimed is:

1. An apparatus for generating an electrolyte containing metal ions, the apparatus comprising:

(a) an anolyte chamber configured to contain an active anode and an anolyte, wherein the apparatus is configured to electrochemically dissolve the active anode into the anolyte, and to thereby form the electrolyte containing metal ions, wherein the anolyte chamber comprises:
  (i) an inlet for receiving a fluid;
  (ii) an outlet for removing the anolyte; and
  (iii) one or more sensors configured for measuring a concentration of metal ions in the anolyte;

(b) a first catholyte chamber separated from the anolyte chamber by a first anion permeable membrane, wherein the first catholyte chamber is configured to contain a first catholyte;

(c) a second catholyte chamber configured to contain a cathode and a second catholyte, wherein the second catholyte chamber is separated from the first catholyte chamber by a second anion permeable membrane, wherein the first catholyte chamber and the second catholyte chamber are fluidically connected through a fluidic conduit, wherein the fluidic conduit allows for transfer of the second catholyte from the second catholyte chamber to the first catholyte chamber.

2. The apparatus of claim 1, wherein the first catholyte chamber and the second catholyte chamber are parts of a removable cathode-housing assembly, wherein the removable cathode-housing assembly is configured to be releasably inserted into the anolyte chamber.

3. The apparatus of claim 1, wherein the apparatus is configured to deliver the first catholyte from the first catholyte chamber to the anolyte chamber through a fluidic conduit, and/or wherein the apparatus is configured to remove the first catholyte from the first catholyte chamber to a drain.

4. The apparatus of claim 1, wherein the apparatus comprises a single piece metal anode.

5. The apparatus of claim 1, wherein the anolyte chamber comprises an ion -permeable container for containing a plurality of metal pieces that serve as an anode.

6. The apparatus of claim 5, wherein the anolyte chamber further comprises a receiving port for receiving a plurality of metal pieces into the ion-permeable container.

7. The apparatus of claim 6, wherein the receiving port comprises a gravity fed hopper.

8. The apparatus of claim 6, wherein the receiving port comprises a sensor configured to communicate to a system controller when the level of metal pieces in the receiving port is low.

9. The apparatus of claim 1, wherein the apparatus comprises a hydrogen-generating cathode positioned in the second catholyte chamber.

10. The apparatus of claim 9, wherein the apparatus comprises a diluent gas conduit configured to deliver a diluent gas to a space above the second catholyte, and to dilute hydrogen gas accumulating in that space, wherein the space above the second catholyte is covered with a first lid having one or more openings that allow for transfer of diluted hydrogen gas into a space above the first lid.

11. The apparatus of claim 10, further comprising: a second lid over the first lid and spaced apart from the first lid such that there is a space between the first and the second lids; and a second diluent gas conduit configured to deliver a diluent gas to a space between the first and second lids and to move the diluted hydrogen gas from the space between the first and second lids towards an exhaust.

12. The apparatus of claim 1, wherein the anolyte chamber comprises a cooling system.

13. The apparatus of claim 1, wherein the anolyte chamber comprises a cooling system that is located in a cooling portion of the anolyte chamber away from the active anode.

14. The apparatus of claim 13, further comprising a fluidic conduit and an associated pump configured to deliver the anolyte from the anolyte chamber outlet to the cooling portion of the anolyte chamber, wherein the anolyte chamber outlet is located proximate the active anode.

15. The apparatus of claim 1, wherein the apparatus is configured to measure the concentration of metal ions in the anolyte with the one or more sensors, and to communicate the measurement to an apparatus controller.

16. The apparatus of claim 15, wherein a single sensor is used for measuring the concentration of metal ions in the anolyte and the sensor is a densitometer.

17. The apparatus of claim 15, wherein at least two sensors are used for measuring the concentration of metal ions in the anolyte, wherein the at least two sensors comprise a densitometer and a conductivity meter.

18. The apparatus of claim 17, wherein the densitometer and the conductivity meter are further configured for measuring the concentration of acid in the anolyte.

19. The apparatus of claim 18, wherein the conductivity meter is an inductive probe.

20. The apparatus of claim 1, further comprising a sensor configured to measure a concentration of acid in the second catholyte.

21. The apparatus of claim 1, wherein the apparatus comprises a controller having program instructions for automatically generating electrolyte having a concentration of metal ions in a target range.

22. The apparatus of claim 1, further comprising a fluidic connection allowing for automated transfer of the anolyte from the anolyte chamber to an electrolyte storage tank, wherein the electrolyte storage tank is fluidically connected to an electroplating tool, and wherein the apparatus is configured to deliver the electrolyte from the electrolyte storage tank to the electroplating tool.

23. The apparatus of claim 1, further comprising an accessible compartment configured for holding a replaceable source of an acid, wherein the replaceable source of an acid is fluidically connected with the inlet of the anolyte chamber, and said fluidic connection comprises an acid buffer tank, wherein the apparatus is configured to deliver the acid from the replaceable source of the acid to the acid buffer tank and from the acid buffer tank to the anolyte chamber.

24. The apparatus of claim 1, wherein the anolyte chamber further comprises an anolyte recirculation loop.

* * * * *